US009808666B1

(12) United States Patent
Burkinshaw

(10) Patent No.: US 9,808,666 B1
(45) Date of Patent: Nov. 7, 2017

(54) FULL BODY EXERCISE APPARATUS

(71) Applicant: Colin M. Burkinshaw, Pflugerville, TX (US)

(72) Inventor: Colin M. Burkinshaw, Pflugerville, TX (US)

( * ) Notice: Subject to any disclaimer, the term of this patent is extended or adjusted under 35 U.S.C. 154(b) by 0 days.

(21) Appl. No.: 15/640,808

(22) Filed: Jul. 3, 2017

Related U.S. Application Data

(63) Continuation-in-part of application No. 14/690,452, filed on Apr. 19, 2015, now Pat. No. 9,724,554.

(60) Provisional application No. 61/982,022, filed on Apr. 21, 2014.

(51) Int. Cl.

| | |
|---|---|
| ***A63B 21/00*** | (2006.01) |
| ***A63B 21/068*** | (2006.01) |
| ***A63B 21/16*** | (2006.01) |
| ***A63B 23/00*** | (2006.01) |
| ***A63B 21/055*** | (2006.01) |

(52) U.S. Cl.

CPC .... *A63B 21/4035* (2015.10); *A63B 21/00069* (2013.01); *A63B 21/00185* (2013.01); *A63B 21/0557* (2013.01); *A63B 21/068* (2013.01); *A63B 21/1636* (2013.01); *A63B 21/4009* (2015.10); *A63B 21/4043* (2015.10); *A63B 23/00* (2013.01); *A63B 2023/006* (2013.01); *A63B 2209/08* (2013.01); *A63B 2209/10* (2013.01); *A63B 2225/09* (2013.01); *A63B 2225/68* (2013.01)

(58) Field of Classification Search

CPC ..... A63B 21/0552; A63B 21/0557; A63B 21/4025; A63B 21/0442; A63B 21/4011; A63B 21/4009; A63B 23/03541; A63B 21/4043; A63B 21/4017; A63B 21/4007; A63B 21/4015; A63B 21/4035; A63B 21/00069; A63B 2209/10; A63B 21/00185; A63B 21/00043; A63B 21/02; A63B 21/0555; A63B 21/4019; A63B 21/0004; A63B 23/03575

USPC ..... 482/124

See application file for complete search history.

(56) References Cited

U.S. PATENT DOCUMENTS

| | | | | |
|---|---|---|---|---|
| 3,458,188 | A | 7/1969 | Infante | |
| 5,141,223 | A | 8/1992 | Block | |
| 5,158,510 | A | 10/1992 | Lemire | |
| 5,336,151 | A | 8/1994 | Van Ballegooie | |
| 5,433,688 | A | 7/1995 | Davies | |
| 5,450,991 | A * | 9/1995 | Neading | A45F 3/00 224/250 |
| 5,618,249 | A | 4/1997 | Marshall | |
| 5,647,827 | A | 7/1997 | Gutkowski | |
| 5,716,307 | A | 2/1998 | Vadher | |

(Continued)

FOREIGN PATENT DOCUMENTS

EP 0344723 B1 3/1989

*Primary Examiner* — Andrew S Lo
(74) *Attorney, Agent, or Firm* — ClearPat Services, LLC

(57) ABSTRACT

A portable exercise apparatus utilized for exercising, stretching, and training multiple muscle groups of the body of a user. The apparatus is adapted to be worn about the waist or carried as a bandolier about the user's body. The apparatus has at least one releasably closable pocket and fixation rings for securing and carrying accessories, such as attachable handles, suspension lines, and elastic bands. The apparatus and methods of use provide the user with a plurality of configurations for assisted exercise regimens and the flexibility to exercise anywhere.

19 Claims, 24 Drawing Sheets

(56) References Cited

U.S. PATENT DOCUMENTS

| | | | | |
|---|---|---|---|---|
| 5,743,838 | A | 4/1998 | Willis | |
| 5,769,764 | A | 6/1998 | Tilberis | |
| 5,792,034 | A | 8/1998 | Kozlovsky | |
| 5,820,534 | A | 10/1998 | Vadher | |
| 5,876,310 | A | 3/1999 | MacKey | |
| 5,993,362 | A | 11/1999 | Ghobadi | |
| 6,371,346 | B1 * | 4/2002 | Sharma | A45F 3/14 224/195 |
| 6,837,834 | B2 | 1/2005 | Basting | |
| 7,207,931 | B2 | 4/2007 | Boland | |
| 7,316,636 | B1 | 1/2008 | Hinds | |
| 7,854,694 | B1 | 12/2010 | Frunzi | |
| 8,556,754 | B2 | 10/2013 | Roman | |
| 8,617,037 | B2 | 12/2013 | Dieter | |
| 8,998,052 | B1 * | 4/2015 | Mitchell | A45F 3/14 224/250 |
| 2001/0034291 | A1 | 10/2001 | Horton | |
| 2002/0187884 | A1 | 12/2002 | McGrath | |
| 2003/0216220 | A1 | 11/2003 | Rota | |
| 2004/0087420 | A1 | 5/2004 | Montesquieu | |
| 2005/0113221 | A1 | 5/2005 | Dovner | |
| 2005/0113223 | A1 | 5/2005 | Donver | |
| 2005/0170937 | A1 | 8/2005 | Van Straaten | |
| 2006/0019806 | A1 | 1/2006 | Mikulski | |
| 2007/0015642 | A1 | 1/2007 | Demeniuk | |
| 2007/0173383 | A1 | 7/2007 | Feigenbaum | |
| 2007/0232449 | A1 | 10/2007 | Planke | |
| 2008/0293545 | A1 | 11/2008 | Planke | |
| 2009/0075789 | A1 | 3/2009 | Hetrick | |
| 2009/0075790 | A1 | 3/2009 | Hetrick | |
| 2009/0215593 | A1 | 8/2009 | Ligrano | |
| 2010/0126902 | A1 | 5/2010 | Garza | |
| 2010/0152002 | A1 | 6/2010 | Knight | |
| 2011/0172064 | A1 | 7/2011 | Cutler | |
| 2011/0224055 | A1 | 9/2011 | Kassel | |
| 2011/0237410 | A1 | 9/2011 | Perez | |
| 2012/0108403 | A1 | 5/2012 | Zandman-Zem | |
| 2012/0152772 | A1 * | 6/2012 | Garner | A45F 4/12 206/223 |
| 2012/0202658 | A1 | 8/2012 | Menefee, Sr. | |
| 2013/0045842 | A1 | 2/2013 | Wood | |
| 2013/0079201 | A1 | 3/2013 | Morgan | |
| 2013/0085046 | A1 | 4/2013 | Jolly | |
| 2013/0143724 | A1 | 6/2013 | DeMeo | |
| 2014/0005015 | A1 * | 1/2014 | Hester | A63B 21/154 482/131 |
| 2014/0155229 | A1 * | 6/2014 | Nikkaran | A63B 21/068 482/99 |

* cited by examiner

FULL BODY EXERCISE APPARATUS

CROSS-REFERENCE TO RELATED APPLICATIONS

This application is a continuation-in-part of application of Ser. No. 14/690,452, filed Apr. 19, 2015, and to which application we claim priority under 35 USC §120; and claims the benefit of U.S. Provisional Application No. 61/982,022, filed Apr. 21, 2014, which applications are incorporated herein by reference in their entirety.

BACKGROUND OF THE INVENTION

The present invention relates to exercise equipment. More specifically, the present invention relates to an exercise system that provides the user with a portable exercise assistance apparatus.

Some specialized exercise programs incorporate accessory devices to add strength and flexibility options and to further expand the exercise program. Unfortunately, due to their bulk, most of these accessories are quite heavy, difficult to transport and limit their use to a restricted location such as a fitness gym, which in turn limits the general utility of such exercise programs.

SUMMARY OF THE INVENTION

Many exercise enthusiasts feel claustrophobic in the indoor fitness gym environment and wish to take their exercise programs outdoors, but feel limited by the lack of available portable equipment. Some "hard-core" enthusiasts have even gone so far as to make use of existing structures and created exercise sports such as Parkour, Freerunning, Buildering, spelunking, rock climbing, urban rock climbing, and Plyometrics, also known as "jump training" or "plyos", in an attempt to combine their running and aerobic exercise with strength training.

However, not every "weekend athlete" can train as intensely or has access to the training protocols or facilities utilized by many of these hard-core athletes. There remains a need for a portable apparatus that is lightweight, easy to use, and easily transportable that provides the exercise enthusiast, or those who prefer not to be restricted to a gym environment, with a system that can add variety to their routine and allow them to have a gym fitness experience while exercising anywhere.

Illustrated and described herein, is a versatile, lightweight, and durable exercise apparatus for exercising multiple muscle groups of the entire body. The exercise apparatus comprises a layered strap or strap-like apparatus adapted to be worn about the waist, carried across the chest of the user's body as a bandolier, or simply carried and stored in a gym bag. The apparatus comprises a pocket or pockets for securing and carrying exercise accessories such as suspension lines, releasable handles, and elastic bands, among other items, attachable to multiple fixation rings located at various points about the strap-like apparatus. The apparatus and described methods of use provide the user with balanced loading options to develop and improve muscle strength, flexibility and tone while providing the user with the flexibility to exercise anywhere that is convenient to the user.

The apparatus can be worn or carried anywhere by the user and can provide an outdoor enthusiast with portable exercise equipment to perform balanced resistance and tension training utilizing coupled non-elastic bands, elastic bands, detachable and affixed handles with flexible straps used in various exercise protocols and therapeutic applications.

Further, the apparatus is adaptable for use as a physical therapy device to be utilized at home by physically compromised individuals or individuals recovering from injury. Additionally, the device can be utilized by individuals with limited physical capacity due to age, handicap or health concerns as part of regular health maintenance program. Further still, the apparatus can be incorporated into conventional programs such as yoga, aerobics, kickboxing, martial arts or similar exercise regimens to add additional strength and stretching protocols to such programs. Even further, the apparatus can be utilized while traveling or away from home on business, or in a hotel.

Provided herein is an exercise apparatus comprising a strap-like apparatus or belt adapted to be worn about the user's body, wherein the apparatus or strap-like belt comprises at least a first layer and a second layer, wherein the first layer comprises a first inside surface and a first outside surface, and the second layer comprises a second inside surface and a second outside surface; a pocket or pockets between the first inside surface and the second inside surface, which can be continuous or segregated into two or more compartment-like pockets; a connector strap comprising a first end and a second end and affixed to the outside surface or inside surface of the first layer, wherein the connector strap comprises a coupling mechanism for releasably securing the first end and second end of the connector strap to each other; a first handle and a second handle permanently or temporarily affixable to the connector strap or directly to the outside of the apparatus, wherein each handle is spaced approximately equidistant from the lengthwise center of the layered strap-like apparatus; a first fixation ring affixed adjacent to the first end of the strap-like apparatus, extending outside of the pocket; and a second fixation ring affixed adjacent to the second end of the strap-like apparatus, extending outside of the pocket; wherein the first and second fixation rings are affixed between the first and second layers and to the connector strap or are affixed directly to the connector strap.

In some embodiments, the device comprises a third layer, wherein the third layer comprises a third inside surface and a third outside surface. In some embodiments, the third layer is an extension of the first layer and folds over the second layer to enclose the at least one pocket between the first inside surface and the second inside surface.

In some embodiments, the layers are formed from a single piece of folded material. In some embodiments, the layers are formed from two or more pieces of material and joined along their lengthwise edges.

In some embodiments, the exercise apparatus comprises a third fixation ring affixed to the connector strap and through the approximate lengthwise center of the strap-like apparatus and accessible through at least one access point in the layers of the strap-like apparatus.

In some embodiments of the exercise apparatus, the at least one pocket is at least partially closable along the lengthwise edge.

In some embodiments of the exercise apparatus, the at least one pocket is at least partially closable at the first longitudinal end and/or the second longitudinal end.

In some embodiments of the exercise apparatus, the first longitudinal end and/or the second longitudinal end of the at least one pocket are at least partially closed with a permanent fixation means. In some embodiments, the permanent fixation means comprise thread; rivets; heat bonding materials; and glues or epoxies.

In some embodiments, the exercise apparatus comprises a fourth fixation ring affixed adjacent to the first end of the strap-like apparatus and a fifth fixation ring affixed adjacent to the second end of the strap-like apparatus, near the first and second fixation rings, wherein the fourth and fifth fixation rings are affixed between the first and second layers, within the at least one pocket, and to the connector strap and are accessible from the inside of the at least one pocket.

In some embodiments of the apparatus, the two or more segregated compartment-like pockets are closable along a lengthwise edge. In some embodiments of the apparatus, the two or more segregated compartment-like pockets are individually closable along a lengthwise edge.

In some embodiments of the apparatus, the two or more segregated compartment-like pockets are closable at a first end and a second end.

Further still, in some embodiments of the apparatus, a pocket which may be continuous, or comprising two or more segregated compartment-like pockets, are sewn closed at a first end or a second end, or both ends of the pocket, or each end of the two or more segregated pockets.

In some embodiments, the apparatus further comprises at least one securing mechanism configured to releasably capture and at least partially close the lengthwise edge or edges that comprise an edge of a pocket or pockets between the first inside surface and the second inside surface of the first two layers of the apparatus, or a lengthwise edge that forms a third layer or cover for the pocket or pockets.

In some embodiments, the apparatus further comprises at least one securing mechanism configured to releasably capture and at least partially close the first longitudinal end and/or the second longitudinal end of the at least one pocket.

In some embodiments, the at least one securing mechanism to releasably capture and at least partially close the lengthwise edge or edges, and/or ends of the pocket or pockets comprises: a lace, a flap; a Velcro™ connection; a compression snap; a zipper; a magnet; a buckle; a button; a clasp; a flexible material strap; or a hook.

In some embodiments of the apparatus, the first handle and second handle are permanently affixed.

In some embodiments of the apparatus, the first handle and second handle comprise collapsible handgrips, flexible bands; or a tubular grip with a flexible band of material extended therethrough and connected together at the ends thereof.

In some embodiments of the apparatus, the at least one pocket is configured to releasably capture and secure accessory articles.

In some embodiments, the exercise apparatus further comprises at least a releasably attachable third handle.

In some embodiments of the apparatus, the releasably attachable third handle comprises a flexible material strap.

In some embodiments of the apparatus, the releasably attachable third handle comprises an auxiliary fixation ring and/or quick-release attachment coupling on a first end and a second end of the strap.

In some embodiments of the apparatus, the auxiliary fixation rings and/or quick-release attachment couplings of the releasably attachable third handle are attachable to any of the fixation rings on the exercise apparatus.

In some embodiments, the exercise apparatus further comprises at least one releasably attachable elastic band.

In some embodiments of the apparatus, the at least one releasably attachable elastic band comprises an auxiliary fixation ring and/or quick-release attachment coupling on a first end and a second end of the attachable elastic band.

In any one of the embodiments of the apparatus, the coupling mechanism for releasably securing the ends of the connector strap of the layered strap-like apparatus comprises: a belt buckle; a cam buckle; a Velcro™ attachment; a Velcro™ hook and loop; airline seat buckle; a side release buckle; a double loop and strap of material; and a snap hook and ring.

In some embodiments, the belt buckle further comprises a frame-style buckle; a plate-style buckle; a box-out buckle; and a box-frame buckle.

In some embodiments of the apparatus, the coupling mechanism is length-adjustable.

In any one of embodiments of the apparatus, the quick-release attachment coupling comprises a carabiner; a snap hook; a bolt snap; a spring snap; a spring clip; a harness clip; a releasable captured hook and variations thereof.

In any one of embodiments of the apparatus, the quick-release attachment coupling is adapted to couple to any of the fixation rings on the layered strap-like apparatus or belt-like strap, or an accessory device.

In any one of embodiments of the apparatus, the quick-release attachment coupling is adapted to couple to any stationary structure comprising a feature that can act as an anchoring point or a fixation ring.

In any one of embodiments of the apparatus, the quick-release attachment coupling is adapted to couple to any other attachment feature, coupling mechanism, fixation ring, coupling strap, or handle to facilitate wrapping the layered strap-like apparatus or strap-like belt around a stationary structure that can act as an anchoring point or a fixation ring.

In any one of embodiments of the apparatus, the fixation ring comprises: a circular ring a reinforced material ring a D-ring; a carabiner; a spring clip; a harness clip; a snap hook; and a releasable captured hook.

In any one of embodiments of the apparatus, the quick-release attachment couplings and fixation rings comprise materials of sufficient strength to support a human and provide a factor of safety, such as alloy aluminum, steels and other metals known to those skilled in the art safety equipment, sky diving and mountain climbing, or any of the materials described below.

In any one of embodiments of the apparatus, the strap-like apparatus is adapted to be worn about the waist of the user's body. In any one of embodiments of the apparatus, the strap-like apparatus is adapted to be carried as a bandolier about the user's body. In any one of embodiments of the apparatus, the strap-like apparatus is adapted to be carried in a gym bag, backpack, or similar equipment-carrying apparatus.

In some embodiments of the apparatus, the at least one releasably attachable elastic band comprises an elastic tension ranging from about: 1.0-5.0 lbs.; 2.0-10.0 lbs.; 5.0-15.0 lbs.; 10.0-20.0 lbs.; 15.0-30.0 lbs.; 20.0-40.0 lbs.; 25.0-50.0 lbs.; 30.0-60.0 lbs.; 35.0-70.0 lbs.; 40.0-80.0 lbs.; 45.0-90.0 lbs.; 50.0-100.0 lbs.; 60.0-120.0 lbs.; 75.0-150.0 lbs.; 100.0-200.0 lbs.; 150.0-250.0 lbs.; 200.0-400.0 lbs.; and from about 1.0-400 lbs.

In some embodiments of the apparatus, the at least one releasably attachable elastic band ranges in length from about: 0.5-2.0 feet, 1.0-2.0 feet, 1.5-2.0 feet; 1.5-3.0 feet; 1.5-4.0 feet; 1.5-5.0 feet; 1.5-6.0 feet; 1.5-7.0 feet; 1.5-8.0 feet; 1.5-9.0 feet; and from about 0.5-10.0 feet.

In some embodiments, the apparatus comprises at least one releasably attachable non-elastic band and/or at least one releasably attachable elastic band.

In some embodiments of the apparatus, the at least one releasably attachable non-elastic band or releasably attachable elastic band comprises a protective sleeve to prevent or at least reduce wear, abrasion, tearing and scoring of the non-elastic or elastic bands during use. In some embodiments, the sleeve prevents overstretching of the non-elastic or elastic bands during use. In some embodiments, the protective sleeve has an elastic quality to allow it to stretch with the underlying band. In some embodiments, the elastic protective sleeve prevents overstretching of the non-elastic or elastic bands during use.

In some embodiments of the apparatus, the elastic band comprises a non-elastic inner band to prevent or at least reduce overstretching and possible failure of the elastic bands during use.

In some embodiments of the apparatus, an accessory article comprises an elastic band, a non-elastic band, at least one detachable flexible or solid handle with flexible straps, a running parachute, a suspension cord, a suspension harness, a parachute cord, an additional coupling device, an additional quick-release attachment coupling mechanism, a flexible water canteen, and a glove.

In some embodiments of the apparatus, a quick-release attachment coupling mechanism comprises a circular ring; a D-ring; a carabiner; a spring clip; a harness clip; a snap hook; or a releasable captured hook.

In some embodiments of the apparatus, the strap-like apparatus comprises wear-resistant material comprising: nylon; moleskin; polyester; polypropylene; aramid polymer fabric; Kevlar®; technical fabric; SuperFabric®; Cordura®; Spectra Shield®; Dyneema®; Tegris™ polypropylene; Innegra™; HB51; Protech®; Gold Shield®; polyethylene naphthalate (PEN); Vectran®; high-modulus polyethylene; ABC-Matrix © Technora®, Vectran®; Ultra High Molecular Weight Polyethylene (UHMWPE); Twaron®; Zylon®; Carbon Fiber; Mylar®; Chlorosulfonated polyethylene (Hypalon, CSPE, CSM) or leather.

In some embodiments of the strap-like apparatus, the apparatus further comprises one or more of a plurality of safety features comprising reflective tape; neon coloring; florescent coloring; a flashing light unit; a RFID tracking device; a GPS tracking device; or a geolocation device.

Provided herein is a portable exercise apparatus comprising: an adjustable connector strap having a first end and a second end spaced lengthwise from each other; a coupling mechanism assembly comprising a first coupling component at or near the first end and a second coupling component at or near the second end of the adjustable connector strap, for releasably securing the first end of the adjustable connector strap to another section of the adjustable connector strap at or near the second end of the adjustable connector strap; a releasably closeable pocket (pouch), affixed lengthwise to the adjustable connector strap comprising; at least a first medial exterior surface and a first lateral exterior surface, an interior space within the releasably closeable pocket comprising at least a first medial interior surface and a first lateral interior surface, a first exterior end margin, and a second exterior end margin; wherein the first end margin and the second end margin are closed and spaced apart from each other at opposite ends of the pocket along the adjustable connector strap; a first exterior lengthwise margin comprising a first edge and a second edge, forming a first opening to the interior space; and a second exterior lengthwise margin spaced apart from the first exterior lengthwise margin forming a closed bottom to the interior space of the pocket; wherein the first and second lengthwise margins are positioned longitudinally between the first end margin and second end margin; at least one securing mechanism configured to releasably capture the first edge and the second edge to at least partially close the first opening to the interior space of the releasably closeable pocket; wherein the adjustable connector strap is affixed lengthwise to the medial interior surface of the releasably closeable pocket, or to the medial exterior surface of the releasably closeable pocket such that the first end and the second end of the adjustable connector strap protrude past the first exterior end margin and the second exterior end margin of the releasably closable pocket.

In some embodiments of the portable exercise apparatus, the position of the second coupling component is adjustable at or near the second end of the adjustable connector strap.

In some embodiments of the portable exercise apparatus, the first exterior end margin comprises a third edge and a fourth edge, forming a second opening to the interior space, wherein the at least one securing mechanism is configured to releasably capture the third edge, the fourth edge, first edge and the second edge to at least partially close the first opening and the second opening to the interior space of the releasably closeable pocket.

In some embodiments of the portable exercise apparatus, the second exterior end margin comprises a fifth edge and a sixth edge, forming a third opening to the interior space, wherein the at least one securing mechanism is configured to releasably capture the third edge, the fourth edge, first edge, the second edge, the fifth edge and the sixth edge, to at least partially close the second opening, the first opening and the third opening to the interior space of the releasably closeable pocket.

In some embodiments, the first opening only adjoins the second opening. In some embodiments, the first opening adjoins only the third opening. In some embodiments, the first opening adjoins the second opening and the third opening.

In some embodiments, the first opening, the second opening, and the third opening of the releasably closeable pocket each individually comprise a separate securing mechanism, such that there are two closure mechanisms when there are two openings or three closure mechanisms when there are three openings. Further still, in some embodiments, the releasably closeable pocket can comprise only two closure mechanisms when there are three openings, wherein one closure mechanism can secure two openings, and a second closure mechanism secures the third opening. Still further, in some embodiments, there can be multiple closure mechanisms to secure each opening of the releasably closeable pocket.

In some embodiments, the portable exercise apparatus comprises: an adjustable connector strap comprising a first end and a second end spaced lengthwise from each other; a coupling mechanism assembly comprising a first coupling component at or near the first end of the adjustable connector strap and a second coupling component at or near the second end adjustable connector strap for releasably securing the first end of the adjustable connector strap to a section of the adjustable connector strap at or near the second end of the adjustable connector strap; a releasably closeable pocket (or pouch) affixed lengthwise to the adjustable connector strap comprising at least a first medial exterior surface and a first lateral exterior surface, an interior space within the releasably closeable pocket comprising, a first medial interior surface and a first lateral interior surface; a first exterior end margin and a second exterior end margin; a first exterior lengthwise margin comprising a first edge and a second edge, forming a first opening to the interior space; and a second exterior lengthwise margin spaced apart from the first exterior lengthwise margin, forming a closed bottom to the interior space of the pocket; the first exterior end margin comprising a third edge and a fourth edge, forming a second opening to the interior space; the second exterior end margin comprising a fifth edge and a sixth edge, forming a third opening to the interior space, wherein the first end margin and the second end margin are spaced apart from each other at opposite ends of the pocket, wherein the first exterior lengthwise margin and the second lengthwise margin adjoin the first end margin and the second end margin, and wherein the first and the second lengthwise margin are positioned longitudinally between the first end margin and second end margin; at least one securing mechanism configured to releasably capture the third edge, the fourth edge, the first edge, the second edge, the fifth edge and the sixth edge, to at least partially close the second opening, the first opening and the third opening to the interior space of the releasably closable pocket; and wherein the adjustable connector strap is affixed lengthwise to the medial interior surface of the releasably closeable pocket, or to the medial exterior surface of the releasably closeable pocket, such that the first end and the second end of the adjustable connector strap protrude past the first exterior end margin and the second exterior end margin.

In some embodiments of the portable exercise apparatus, the position of the second coupling component is adjustable at or near the second end of the adjustable connector strap.

In some embodiments, the medial and lateral surfaces are layers formed from a single piece of folded material. In some embodiments, the medial and lateral surfaces are layers formed from two or more pieces of material and joined along at least one the margins.

In some embodiments of the portable exercise apparatus, the releasably closable pocket is at least partially closable along the first exterior lengthwise margin.

In some embodiments of the portable exercise apparatus, the releasably closable pocket is at least partially closable at the first end margin and the second end margin.

In some embodiments, the portable exercise apparatus further comprises a first auxiliary storage pocket having a first end, a second end and a first cavity therebetween, affixed to the apparatus on or about the second exterior lengthwise margin, typically near the first exterior margin.

In some embodiments, the portable exercise apparatus further comprises a second auxiliary storage pocket having a third end, a fourth end and a second cavity therebetween, wherein the first and second auxiliary storage pocket are spaced apart lengthwise from each other and affixed on or about the second exterior lengthwise margin, typically near the first exterior margin.

In some embodiments, the portable exercise apparatus the first and second auxiliary storage pocket are spaced apart lengthwise from each other.

In some embodiments, the portable exercise apparatus further comprises a first fixation ring; and a second fixation ring; wherein the first fixation ring is permanently affixed to the adjustable connector strap between the first coupling component and the first exterior end margin of the pocket, and wherein the second fixation ring is permanently affixed to the adjustable connector strap between the second coupling component and the second exterior end margin of the pocket. In some embodiments, the portable exercise apparatus further comprises a first fixation ring and a second fixation ring; wherein the first fixation ring is a releasably affixable carabiner affixable to the adjustable connector strap between the first coupling component and the first exterior end margin of the pocket, and wherein the second fixation ring is a releasably affixable carabiner affixable to the adjustable connector strap between the second coupling component and the second exterior end margin of the pocket.

In some embodiments, the portable exercise apparatus further comprises a third fixation ring; wherein the third fixation ring is permanently affixed to the portable exercise apparatus at or about the approximate lengthwise center of the releasably closeable pocket, approximately equidistant between the first fixation ring and the second fixation ring. In some embodiments, the third fixation ring is a releasably affixable carabiner affixable to the portable exercise apparatus at or about the approximate lengthwise center of the releasably closeable pocket, approximately equidistant between the first fixation ring and the second fixation ring. In some embodiments, the third fixation ring is a releasably affixable carabiner affixed to the adjustable connector strap.

In some embodiments, the portable exercise apparatus comprises a first handgrip with a first flexible connector strap.

In some embodiments, the portable exercise apparatus further comprises a second handgrip with a second flexible connector strap.

In some embodiments of the portable exercise apparatus, the first handgrip is permanently affixed to the adjustable connector strap with the first flexible connector strap between the first coupling component and the first exterior end margin of the pocket.

In some embodiments of the portable exercise apparatus, the second handgrip is permanently affixed to the adjustable connector strap with the second flexible connector strap between the second coupling component and the second exterior end margin of the pocket.

In some embodiments of the portable exercise apparatus, the first handgrip with the first flexible connector strap and the second handgrip with the second flexible connector strap are configured for storage within the first auxiliary storage pocket and the second auxiliary storage pocket.

In still other embodiments of the portable exercise apparatus, the first handgrip with the first flexible connector strap is releasably affixable to the first fixation ring that is affixed to the adjustable connector strap between the first coupling component and the first exterior end margin of the pocket.

In still other embodiments of the portable exercise apparatus, the second handgrip with the second flexible connector strap is releasably affixable to the second fixation ring that is affixed to the adjustable connector strap between the second coupling component and the second exterior end margin of the pocket.

In some embodiments of the portable exercise apparatus, the securing mechanism for the pocket comprises: a zipper; a Velcro™ connection; a compression snap; a magnet; a buckle; a button; a clasp; a lace; a flexible material strap; a hook or a combination thereof.

In some embodiments of the portable exercise apparatus, the auxiliary storage pocket further comprises a cavity closure mechanism comprising: a zipper; a Velcro™ connection; a compression snap; a magnet; a clasp; a flexible material strap; a hook or a combination thereof.

In some embodiments of the portable exercise apparatus, the apparatus further comprises additional detachable flexible handles or detachable solid handles, each with flexible connector straps; tension bands, suspension cords; a door or door frame attachment feature; a suspension harness; a running parachute; a parachute cord; a coupling mechanism;

a flexible water canteen; a drinking tube; a flow valve; a glove and one or more of a plurality of safety features Provided herein is a portable exercise apparatus comprising: an adjustable connector strap comprising a first end and a second end spaced lengthwise from each other; a coupling mechanism assembly comprising a first coupling component at or near the first end of the adjustable connector strap and a second coupling component at or near the second end of the adjustable connector strap for releasably securing the first end of the adjustable connector strap to a section of the adjustable connector strap at or near the second end of the adjustable connector strap; a first releasably closeable pocket (or pouch) attached to and spaced along a first section of the adjustable connector strap comprising; at least a first medial exterior surface and a first lateral exterior surface, an first interior space within the first releasably closeable pocket comprising a first medial interior surface and a first lateral interior surface; a first exterior end margin and a first interior end margin; wherein the first exterior end margin and the first interior end margin are spaced apart lengthwise from each other along the first section of the adjustable connector strap, at opposite ends of the first releasably closeable pocket, a first exterior lengthwise margin adjoining the first exterior end margin and the first interior end margin, the first exterior end margin comprising a first edge and a second edge, forming a first opening to the interior space; and a second exterior lengthwise margin spaced apart from the first exterior lengthwise margin, forming a closed bottom to the first interior space of the first releasably closeable pocket; wherein the first and second exterior lengthwise margins are positioned longitudinally along the first section of the adjustable connector strap between the first exterior end margin and first interior end margin; at least a first pocket securing mechanism configured to releasably capture the first edge and the second edge to at least partially close the first opening to the interior space of the first releasably closeable pocket; and a second releasably closable pocket (or pouch) attached to and spaced along a second section of the adjustable connector strap comprising: at least a second medial exterior surface and a second lateral exterior surface, a second interior space within the second releasably closeable pocket comprising at least a second medial interior surface and a second lateral interior surface, a second exterior end margin and a second interior end margin; wherein the second exterior end margin and the second interior end margin are spaced apart lengthwise from each other at opposite ends of the second releasably closeable pocket along the second section of the adjustable connector strap, a third exterior lengthwise margin adjoining the second exterior end margin and the second interior end margin, the third exterior lengthwise margin comprising a third edge and a fourth edge, forming a first opening to the second interior space within the second releasably closeable pocket; and a fourth exterior lengthwise margin spaced apart from the third exterior lengthwise margin, forming a closed bottom to the second interior space of the second releasably closeable pocket; wherein the third and fourth exterior lengthwise margins are positioned longitudinally along the second section of the adjustable connector between the second exterior end margin and second interior end margin; at least a second pocket securing mechanism configured to releasably capture the third edge and the fourth edge to at least partially close the first opening to the second interior space of the second releasably closeable pocket; a connecting section comprising at least a medial exterior surface and a lateral exterior surface positioned between the first interior end margin of the first releasably closeable pocket and the second interior end margin of the second releasably closeable pocket; wherein the adjustable connector strap is affixed lengthwise to the first medial interior surface of the first releasably closeable pocket, optionally affixed to the lateral surface of the connecting section and affixed lengthwise to the second medial interior surface of the second releasably closeable pocket, or wherein the adjustable connector strap is affixed lengthwise to the first medial exterior surface of the first releasably closeable pocket, optionally affixed the lateral surface of the connecting section and affixed lengthwise to the second medial exterior surface of the second releasably closeable pocket, or, a combination thereof, such that the first end and the second end of the adjustable connector strap protrude past the first exterior end margin of the first pocket and the second exterior end margin of the second pocket.

In some embodiments of the portable exercise apparatus, the connecting section comprises: a separate intermediate piece of material, an extension at the end of the first pocket, beyond the first interior end margin of the first pocket joined to an extension at the end of the second pocket beyond the second interior end margin of the second pocket, the adjustable connector strap, or a combination thereof.

In some embodiments of the portable exercise apparatus, the first exterior end margin further comprises a fifth edge and a sixth edge, forming a second opening to the first interior space of the first releasably closeable pocket, and wherein the first interior end margin forms a closed end to the first interior space of the first releasably closeable pocket.

In some embodiments of the portable exercise apparatus, the first opening to the first interior space of the first releasably closeable pocket adjoins the second opening to the first interior space of the first releasably closeable pocket, forming a continuous opening along two end margins.

In some embodiments, the first opening and the second opening of the first releasably closeable pocket comprise one closure mechanism to secure both the first and the second opening. In some embodiments, the first opening and the second opening of the first releasably closeable pocket each individually comprise a separate securing mechanism, such that there are two closure mechanisms when there are two openings.

Still further, in some embodiments, there can be multiple closure mechanisms to secure each of the first and second openings of the first releasably closeable pocket.

In some embodiments of the portable exercise apparatus, the second exterior end margin comprises a seventh edge and an eighth edge, forming a second opening to the second interior space of the second releasably closeable pocket, wherein the second interior end margin forms a closed end to the second interior space of the second releasably closeable pocket.

In some embodiments of the portable exercise apparatus, the first opening to the second interior space of the second releasably closeable pocket adjoins the second opening to the second interior space of the second releasably closeable pocket, forming a continuous opening along two end margins.

In some embodiments, the first opening and the second opening of the second releasably closeable pocket comprise one closure mechanism to secure both the first and the second opening.

In some embodiments, the first opening and the second opening of the second releasably closeable pocket each individually comprise a separate securing mechanism, such that there are two closure mechanisms when there are two openings.

Still further, in some embodiments, there can be multiple closure mechanisms to secure each of the first and second openings of the second releasably closeable pocket.

In some embodiments, the portable exercise apparatus further comprises, a first auxiliary storage pocket having a first end, a second end and a first cavity therebetween, affixed to the apparatus on or about the second exterior lengthwise margin, typically near the first exterior margin of the first pocket.

In some embodiments, the portable exercise apparatus further comprises, a second auxiliary storage pocket having a third end, a fourth end and a second cavity therebetween, affixed on or about the fourth exterior lengthwise margin, typically near the second exterior margin of the second pocket.

In some embodiments, the portable exercise apparatus comprises a first fixation ring and a second fixation ring, wherein the first fixation ring is permanently affixed to the adjustable connector strap between the first coupling component and the first exterior end margin of the first pocket, and wherein the second fixation ring is permanently affixed to the adjustable connector strap between the second coupling component and the second exterior end margin of the second pocket. In some embodiments, the portable exercise apparatus further comprises a first fixation ring; and a second fixation ring wherein the first fixation ring is a releasably affixable carabiner affixable to the adjustable connector strap between the first coupling component and the first exterior end margin of the first pocket, and wherein the second fixation ring is a releasably affixable carabiner affixable to the adjustable connector strap between the second coupling component and the second exterior end margin of the second pocket.

In some embodiments, the portable exercise apparatus further comprises a third fixation ring, wherein the third fixation ring is permanently affixed to the portable exercise apparatus between the first pocket and the second pocket, at the connecting section and approximately equidistant between the first fixation ring and the second fixation ring. In some embodiments, the portable exercise apparatus further comprises a third fixation ring, wherein the third fixation ring is a releasably affixable carabiner affixed to the portable exercise apparatus between the first pocket and the second pocket, at the connecting section and approximately equidistant between the first fixation ring and the second fixation ring. In some embodiments, the third fixation ring is affixed or affixable to the adjustable connector strap, between the first releasably closeable pocket and the second releasably closable pocket, approximately equidistant between the first fixation ring and the second fixation ring.

In some embodiments, the portable exercise apparatus comprises a first handgrip with a first flexible strap.

In some embodiments, the portable exercise apparatus further comprises a second handgrip with a second flexible strap.

In some embodiments of the portable exercise apparatus, the first handgrip with the first flexible connector strap is permanently affixed to the adjustable connector strap between the first coupling component and the first exterior end margin of the first pocket.

In some embodiments of the portable exercise apparatus, the second handgrip with the second flexible connector strap is permanently affixed to the adjustable connector strap between the second coupling component and the second exterior end margin of the second pocket.

In still other embodiments of the portable exercise apparatus, the first handgrip with the first flexible connector strap is releasably affixable to a first fixation ring that is affixed to the adjustable connector strap between the first coupling component and the first exterior end margin of the first pocket.

In still other embodiments of the portable exercise apparatus, the second handgrip with the second flexible connector strap is releasably affixable to a second fixation ring that is affixed to the adjustable connector strap between the second coupling component and the second exterior end margin of the second pocket.

In some embodiments, the first handgrip with the first flexible strap is configurable for storage within the first auxiliary storage pocket. In some embodiments, the second handgrip with the second flexible strap is configurable for storage within the second auxiliary storage pocket.

Further still, in any one of the embodiments, the portable exercise apparatus comprises at least a third handgrip with at least a third flexible strap.

Still further, in any one of the embodiments, the portable exercise apparatus comprises a solid handgrip with a flexible connector strap that is convertible to a doorframe attachment device configured with connector strap fixation rings for attachment to the portable exercise apparatus, or any of a plurality of exercise apparatus accessories.

In any one of the embodiments, the handgrip is flexible. In any one of the embodiments, the handgrip is not flexible.

In any one of the embodiments of the portable exercise apparatus, the at least one first pocket securing mechanism for the first pocket and the at least one second pocket securing mechanism for the second pocket comprise: a zipper; a Velcro™ connection; a compression snap; a magnet; a buckle; a button; a clasp; a lace; a flexible material strap; a hook or a combination thereof.

In any one of the embodiments of the portable exercise apparatus, the auxiliary storage pocket further comprises a cavity closure mechanism comprising: a zipper; a Velcro™ connection; a compression snap; a magnet; a clasp; a flexible material strap; a hook or a combination thereof.

In any one of the embodiments of the portable exercise apparatus, the apparatus further comprises additional accessory components comprising: at least a third handgrip with a third flexible strap; at least one suspension line configured to safely support the weight of human adult; at least one tension band; at least one accessory attachment connection device; a doorknob attachment device; a door hinge attachment device or door frame attachment device.

In some embodiments of the portable exercise apparatus, the apparatus further comprises detachable flexible or solid handles with flexible straps; a suspension harness; a running parachute; a parachute cord; a coupling mechanism; a flexible water canteen; a drinking tube; a flow valve; a glove and one or more of a plurality of safety features.

In any one of the embodiments of the portable exercise apparatus, the apparatus is fabricated from or comprises wear-resistant material comprising: nylon; moleskin; polyester; polypropylene; aramid polymer fabric; Kevlar®; technical fabric; SuperFabric®; Cordura®; Spectra Shield®; Dyneema®; Tegris™ polypropylene; Innegra™; HB51; Protech®; Gold Shield®; polyethylene naphthalate (PEN); Vectran®; high-modulus polyethylene; ABC-Matrix © Technora®, Vectran®; Ultra High Molecular Weight Polyethylene (UHMWPE); Twaron®; Zylon®; Carbon Fiber; Mylar®; Chlorosulfonated polyethylene (Hypalon, CSPE, CSM) and/or leather.

Provided herein is a portable exercise apparatus kit comprising: an adjustable connector strap comprising a first end and a second end spaced lengthwise from each other; a coupling mechanism assembly comprising a first coupling component at or near the first end of the adjustable connector strap and a second coupling component at or near the second end of the adjustable connector strap for releasably securing the first end of the adjustable connector strap to a section of the adjustable connector strap at or near the second end of the adjustable connector strap; a first releasably closeable pocket attached to and spaced along a first section of the adjustable connector strap comprising; an first interior space within the first releasably closeable pocket; a first exterior end margin and a first interior end margin; a first exterior lengthwise margin adjoining the first exterior end margin and the second interior end margin, the first exterior lengthwise margin comprising a first edge and a second edge, forming a first opening to the first interior space; and a second exterior lengthwise margin spaced apart from the first exterior lengthwise margin, forming a closed bottom to the first interior space of the first releasably closeable pocket; at least one first pocket securing mechanism configured to releasably capture the first edge and the second edge to at least partially close the first opening to the first interior space of the first releasably closeable pocket; a second releasably closable pocket attached to and spaced along a second section of the adjustable connector strap comprising: a second interior space within the second releasably closeable pocket, a second exterior end margin and a second interior end margin; a third exterior lengthwise margin adjoining the second exterior end margin and the second interior end margin, the third exterior lengthwise margin comprising a third edge and a fourth edge, forming a first opening to the second interior space within the second releasably closeable pocket; and a fourth exterior lengthwise margin spaced apart from the third exterior lengthwise margin, forming a closed bottom to the second interior space of the second releasably closeable pocket; at least a second pocket securing mechanism configured to releasably capture the third edge and the fourth edge to at least partially close the second opening to the second interior space of the second releasably closeable pocket; a connecting section positioned between the first interior end margin of the first releasably closeable pocket and the second interior end margin of the second releasably closeable pocket; wherein the adjustable connector strap is affixed lengthwise to a surface of the first releasably closeable pocket, optionally affixed to a surface of the connecting section and affixed lengthwise to a surface of the second releasably closeable pocket, such that the first end and the second end of the adjustable connector strap protrude past the first exterior end margin of the first pocket and the second exterior end margin of the second pocket, a first fixation ring; a second fixation ring; and a third fixation ring; wherein the first fixation ring is permanently affixed to the adjustable connector strap near the first end of the adjustable connector strap, the second fixation ring is permanently affixed to the adjustable connector strap near the second end of the adjustable connector strap, and the third fixation ring is permanently affixed to the portable exercise apparatus between the first pocket and the second pocket, approximately equidistant between the first and second fixation rings, at least one handgrip with a flexible strap; an auxiliary storage pocket; at least one suspension line configured to safely support the weight of human adult; at least one tension band; at least one accessory attachment connection device; or a door frame attachment device.

Still further, in any one of the embodiments of the portable exercise apparatus kit, the portable exercise apparatus comprises a solid handgrip with a flexible connector strap that is convertible to a doorframe attachment device configured with connector strap fixation rings for attachment to the portable exercise apparatus, or any of a plurality of exercise apparatus accessories.

In some embodiments of the portable exercise apparatus kit, the connecting section comprises: a separate intermediate piece of material, an extension at the end of the first pocket, beyond the first interior end margin of the first pocket joined to an extension at the end of the second pocket beyond the second interior end margin of the second pocket, the adjustable connector strap, or a combination thereof.

In some embodiments of the portable exercise apparatus kit, the portable exercise apparatus comprises a first fixation ring; and a second fixation ring; wherein the first fixation ring is a releasably affixable carabiner affixable to the adjustable connector strap between the first coupling component and the first exterior end margin of the first pocket, and wherein the second fixation ring is a releasably affixable carabiner affixable to the adjustable connector strap between the second coupling component and the second exterior end margin of the second pocket.

In some embodiments of the portable exercise apparatus kit, the portable exercise apparatus comprises a third fixation ring wherein the third fixation ring is a releasably affixable carabiner and affixable to the portable exercise apparatus between the first pocket and the second pocket at the connecting section, approximately equidistant between the first fixation ring and the second fixation ring. In some embodiments, the third fixation ring is a releasably affixable carabiner and affixable to the adjustable connector strap between the first pocket and the second pocket at the connecting section.

Provided herein is a method of using an exercise apparatus comprising: providing a strap-like apparatus adapted to be worn about the user's body, wherein the strap-like apparatus comprises at least a first layer and a second layer, wherein the first layer comprises a first inside surface and a first outside surface and the second layer comprises a second inside surface and a second outside surface; providing at least one pocket between the first layer and the second layer; attaching a connector strap comprising a first end and a second end and affixed to the outside surface or inside surface of the first layer, wherein the connector strap comprises a coupling mechanism for releasably securing the first end and second end of the connector strap to each other; affixing a first handle and a second handle to the connector strap or directly to an outside surface of the exercise apparatus, wherein each first handle and second handle is spaced approximately equidistant from the lengthwise center of the strap-like apparatus; affixing a first fixation ring adjacent to a first end of the strap-like apparatus, extending outside of the pocket; and affixing a second fixation ring adjacent to a second end of the strap-like apparatus, extending outside of the pocket; affixing a third fixation ring to the to the connector strap at the approximate lengthwise center of the strap-like apparatus connector strap and making it accessible through an access point in the layers of the strap-like apparatus; wherein the strap-like apparatus is adapted for exercising various muscle groups of the body of a user when performing suspension exercises, resistance exercises, stretching exercises, aerobic exercises, or other combination exercises with said apparatus as a component of a total body workout.

In some embodiments of the method, the strap-like apparatus is removed from the user's body and wrapped about a stable vertical or horizontal structure such as a tree or pole, wherein a first end of a first elastic band and a first end of a second elastic band are affixed to any two of the fixation rings of the strap-like apparatus, wherein the user performs resistance or stretching exercises with the elastic bands while holding the bands with the hands.

In some embodiments of the method, the resistance exercises comprise: pulling; pushing; spinal flexion; spinal extension; spinal rotation; shoulder internal rotation; shoulder external rotation; lateral flexion; shoulder abduction; shoulder adduction; shoulder flexion; and shoulder extension. In some embodiments of the method, the resistance exercises comprise arm curls; and arm extensions.

In some embodiments of the method, the stretching exercises comprise: pulling; pushing; leg extension, hamstring extension, spinal flexion; spinal extension; spinal rotation; shoulder internal rotation; shoulder external rotation; lateral flexion; shoulder abduction; shoulder adduction; shoulder flexion; and shoulder extension.

In some embodiments of the method, the strap-like apparatus is removed from the user's body and wrapped about a stable vertical or horizontal structure such as a tree or pole, wherein a first end of a first elastic band is affixed to any one of the fixation rings of the strap-like apparatus, a detachable flexible handle is wrapped around the user's ankle or foot and attached the second end of the first elastic band, wherein the user performs limb resistance exercises with the elastic bands with their legs.

In some embodiments of the method, the resistance exercises comprise: hip abduction; hip adduction; dorsiflexion; plantarflexion; knee extension; knee flexion; hip flexion; hip extension; eversion; inversion; and lateral resistance steps.

In some embodiments of the method, the strap-like apparatus is removed from the user's body and suspended about a hanging structure capable of supporting the user, wherein the user performs pull-ups or chin-ups utilizing any the handles affixed to the strap-like apparatus.

In some embodiments of the method, the strap-like apparatus is removed from the user's body and suspended about a hanging structure capable of supporting the user, wherein the first end of a first elastic band and the first end of a second elastic band are each affixed to any of the fixation rings; a first end of a flexible strap handle is connected to the second end of the first elastic band and a second end of the detachable flexible handle is connected to the second end of the second strap-like apparatus, creating a suspended strap step; wherein the user can step or kneel on the suspended strap step while grasping any of the affixed handles of the strap-like apparatus and performing assisted suspension exercises, such as assisted pull-ups or chin-ups.

In some embodiments of the method, the first end of at least a first elastic band is affixable to any of the fixation rings of the strap-like apparatus, wherein the user performs limb resistance exercises with an elastic band while holding the band in a hand with the strap-like apparatus secured about the user's waist.

In some embodiments of the method, the first end of a first elastic band is affixable to any of the fixation rings of the strap-like apparatus, wherein the user performs limb resistance exercises with an elastic band in a hand while holding the band and standing on the strap-like apparatus with the user's feet or kneeling on the strap-like apparatus.

In some embodiments of the method, the resistance exercises comprise elbow flexion; elbow extension; shoulder abduction; shoulder internal rotation, shoulder external rotation; shoulder extension; shoulder flexion; lateral flexion; and tension squatting exercises.

In some embodiments of the method, the first end of a first elastic band is affixed to the fixation ring located on the outside surface of the strap-like apparatus, the second end of the first elastic band comprising a quick-release attachment coupling is affixed to an anchoring point of a stationary structure, wherein the user performs resistance running exercises with the elastic band providing a resistance force while the strap-like apparatus is secured about the user's waist.

In some embodiments of the method, the first end of a first elastic band is affixed to the fixation ring located on the outside surface of the strap-like apparatus, (the center of connecting strap) the second end of the first elastic band comprising a quick-release attachment coupling with a detachable handle is held by another person, wherein the user performs resistance running exercises with the elastic band and other person providing a resistance force while the strap-like apparatus is secured about the user's waist.

In some embodiments of the method, the first end of a first elastic band is affixed to the fixation ring located on the outside surface of the strap-like apparatus, (the center of connecting strap) the second end of the first elastic band comprising an attached handle is held by another person, wherein the user performs resistance running exercises with the elastic band while the strap-like apparatus is secured about the user's waist.

In some embodiments of the method, the first end of a first elastic band is affixed to the fixation ring located on the outside surface of the strap-like apparatus, (center of connecting strap) the second end of the first elastic band comprising a quick-release attachment coupling is affixed to an anchoring point of a stationary structure, wherein the user performs resistance running exercises with the elastic band while the strap-like apparatus is secured about the user's body as a bandolier or waist.

In some embodiments of the method, the first end of a first elastic band is affixed to the fixation ring located in the lengthwise center of the strap-like apparatus, the second end of the first elastic band comprising an optional handle is held by another person, wherein the user performs resistance running exercises with the elastic band while the strap-like apparatus is secured about the user's body as a bandolier or waist.

In some embodiments of the method, at least a second band is affixable to the fixation ring located in outer surface of the first layer of the strap-like apparatus for additional resistance.

In some embodiments of the method, the first end of a first elastic band and the first end of a second elastic band are each affixed to any of the fixation rings; the second end of the first elastic band and the second end of the second elastic band each comprising a quick-release attachment coupling are each affixed to an anchoring point of a stationary structure above the user capable of supporting the user's weight, wherein the user can step on the suspended strap-like apparatus, while grasping the stationary structure above the user's head and performing assisted suspension exercises.

Provided herein is a kit for an exercise apparatus comprising a strap-like apparatus adapted to be worn about the user's body, wherein the strap-like apparatus comprises at least a first layer and a second layer, wherein the first layer comprises a first inside surface and a first outside surface and the second layer comprises a second inside surface and a second outside surface; at least one pocket between the first layer and the second layer; a connector strap comprising a first end and a second end and affixed to the outside surface or inside surface of the first layer, wherein the connector strap comprises a coupling mechanism for releasably securing the first end and second end of the connector strap to each other; a first handle and a second handle affixable to the connector strap or directly to an outside surface of the exercise apparatus, wherein each first handle and second handle is spaced approximately equidistant from the lengthwise center of the strap-like apparatus; at least one fixation ring affixed to the apparatus; and at least one releasably attachable elastic band.

In some embodiments of the kit, the strap-like apparatus comprises a third layer, wherein the third layer comprises a third inside surface and a third outside surface.

In some embodiments of the kit, the third layer is an extension of the first layer and folds over the second layer to enclose the at least one pocket between the first inside surface and the second inside surface.

In some embodiments of the kit, the layers are formed from a single piece of folded material.

In some embodiments of the kit, the layers are formed from two or more pieces of material and joined along their lengthwise edges.

In some embodiments of the kit, the at least one fixation ring is located at the approximate lengthwise center of the connector strap and accessible through an access point in the layers of the strap-like apparatus.

In some embodiments, the kit further comprises detachable flexible or solid handles with flexible straps; a running parachute; a suspension cord; a suspension harness; a parachute cord; a coupling mechanism; a flexible water canteen; a glove; a drinking tube; a flow valve and one or more of a plurality of safety features.

In some embodiments, the kit further comprises a second fixation ring affixed adjacent to a first end of the strap-like apparatus, extending outside of the pocket and a third fixation ring affixed adjacent to a second end of the strap-like apparatus, extending outside of the pocket, wherein the second and third fixation rings are affixed between the first and second layers and to the connector strap or are affixed directly to the connector strap.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention is obtained by reference to the following detailed description that sets forth illustrative embodiments, in which the principles of the invention are taught, and the accompanying drawings of which:

Figure 1:
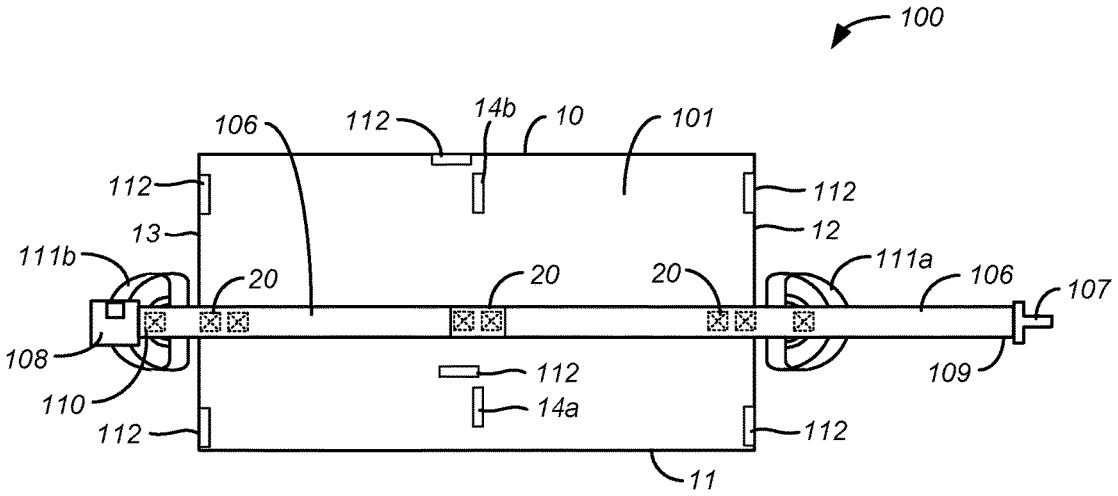
FIG. 1 is an illustrative plan view of an exemplary exercise strap-like apparatus in an unfolded state, illustrating the outer surface layer, a connector strap comprising a first end and a second end and affixed to the outside surface layer, two handles affixable to the connector strap, spaced approximately equidistant from the lengthwise center of the unfolded strap-like apparatus, fixation rings (e.g.: D-rings) positioned approximately adjacent to a first end and second end of the outside surface layer of the strap-like apparatus, each fixation ring being further secured to the connector strap, and a coupling mechanism comprising a pair of securing mechanism components, said individual components at each end of the connector strap for releasably securing the first end and second end of the connector strap to each other.
Figure 2:
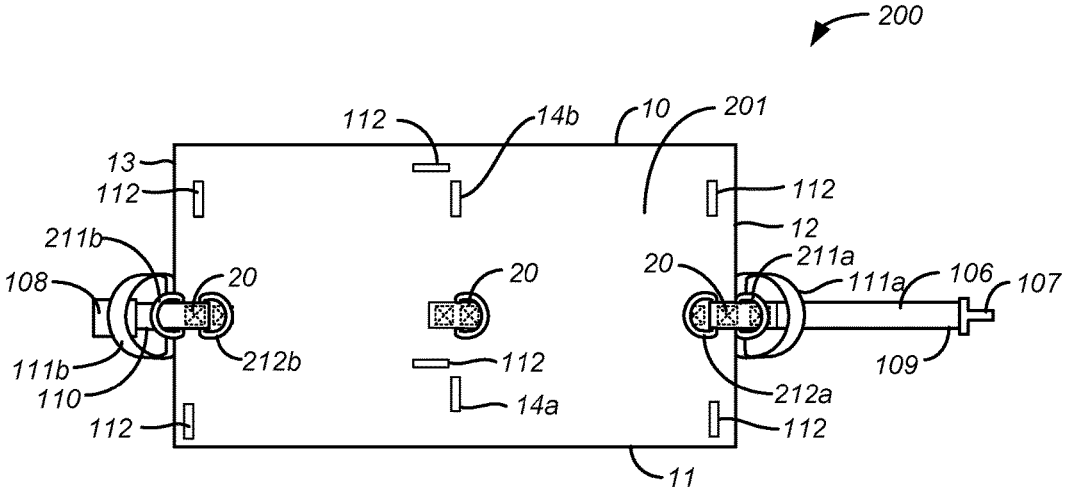
FIG. 2 is an illustrative plan view of an exemplary exercise strap-like apparatus in an unfolded state, illustrating the inner surface layer of the strap-like apparatus, the ends of the a connector strap, each comprising ½ of a securing mechanism for releasably securing the first end and second end of the connector strap to each other, multiple fixation rings (D-rings) positioned and secured approximately adjacent to a first end (2 each) and second end (2 each) of the outside surface layer of the strap-like apparatus and an additional fixation ring (D-rings) positioned in the approximate center of the inside surface of the strap-like apparatus, each fixation ring being further secured to the connector strap.

These representative views are not intended as limiting representations. One skilled in the art would recognize that this apparatus could be fabricated in a wide variety of combinations and configurations as illustrated herein, or from any number of recognized materials, or be configured similarly to any of the described shapes or configurations. In addition, the methods described herein are not intended to be limiting in any way. One skilled in the art would recognize that this apparatus could be utilized in many ways and could have many uses beyond those described herein.

DETAILED DESCRIPTION OF THE INVENTION

The present invention provides a novel and a versatile exercise apparatus for exercising multiple muscle groups of the user's body that comprises an exercise apparatus with releasably closable pockets, an attached connector strap, fixed and releasably attachable handles and multiple accessories adapted to be worn about the waist or carried across the chest of the user's body as a bandolier. The portable apparatus is lightweight, easy to use, and easily transportable and provides the general user, subject, patient, or athletic enthusiast with accessories that can add variety to their exercise regimen or therapy and allow them to have a versatile fitness experience anywhere.

As used herein, and unless otherwise specified, the terms "exercise apparatus," "exercise apparatus assembly," "strap-like belt," "layered strap," "layered strap-like belt" or "strap apparatus" are understood to have a synonymous interpretation meaning an apparatus comprising at least two layers with at least one pocket therebetween when assembled, with a connector strap and coupling mechanism attached thereto, adaptable to be worn about the body of a person; attachable to, or suspendable from a stable support structure and configurable to be utilized as an exercise or physical therapy device, as would be commonly understood by one skilled in the art.

As used herein, and unless otherwise specified, the term "tension band," "elastic band," "elastic tension band," "resistance band," and similar terms are understood to have a synonymous interpretation meaning flexible bands having an elastic tension utilized for resistance training or physical therapy. Resistance training (also called strength training or weight training) is the use of resistance to muscular contraction to build the strength, anaerobic endurance, and size of skeletal muscles.

As used herein, and unless otherwise specified, the term "about" or "approximately" means an acceptable error for a particular value as determined by one of ordinary skill in the art, which depends in part, on how the value is measured or determined. In certain embodiments, the term "about" or "approximately" means within 1, 2, 3, or 4 standard deviations. In certain embodiments, the term "about" or "approximately" means within 30%, 25%, 20%, 15%, 10%, 9%, 8%, 7%, 6%, 5%, 4%, 3%, 2%, 1%, 0.5%, 0.1%, or 0.05% of a given value or range. In certain embodiments, the term "about" or "approximately" means within 40.0 inches, 30.0 inches, 20.0 inches, 10.0 inches, 5.0 inches, 1.0 inches, 0.9 inches, 0.8 inches, 0.7 inches, 0.6 inches, 0.5 inches, 0.4 inches, 0.3 inches, 0.2 inches or 0.1 inches of a given value or range. In certain embodiments, the term "about" or "approximately" means within 40.0 mm, 30.0 mm, 20.0 mm, 10.0 mm, 5.0 mm, 1.0 mm, 0.9 mm, 0.8 mm, 0.7 mm, 0.6 mm, 0.5 mm, 0.4 mm, 0.3 mm, 0.2 mm or 0.1 mm of a given value or range. In certain embodiments, the term "about" or "approximately" means within 40.0 lbs., 30.0 lbs., 20.0 lbs., 10.0 lbs., 5.0 lbs., 1.0 lbs., 0.9 lbs., 0.8 lbs., 0.7 lbs., 0.6 lbs., 0.5 lbs., 0.4 lbs., 0.3 lbs., 0.2 lbs. or 0.1 lbs. of a given value or range. In certain embodiments, the term "about" or "approximately" means within 20.0 kg., 10.0 kg., 5.0 kg., 1.0 kg., 0.9 kg., 0.8 kg., 0.7 kg., 0.6 kg., 0.5 kg., 0.4 kg., 0.3 kg., 0.2 kg., 0.1 kg., or 0.05 kg., of a given value or range.

As used herein, and unless otherwise specified, the term "about" when used with respect to a weight or tension load means variations up to 5%, up to 10%, up to 15%, up to 20%, up to 25%, and up to 30%. For example: If the amount of weight or tension load is "10.0 lbs.," this may include variations of up to 5%, i.e. 9.5-10.5 lbs., variations of up to 10%, i.e. 9.0-11.0 lbs., variations of up to 15%, i.e. 8.5-11.5 lbs., variations of up to 20%, i.e. 8.0-12.0 lbs., variations of up to 25%, i.e. 7.5-12.5 lbs., or variations of up to 30%, i.e. 7.0-13.0 lbs.

As used herein, and unless otherwise specified, the term "about" when used with respect to a length means variations up to 5%, up to 10%, up to 15%, up to 20%, up to 25%, and up to 30%. For example: If the amount of the length is "10.0 ft.," this may include variations of up to 5%, i.e. 9.5-10.5 ft., variations of up to 10%, i.e. 9.0-11.0 ft., variations of up to 15%, i.e. 8.5-11.5 ft., variations of up to 20%, i.e. 8.0-12.0 ft., variations of up to 25%, i.e. 7.5-12.5 ft., or variations of up to 30%, i.e. 7.0-13.0 ft.

As used herein, the terms "comprises", "comprising", or any other variation thereof, are intended to cover a nonexclusive inclusion, such that a process, method, article, or apparatus that comprises a list of elements does not include only those elements but may include other elements not expressly listed or inherent to such process, method, article, or apparatus.

As used herein, the terms "user," "subject," "subjects," "athlete" or "patient" are used interchangeably.

As used herein, the terms "user," "subject" and "subjects," "athlete" or "patient" refer to a primate (e.g., a human). In certain embodiments, the primate is 0 to 6 months old, 6 to 12 months old, 1 to 5 years old, 5 to 10 years old, 10 to 15 years old, 15 to 20 years old, 20 to 25 years old, 25 to 30 years old, 30 to 35 years old, 35 to 40 years old, 40 to 45 years old, 45 to 50 years old, 50 to 55 years old, 55 to 60 years old, 60 to 65 years old, 65 to 70 years old, 70 to 75 years old, 75 to 80 years old, 80 to 85 years old, 85 to 90 years old, 90 to 95 years old or 95 to 100 years old. In a preferred embodiment, the user, subject, athlete, or patient is a human.

As used herein, the terms "therapies," "therapy," "treatment(s)" and "treating" can refer to any protocol(s), method (s), compositions, exercises, and/or agent(s) that can be used in the prevention, treatment, management, or amelioration of a sub-optimal physical condition; (e.g.: weight management, arthritis; orthopedic surgery recovery; stroke, heart attack, amputation, etc.). In certain embodiments, the terms "therapies" and "therapy" refer to physical therapy, supportive therapy, and/or other therapies useful in treatment, management, prevention, or amelioration of a sub-optimal physical condition, known to one of skill in the art.

As used herein, and unless otherwise specified, the term "anterior" refers to human anatomy and means the front surface of the body; often used to indicate the position of one structure relative to another, that is, situated nearer the front part of the body. Alternately, it may also refer in a similar fashion to an apparatus or structure.

As used herein, and unless otherwise specified, the term "posterior" refers to human anatomy and means the back surface of the body; Often used to indicate the position of one structure relative to another, that is, nearer the back of the body. Alternately, it may also refer in a similar fashion to an apparatus or structure.

As used herein, and unless otherwise specified, the term "superior" refers to human anatomy and means situated nearer the vertex of the head in relation to a specific reference point; opposite of inferior. It may also mean situated above or directed upward. Alternately, it may also refer in a similar fashion to an apparatus or structure.

As used herein, and unless otherwise specified, the term "inferior" refers to human anatomy and means situated nearer the soles of the feet in relation to a specific reference point; opposite of superior. It may also mean situated below or directed downward. Alternately, it may also refer in a similar fashion to an apparatus or structure.

As used herein and unless otherwise specified, the term "medial" refers to human anatomy and refers to being situated toward the median plane or midline of the body. Alternately, it may also refer in a similar fashion to an apparatus or structure. In some embodiments, medial refers to an inside surface of an apparatus, closest to the midline of the body to which the apparatus is applied.

As used herein, and unless otherwise specified, the term "lateral" refers to human anatomy and means denoting a position farther from the median plane or midline of the body or a structure. Alternately, it may also refer in a similar fashion to an apparatus or structure. It can also mean, "pertaining to a side." In some embodiments, lateral refers to an outside surface of an apparatus, farthest from the midline of the body to which the apparatus is applied.

As used herein, and unless otherwise specified, the term "transverse plane" (also called the horizontal plane, axial plane, or transaxial plane), is an imaginary plane that divides the body into superior and inferior parts and is perpendicular to the coronal and sagittal planes.

As used herein, and unless otherwise specified, the term "coronal plane" (also known as the frontal plane, sometimes referred to as a longitudinal plane because it is perpendicular to the transverse plane), is any vertical plane that divides the body into ventral and dorsal (belly and back) sections.

As used herein, and unless otherwise specified, the term "sagittal plane" (also known as median plane or mid-sagittal plane), is an anatomical plane which divides the body into right and left halves. This plane cuts the body into halves (assuming bilateral symmetry), passing through midline structures such as the navel and spine. The term "parasagittal" as used herein is meant to describe any plane parallel to the sagittal plane.

As used herein, and unless otherwise specified, the term "prone" means lying on the stomach and the term "supine" means lying on the back.

As used herein, the term "proximity" means nearness in space or relationship, but not excluding the potential to be touching. Proximity is also alternatively meant to mean that one thing may be as close to another thing as to be "in direct or nearly direct contact" (in proximity) with another thing along some point. To "place something in proximity" is also meant to mean that items are "paired" or "mated together" either in their paired function or at some point of contact.

As used herein, and unless otherwise specified, the terms "connection device," "connector" and "attachment coupling" mean a device intended for connecting parts together or for the pairing of two items; a device that serves to connect the ends of adjacent parts or objects.

As used herein, and unless otherwise specified, the term "securing mechanism" means a method, tool, or device intended to close, fix, fasten or join two or more components together in a secure manner, in order to assure that they not become loose, not open unintentionally, give way, or be lost. The term "securing mechanism" is used broadly and may include locks, attachment couplings, buckles, closure mechanisms, threads, stitches, Velcro™ or "hook and loop" connectors, straps, strings, ties, zippers, hitches, snaps, etc.

As used herein, and unless otherwise specified, the term "closure mechanism", "cavity closure mechanism" and similar terms, means a method, tool or device intended to close an opening or secure two or more edges together in order to close an opening or pocket. A closure mechanism may include attachment couplings, closure mechanisms, threads, stitches, zippers, snaps, etc.

As used herein, and unless otherwise specified, the term "pocket" means a small bag or "pouch" that is typically sewn onto or inserted in the apparatus, such that it is open at the top and/or side and intended for carrying items. A pocket may be open or releasably closeable, comprising a closure mechanism intended to close the pocket in order to secure items within the pocket, but openable to allow for the extraction of said items when desired.

As used herein, and unless otherwise specified, the term "margin" or "end margin" means a border or edge or a garment or piece of material, as for example, the edge of a pocket or pouch where a seam, edge, or closure mechanism exists.

As used herein, and unless otherwise specified, the term "carabiner" refers to a specialized type of shackle, a metal loop with a spring-loaded gate used to quickly and reversibly connect components, most notably in safety-critical systems. The word is a shortened form of Karabinerhaken (or also short Karabiner), a German phrase for a "spring hook" to attach items to a belt or bandolier. They are predominantly made from both steel and aluminum, but other high strength materials, such as titanium, could also be utilized. In any one of the embodiments, the carabiner can comprise "auto-locking," "manual locking," or "non-locking" mechanisms.

As used herein, and unless otherwise specified, the term "pocket" or "pouch" refers to a small bag or containment space sewn into or on clothing or into or on an item so as to form part of the item, used for carrying small articles or accessories.

In some embodiments, the exercise apparatus comprises at least one pocket between the layers of the strap-like apparatus for securing and carrying exercise accessories, such as releasable handles, various attachment devices, ropes, "first aid" materials, suspension lines, bands, or elastic bands attachable to multiple fixation rings located about the strap-like apparatus. In some embodiments, the apparatus and described methods of use provide the user with balanced loading options to develop even muscle tone or muscle stretching options, while providing the user with the flexibility to exercise, indoors, outdoors or anywhere.

Alternatively, one skilled in the art would understand that in some embodiments, the exercise apparatus is a multi-purpose training apparatus configurable by the user or a trained professional as a physical therapy device.

Alternatively, one skilled in the art would understand that in some embodiments, the strap-like apparatus described herein comprises a single "base" layer, with one or more pockets comprising at least one auxiliary layer formed on one or both sides of the base layer of the strap-like apparatus.

The exercise apparatus can be worn or carried anywhere by the user and is configurable to provide an individual with portable exercise equipment to perform balanced resistance training, stretching and tension training utilizing, among other things, elastic and non-elastic bands, suspension lines, as well as detachable and affixed flexible or solid handles used in various exercise protocols and therapeutic applications.

Provided herein is an exercise apparatus comprising a strap-like apparatus or strap-like belt, as illustrated in FIGS. 1-5, the exercise apparatus 100, 200, 300, 400, 500, 600 adapted to be worn about the user's body, wherein the apparatus comprises at least a first layer 101 and a second layer 201, wherein, when assembled, the first layer 101 comprises a first inside surface 303 and a first outside surface 61, and the second layer 201 comprises a second inside surface 304 and a second outside surface 61; a pocket 301 or pockets, having the inside surfaces 303, 304 between the first layer 101 and the second layer 201, which can be continuous or segregated into two or more compartment-like pockets; a connector strap 106 comprising a first end 109 and a second end 110 and affixed to the outside surface 61 or inside surface 51 of the first layer 101, wherein the connector strap 106 comprises a coupling mechanism 120 comprising components 107, 108 for releasably securing the first end 109 and second end 110 of the connector strap to each other; a first handle 111*a* and a second handle 111*b* permanently or temporarily affixable to the connector strap 106 or directly to the outside of the apparatus, wherein each handle 111 is spaced approximately equidistant from the lengthwise center of the layered strap-like apparatus; a first fixation ring 211*a* affixed adjacent to the first end 12 of the strap-like apparatus, extending outside of the pocket 301; and a second fixation ring 211*b* affixed adjacent to the second end 13 of the strap-like apparatus, extending outside of the pocket 301; wherein the first and second fixation rings 211*a*, 211*b* are affixed or secured between the first and second layers and to the connector strap or are affixed directly to the connector strap at an assembly point 20.

Figure 4:
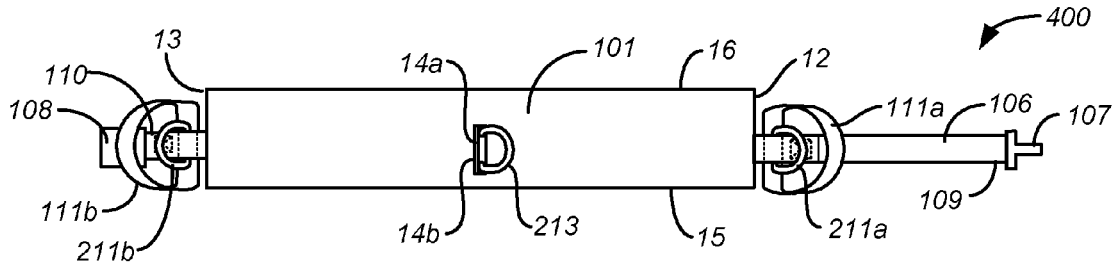
FIG. 4 is an illustrative front plan view of a fully assembled exemplary multi-layered exercise strap-like apparatus of FIG. 3, further illustrating the formation of an inner pocket with a (third layer) outer covering, and further illustrating the exposed central fixation ring (D-ring) protruding through the access slot in the outer covering (third) layer.
Figure 5:
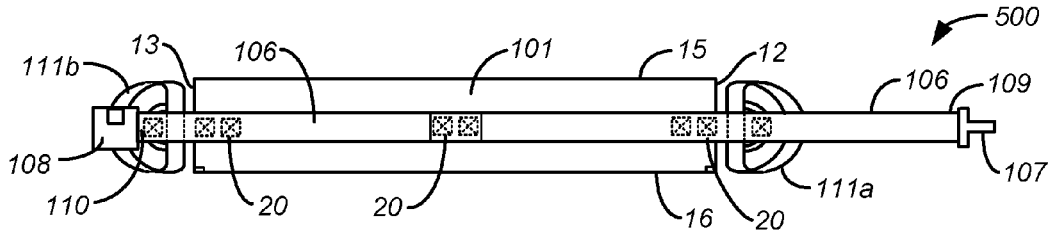
FIG. 5 is an illustrative back plan view of a fully assembled exemplary multi-layered exercise strap-like apparatus of FIG. 4, further illustrating the full connector strap and reinforced (sewn) connection points for the various fixation rings (D-rings) and handles.

In some embodiments, the device comprises a third layer 401, wherein the third layer comprises a third inside surface and a third outside surface. In some embodiments, the third layer is an extension of the first layer and folds over the second layer 201 wherein edge 10 is folded over to meet edge 15 to enclose the at least one pocket 301 between the first inside surface and the second inside surface, as illustrated in FIG. 4.

Figure 3:
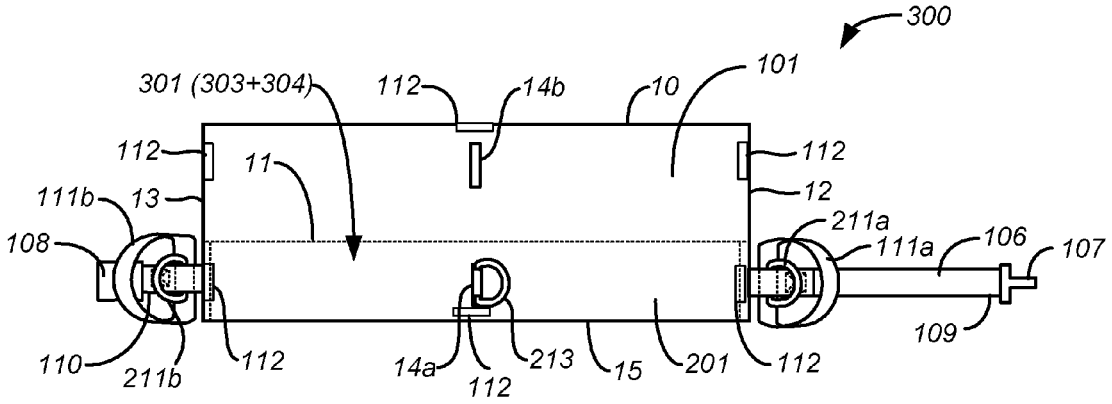
FIG. 3 is an illustrative plan view of an exemplary exercise strap-like apparatus in a partially folded state, creating a two-layer assembly, illustrating the formation of an inner pocket with an outer covering, unfolded third layer above, and further illustrating the exposed central fixation ring (D-ring) protruding through the access slot in the second layer and two outermost fixation rings (D-rings), one each protruding from each end of the formed pocket in the strap-like apparatus. Two additional fixation rings (D-rings), not shown, are hidden inside the formed pocket near the ends of the strap-like apparatus.

In one preferred embodiment of the apparatus, the at least one pocket is at least partially closable along a lengthwise edge 11. Multiple methods are described herein for achieving this. In one preferred embodiment as illustrated in FIG. 3 the apparatus includes at least one flap comprising surface 51 and further comprising at least one closing mechanism 112 which folds over the pocket 301 having edge 11 and is affixable to a mating closing mechanism 112 located about other surface of the pocket 301 or within the pocket. In one ideal example, the closing mechanism 112 comprises magnets attached to the flap and within the pocket.

In some embodiments, the layers are formed from a single piece of folded material, folded along the lengthwise edges 15, 16. In some embodiments, the layers are formed from two or more pieces of material and joined along their lengthwise edges 15, 16.

Figure 6A:
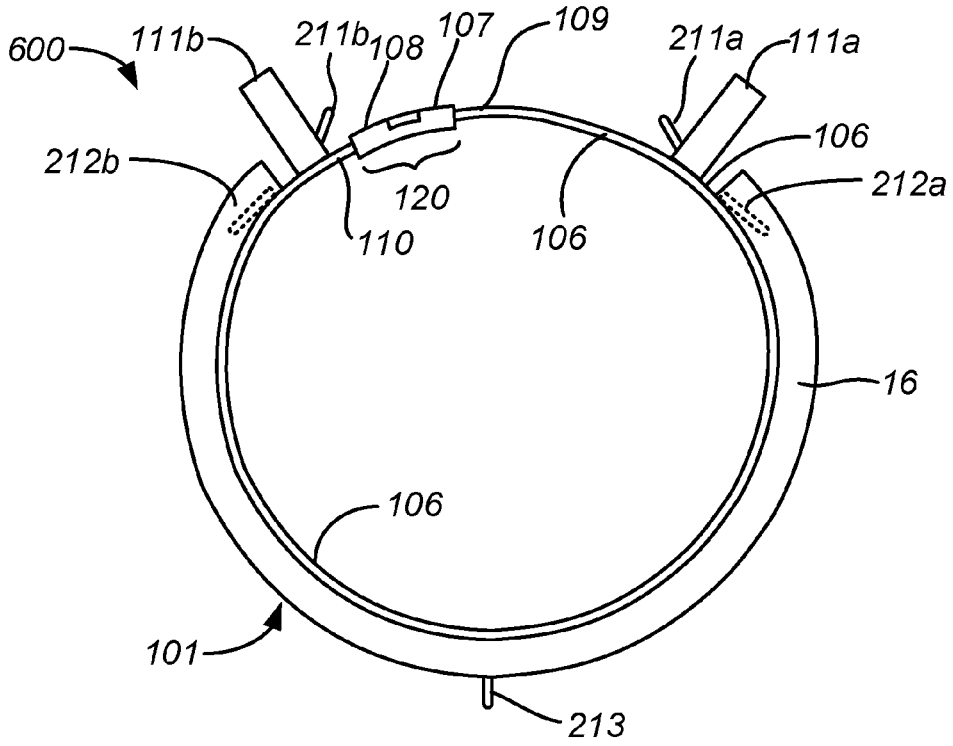
FIG. 6A is a top view of one of an exemplary assembled exercise apparatus illustrating a closed coupling mechanism and closed or covered inner pocket.
Figure 6B:
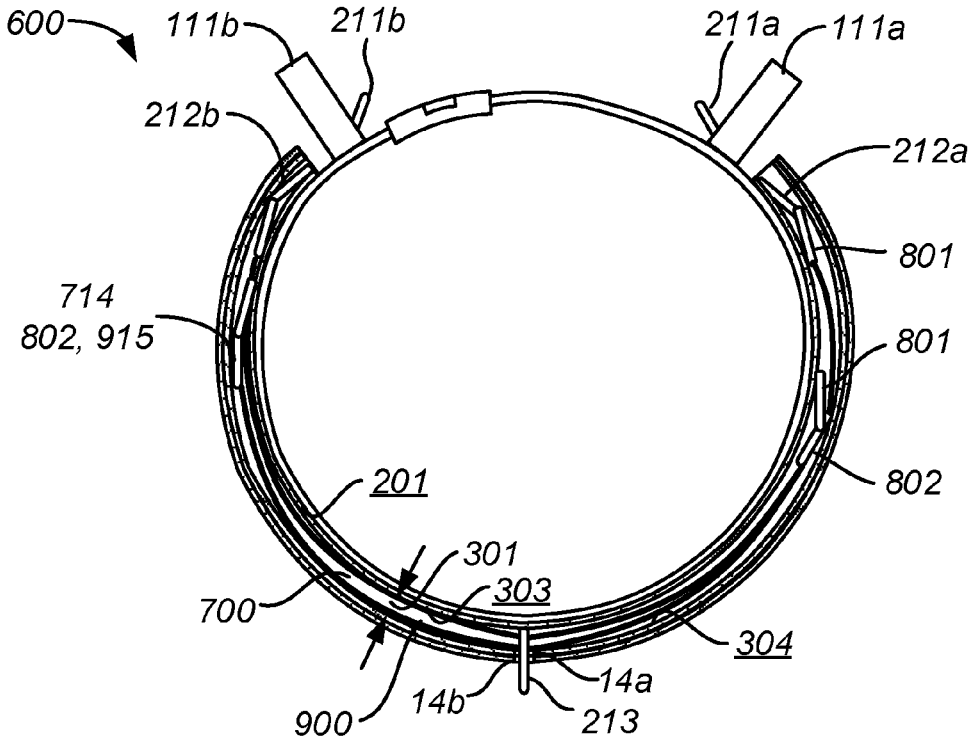
FIG. 6B is a top view of one of an exemplary assembled exercise apparatus illustrating a closed coupling mechanism and open or uncovered inner pocket, and further illustrating the internal placement of auxiliary items contained within the inner pocket, which can comprise for example; a flexible, releasable handle, elastic bands, additional attachment couplings such as a carabiner, gloves, etc.
Figure 6C:
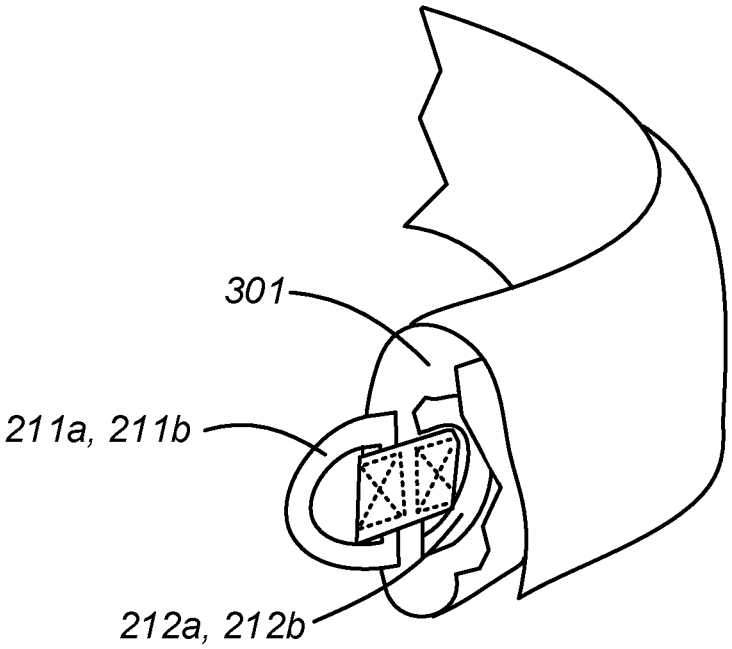
FIG. 6C is a representative partial end view of the exemplary assembled exercise apparatus of FIG. 6B illustrating one possible configuration for the attachment of fixation rings (211, 212) to the apparatus at or about the end of the pocket. The ends of the pocket may be open or closed.
Figure 6D:
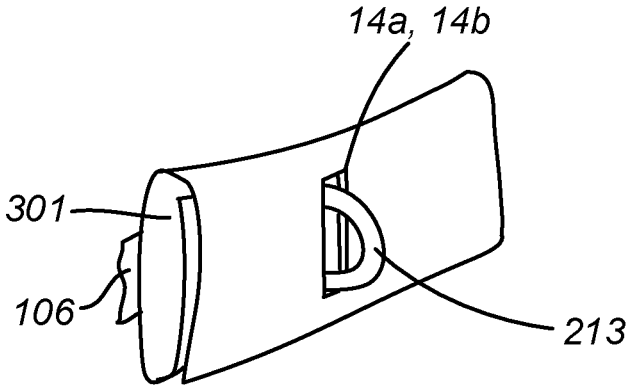
FIG. 6D is a representative view of the exemplary assembled exercise apparatus of FIG. 6B illustrating a representative attachment ring (213) protruding through the slots (14*a*, 14*b*) in the layers of the pocket.

In some embodiments, the exercise apparatus comprises a third fixation ring 213 affixed to the connector strap 106 and through the approximate lengthwise center of the strap-like apparatus 100, 200, 300, 400, 500, 600 and accessible through at least one access point 14*a*, 14*b* in the layers of the strap-like apparatus as illustrated in FIG. 6D.

In some embodiments of the exercise apparatus, the at least one pocket 301 is at least partially closable along the lengthwise edge 11.

In some embodiments of the exercise apparatus, the at least one pocket is at least partially closable at the first longitudinal end 12 and/or the second longitudinal end 12.

In some embodiments, the apparatus further comprises at least one securing mechanism 112 configured to releasably capture and at least partially close the first longitudinal end 12 and/or the second longitudinal end 13 of the at least one pocket 301.

In some embodiments, the at least one securing mechanism 112 to releasably capture and at least partially close the lengthwise edge or edges, and/or ends of the pocket or pockets comprises: a lace, a flap; a Velcro™ connection; a compression snap; a zipper; a magnet; a buckle; a button; a clasp; a flexible material strap; and a hook.

In some embodiments of the exercise apparatus, the first longitudinal end 12 and/or the second longitudinal end 12 of the at least one pocket are at least partially closed with a permanent fixation means. In some embodiments, the permanent fixation means comprise thread; rivets; heat bonding materials; and glues or epoxies.

In some embodiments, the exercise apparatus comprises a fourth fixation ring 212*a* affixed adjacent to the first end 12 of the strap-like apparatus and a fifth fixation ring 212*b* affixed adjacent to the second end 13 of the strap-like apparatus, near the first and second fixation rings 211*a*, 211*b*, wherein the fourth and fifth fixation rings 212*a*, 212*b* are affixed between the first and second layers 101, 102, within the at least one pocket 301, and to the connector strap 106 at an assembly point 20 and are accessible from the inside of the at least one pocket, as more clearly illustrated in FIG. 6C. The fourth and fifth points 212*a*, 212*b* are ideally intended to provide secure locations to detachable secure attachment features intended for use with the exercise apparatus within pocket 301.

In some embodiments of the apparatus, the first handle 111*a* and second handle 111*b* are permanently affixed to the connector strap 106. In some embodiments of the apparatus, the first handle 111*a* and second handle 111*b* are permanently affixed to a secure layer 101 or layers 101, 201, 401 of the apparatus. In some embodiments of the apparatus, the first handle 111*a* and second handle 111*b* are permanently affixed to a layer or layers and the connector strap of the apparatus.

In some embodiments of the apparatus, the first handle 111*a* and second handle 111*b* comprise collapsible handgrips 702, flexible bands; or a tubular grip with a flexible band of material extended therethrough and connected together at the ends thereof (not shown).

In some embodiments of the apparatus 600, the at least one pocket 301 is configured to releasably capture and secure accessory articles, as illustrated in FIG. 6B. As further illustrated in FIGS. 6A and 6B, the at least one pocket 301 can be connected at the ends of the connector strap with an assembled coupling mechanism 120, comprising coupling components 107, 108, so that the apparatus can easily worn about a user's body. Further still, the pocket 301 can be covered by a flap or third layer 401 to hide or secure various accessories contained therein.

In some embodiments, the exercise apparatus further comprises at least a releasably attachable third handle.

Figure 7A:
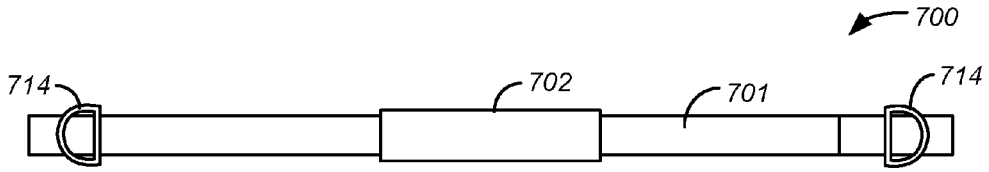
FIGS. 7A-7C are illustrative views of an exemplary detachable flexible handle strap in various states of assembly and further comprising end fixation rings and a quick-release attachment coupling, such as a carabiner.
Figure 7B:
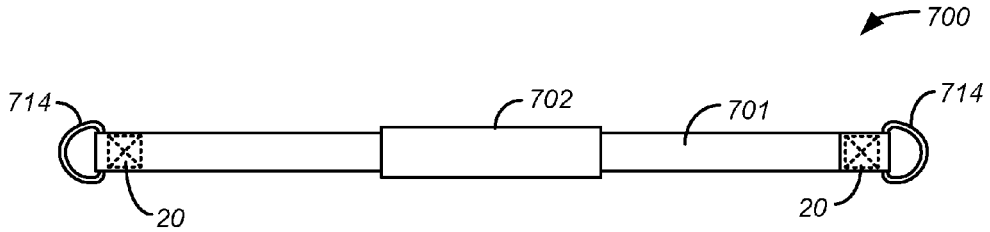
Figure 7C:
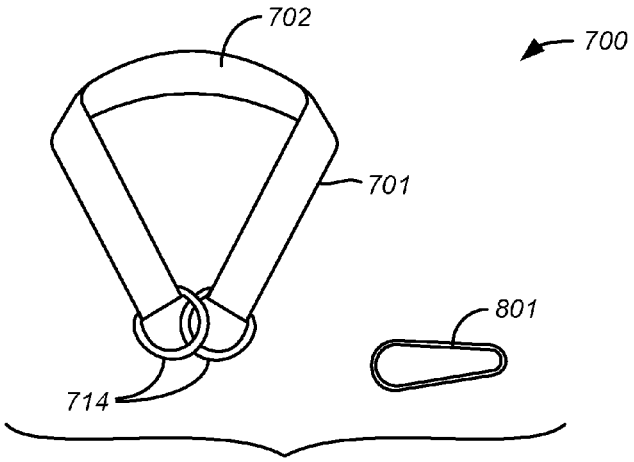

In some embodiments of the apparatus, the releasably attachable third handle comprises a flexible, wear resistant material strap 700 as illustrated in FIGS. 7A-7C.

In some embodiments of the apparatus, the releasably attachable third handle 700 comprises a strap material 701, a grip 702 (as previously described), an auxiliary fixation ring 714, and/or quick-release attachment coupling 801 on a first end and a second end of the strap.

In some embodiments of the apparatus, the auxiliary fixation rings 714 and/or quick-release attachment couplings 801 of the releasably attachable third handle 700 are attachable to any of the fixation rings 211, 212, 213 on the exercise apparatus.

As further illustrated in FIGS. 7A-7C, the releasably attachable third handle may be assembled from a variety of materials and components, wherein the auxiliary fixation rings 714 and/or quick-release attachment couplings 801 can be formed integral to the strap, (such as in a molding process), or secured to the strap at an assembly point 20.

In some embodiments of the apparatus, the third handle is attachable to any of the fixation rings 211, 212, 213 on the apparatus or to any of the other accessory articles.

Figure 8:
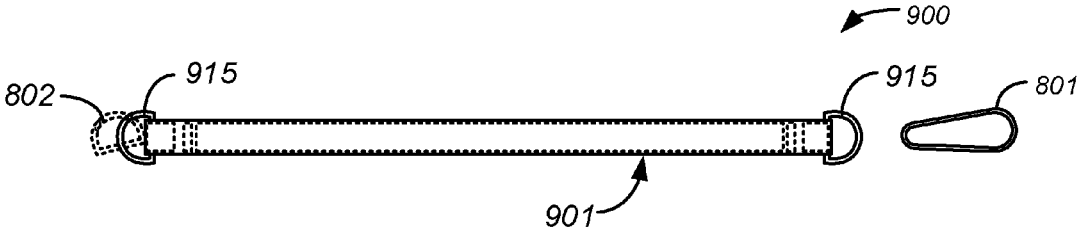
FIG. 8 is an illustrative view of an exemplary elastic band and further comprising end fixation rings and a quick-release attachment coupling, such as a carabiner.

As illustrated in FIG. 8, some embodiments of the exercise apparatus further comprises at least one releasably attachable elastic band 900.

In some embodiments of the apparatus, the at least one releasably attachable elastic band 900 comprising an elastic band material 901 of variable length and tension, and further comprising an auxiliary fixation ring 915 and/or quick-release attachment coupling 801, 802 on a first end and a second end of the attachable elastic band.

In any one of the elastic band embodiments, the auxiliary fixation rings 915 and/or quick-release attachment couplings 801, 802 can be formed integral to the elastic band, (such as in a molding process), or secured to the strap at an assembly point 20.

In some embodiments of the apparatus, the elastic band is attachable to any of the fixation rings 211, 212, 213 on the apparatus or to any of the other accessory articles.

In any one of the embodiments of the layered strap-like apparatus, the coupling mechanism 120 (107,108) for releasably securing the ends of the connector strap 106 comprises: a belt buckle; a cam buckle; a Velcro™ attachment; a Velcro™ hook and loop; airline seat buckle; a side release buckle; a double loop and strap of material; and a snap hook and ring.

In some embodiments, the belt buckle further comprises a frame-style buckle; a plate-style buckle; a box-out buckle; and a box-frame buckle.

In some embodiments of the apparatus, the coupling mechanism is length-adjustable, providing the user with the ability to adjust the length of the connector strap to fit his or her torso appropriately.

In any one of embodiments of the apparatus, the quick-release attachment coupling 801, 802 comprises: a carabiner; a snap hook; a bolt snap; a spring snap; a spring clip; a harness clip; a releasable captured hook and variations thereof, wherein the quick-release attachment coupling is adapted to couple an accessory article to a fixation ring on said exercise apparatus.

In any one of embodiments of the apparatus, the quick-release attachment coupling 801, 802 is adapted to couple to any of the fixation rings 211, 212, 213 on the strap-like apparatus or an accessory device.

In any one of embodiments of the apparatus, the quick-release attachment coupling 801, 802 is adapted to couple to any stationary structure comprising a feature that can act as an anchoring point for the elastic band 900.

In any one of embodiments of the exercise apparatus, the fixation ring 211, 212, 213 comprises: a circular ring; a reinforced material ring; a D-ring; a carabiner; a spring clip; a harness clip; a snap hook; and a releasable captured hook.

In any one of embodiments of the apparatus, the quick-release attachment couplings 801, 802 and fixation rings 211, 212, 213 comprise materials of sufficient strength to support a human and provide a factor of safety, such as alloy aluminum, steels and other metals known to those skilled in the art safety equipment, sky diving and mountain climbing, or any of the materials described below.

In any one of embodiments of the apparatus, the belt/strap-like exercise apparatus 300, 400, 500, 600 is adapted to be worn about the waist of the user's body. In any one of embodiments of the apparatus, the belt/strap-like exercise apparatus 300, 400, 500, 600, is adapted to be carried as a bandolier about the user's body. In any one of embodiments of the apparatus 100, 200, 300, 400, 500, 600, the strap-like apparatus is adapted to be carried in a gym bag, backpack, or similar equipment-carrying apparatus.

In some embodiments of the apparatus, the at least one releasably attachable elastic band 900 comprises an elastic tension ranging from about: 1.0-5.0 lbs.; 2.0-10.0 lbs.; 5.0-15.0 lbs.; 10.0-20.0 lbs.; 15.0-30.0 lbs.; 20.0-40.0 lbs.; 25.0-50.0 lbs.; 30.0-60.0 lbs.; 35.0-70.0 lbs.; 40.0-80.0 lbs.; 45.0-90.0 lbs.; 50.0-100.0 lbs.; 60.0-120.0 lbs.; 75.0-150.0 lbs.; 100.0-200.0 lbs.; 150.0-250.0 lbs.; 200.0-400.0 lbs.; and from about 1.0-400 lbs.

In some embodiments of the apparatus, the at least one releasably attachable elastic band 900 ranges in length from about: 0.5-2.0 feet, 1.0-2.0 feet, 1.5-2.0 feet; 1.5-3.0 feet; 1.5-4.0 feet; 1.5-5.0 feet; 1.5-6.0 feet; 1.5-7.0 feet; 1.5-8.0 feet; 1.5-9.0 feet; and from about 0.5-10.0 feet.

In some embodiments, the apparatus comprises at least one releasably attachable non-elastic band and/or at least one releasably attachable elastic band.

In some embodiments of the apparatus the at least one releasably attachable elastic band 900 comprises a protective sleeve (not shown) to prevent or at least reduce wear, abrasion, tearing and scoring of the elastic bands from during use. In some embodiments, the protective sleeve prevents overstretching of the non-elastic or elastic bands during use. In some embodiments, the protective sleeve has an elastic quality to allow it to stretch with the underlying band. In some embodiments, the elastic protective sleeve prevents overstretching of the non-elastic or elastic bands during use.

In some embodiments of the apparatus, the elastic band comprises a non-elastic inner band to prevent or at least reduce overstretching and possible failure of the elastic bands during use.

In some embodiments of the apparatus, an accessory article comprises: an elastic band 900; a non-elastic band (not shown); a detachable flexible handle 700; a running parachute (not shown); a suspension cord (not shown); a suspension harness (not shown); parachute cord (not shown); a quick-release coupling mechanism 801, 802; a flexible water canteen (not shown); and a glove (not shown).

In some embodiments of the apparatus, the strap-like apparatus or components thereof comprise wear-resistant material comprising: nylon; moleskin; polyester; polypropylene; aramid polymer fabric; Kevlar®; technical fabric; SuperFabric®; Cordura®; Spectra Shield®; Dyneema®; Tegris™ polypropylene; Innegra™; HB51; Protech®; Gold Shield®; polyethylene naphthalate (PEN); Vectran®; high-modulus polyethylene; ABC-Matrixo; Technora®; Vectran®; Ultra High Molecular Weight Polyethylene (UHM-WPE); Twaron®; Zylon®; Carbon Fiber; Mylar®; and or leather.

In some embodiments of the apparatus, the strap-like apparatus further comprises one or more of a plurality of safety features comprising: reflective tape; neon coloring; florescent coloring; a flashing light unit (not shown); RFID tracking device (not shown); GPS tracking device (not shown); or a geolocation device (not shown).

In some embodiments of the apparatus, an additional (fourth) layer is contemplated, creating a second pocket or pockets, wherein a user can store certain accessory items that may be required less frequently, or don't require removal during normal use, such as one or more thin flexible water bottles or water sacks comprising extendable water tubes, suction straws and flow valves that a user can access as needed during an extended exercise routine. Placement of the water sacks could be in the second pocket, on either side of center fixation ring, in order to avoid placing undue stress on the water sacks during routine suspension exercises where the apparatus is suspended (about the approximate center of the belt) from a hanging structure, or wrapped around a support structure such as a pole, when performing horizontal or vertical resistance exercises.

Figure 9:
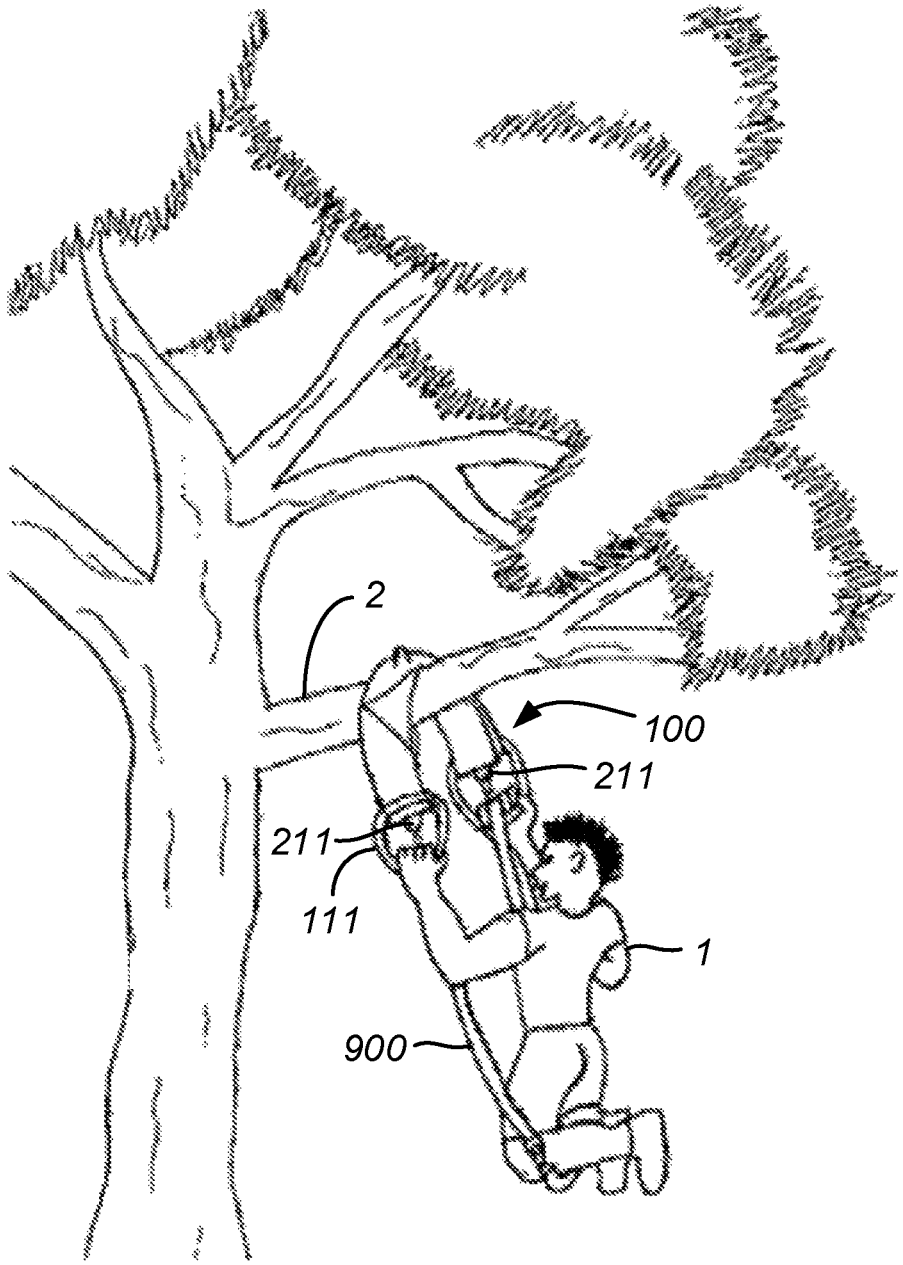
FIG. 9 is an illustrative view of a user performing an exercise routine with the apparatus.

As illustrated in FIG. 9, a user can suspend the apparatus 100 over a structure capable of supporting a weight in excess of the user 1, such as a large tree limb 2, and performing various strength-building exercises, such as pull-ups or assisted pull-ups. As illustrated herein, a user 1 is performing assisted pull-ups by kneeling in a suspended elastic band 900, while grasping the apparatus handles 111, allowing the elastic bands 900 to partially support his/her weight during the exercise. Of course, it would be obvious to one skilled in the art that the user can perform the same exercise without the assistance of the elastic bands 900.

Figure 10:
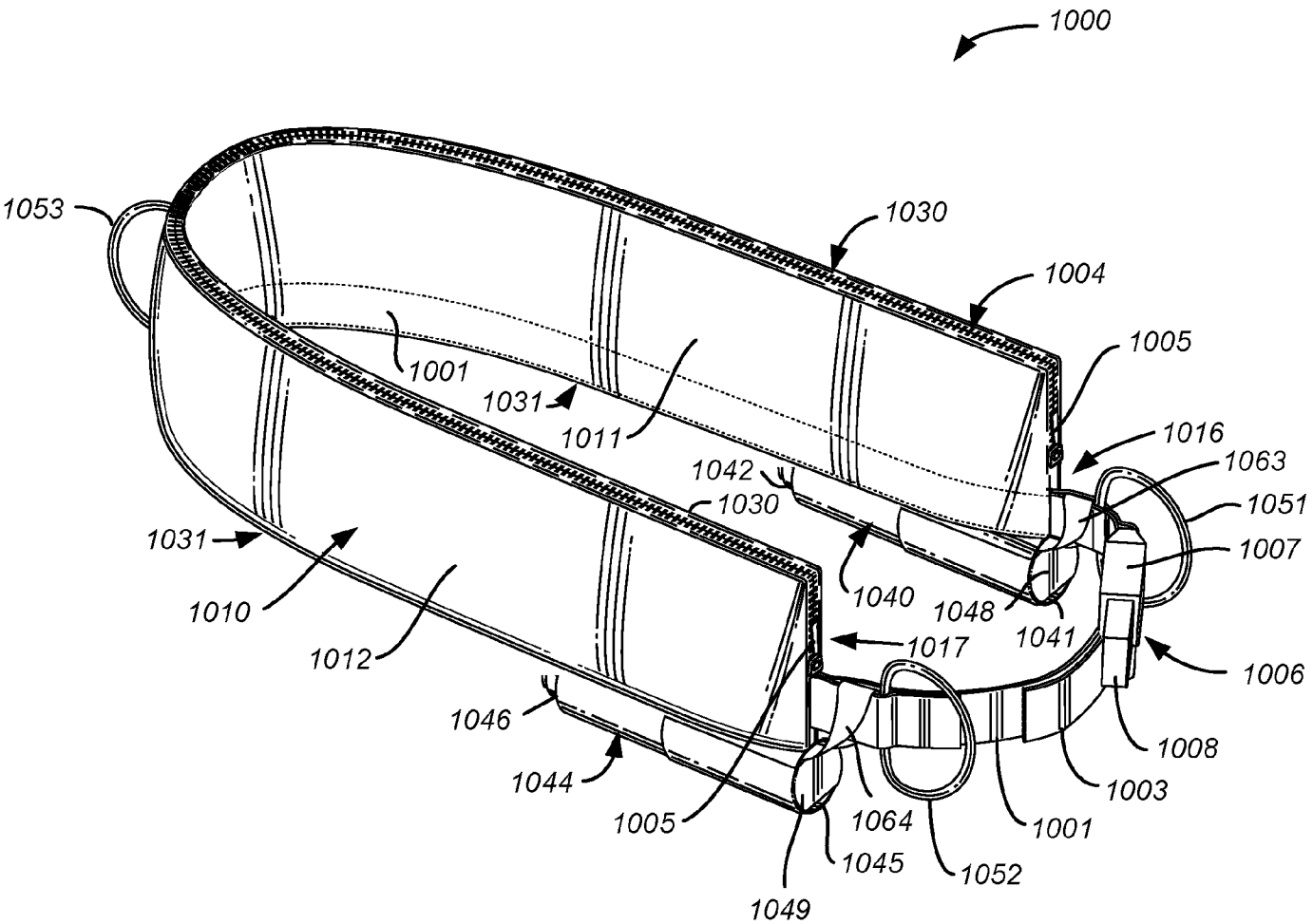
FIG. 10 is a perspective view of another exemplary portable exercise apparatus having a single releasably closable continuous pocket affixed to an adjustable connector strap with a coupling mechanism assembly and auxiliary storage pockets configured along the inferior edge of the single releasably closable continuous pocket.
Figure 11:
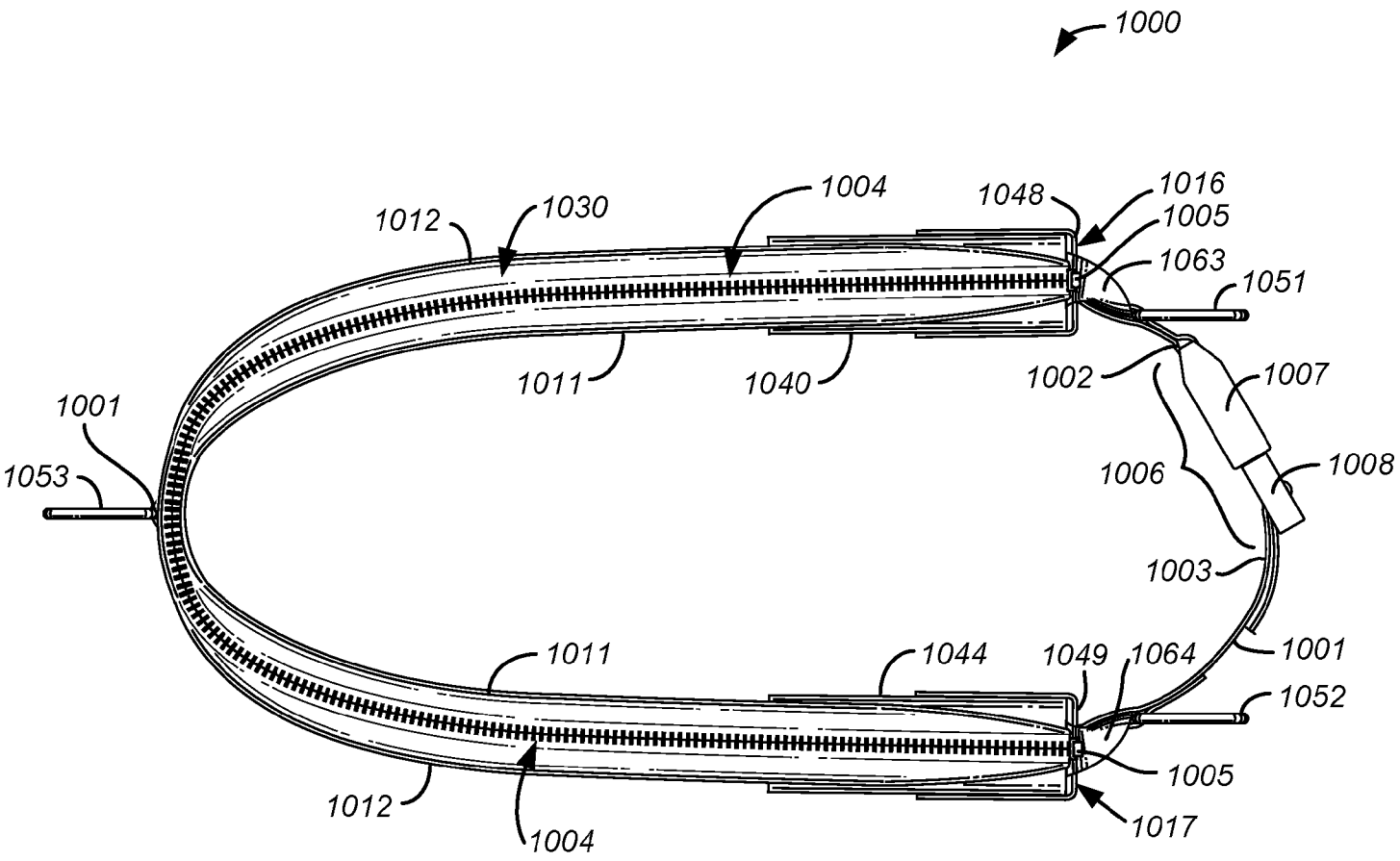
FIG. 11 is a top plan view of the exemplary portable exercise apparatus of FIG. 10 with a single releasably closable continuous pocket.
Figure 15:
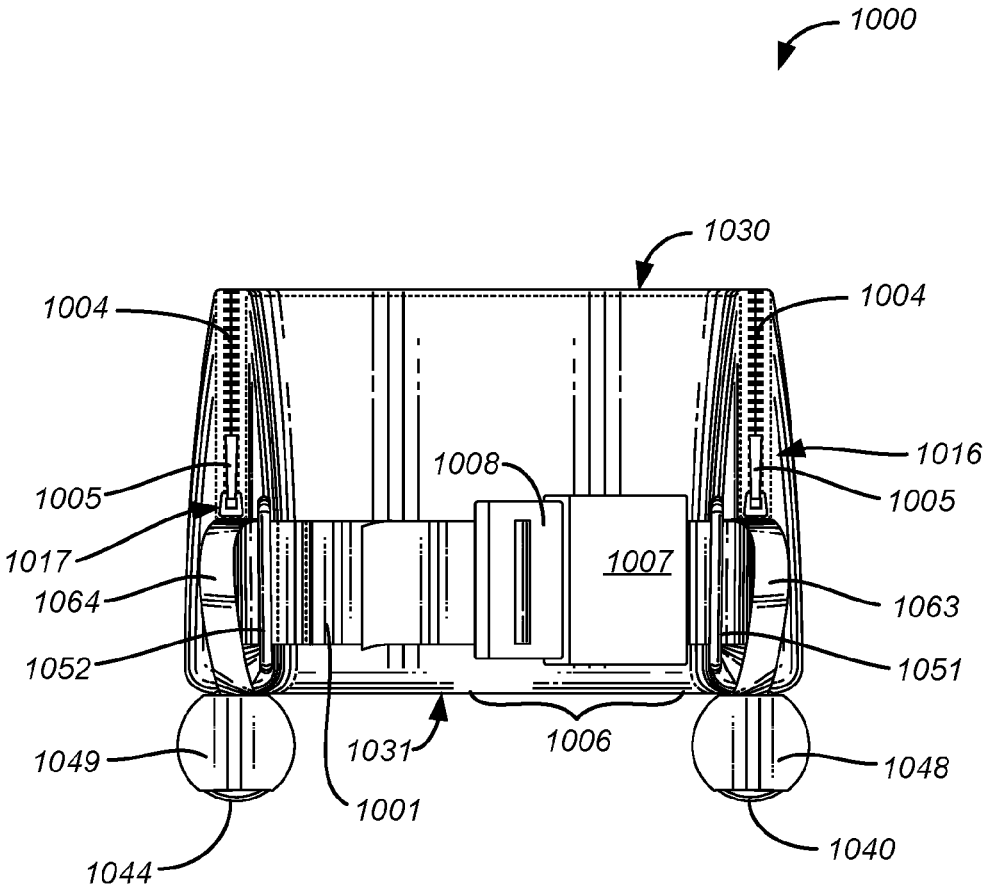
FIG. 15 is a front elevation view of the exemplary portable exercise apparatus of FIG. 10 with a single releasably closable continuous pocket.
Figure 17:
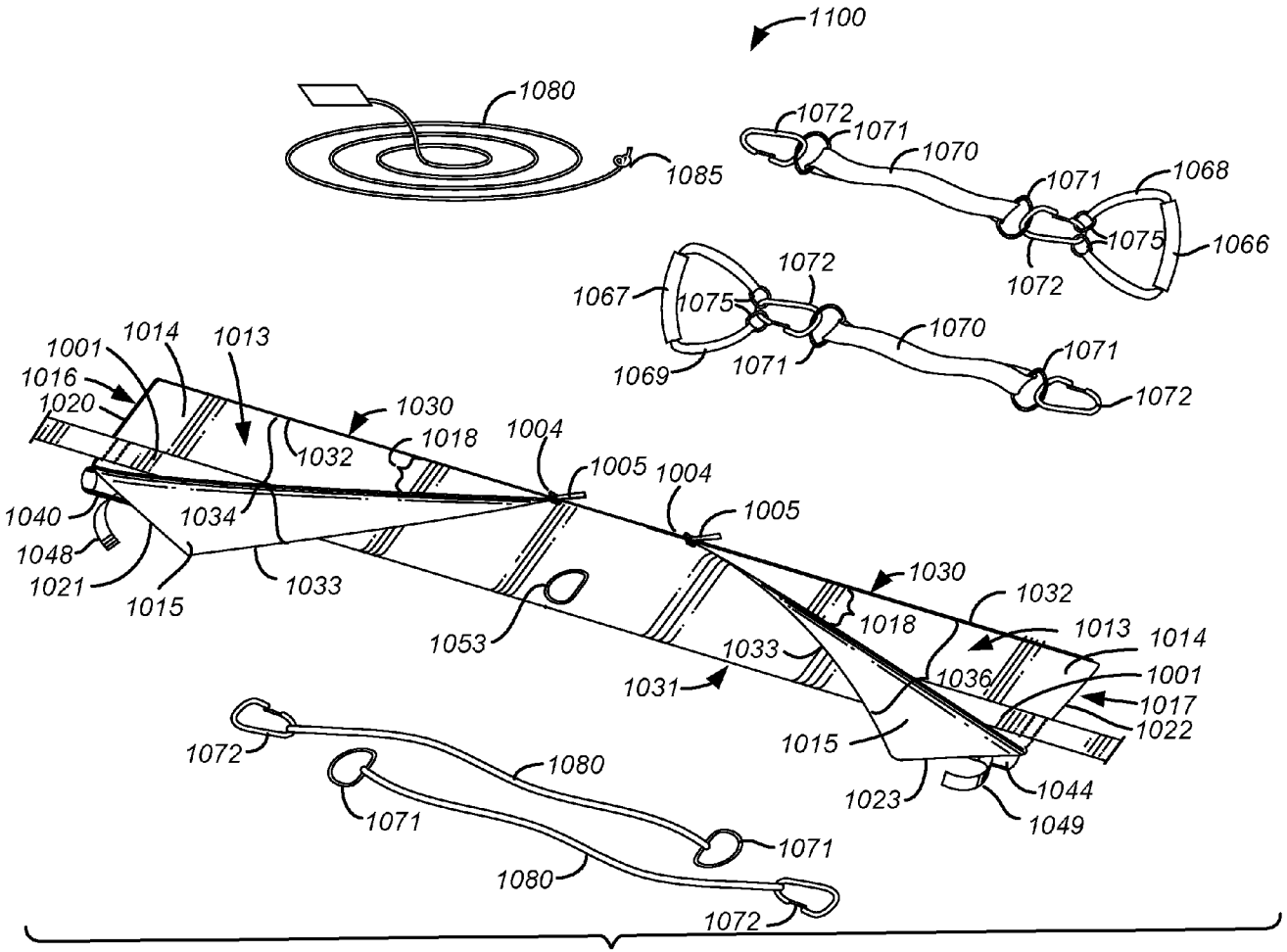
FIG. 17 is another perspective view of the exemplary portable exercise apparatus of FIG. 10 in a fully extended state illustrating the single open, releasably closable pocket for holding accessories, with the two securing mechanisms in an open pocket state and the attachment strap affixed therein and a plurality of accessories comprising tension bands, suspension lines, and additional releasable handles.

Provided herein is a portable exercise apparatus 1000, as illustrated in FIGS. 10, 11 and 17 comprising: an adjustable connector strap 1001 having a first end 1002 and a second end 1003 spaced lengthwise from each other; a coupling mechanism assembly 1006, as illustrated in FIG. 15, comprising a first coupling component 1007 and a second coupling component 1008 for releasably securing the first end 1002 of the adjustable connector strap to another section of the adjustable connector strap at or near the second end 1003 of the adjustable connector strap; a releasably closeable pocket 1010, affixed lengthwise to the adjustable connector strap comprising; at least a first medial exterior surface 1011 and a first lateral exterior surface 1012, an interior space 1013 within the releasably closeable pocket comprising at least a first medial interior surface 1014 and a first lateral interior surface 1015, a first exterior end margin 1016, and a second exterior end margin 1017; wherein the first end margin and the second end margin are closed and spaced apart from each other at opposite ends of the pocket 1010 along the adjustable connector strap; a first exterior lengthwise margin 1030 comprising a first edge 1032 and a second edge 1033, forming a first opening 1018 to the interior space; and a second exterior lengthwise margin 1031 spaced apart from the first exterior lengthwise margin 1030 forming a closed bottom to the interior space of the pocket; wherein the first lengthwise margin 1030 and second lengthwise margin 1031 are positioned longitudinally along the adjustable connector strap between the first exterior end margin 1016 and second exterior end margin 1017; at least one securing mechanism 1004 configured to releasably capture the first edge 1032 and the second edge 1033 to at least partially close the first opening 1018 to the interior space 1013 of the releasably closeable pocket 1010; wherein the adjustable connector strap 1001 is affixed lengthwise to the medial interior surface 1014 of the releasably closeable pocket, or to the medial exterior surface 1011 of the releasably closeable pocket such that the first end 1002 and the second end 1003 of the adjustable connector strap 1001 protrude past the first exterior end margin 1016 and the second exterior end margin 1017 of the pocket 1010.

In some embodiments of the portable exercise apparatus, the first exterior end margin 1016 comprises a third edge 1020 and a fourth edge 1021, forming a second opening 1034 to the interior space 1013 of the pocket 1010, wherein the at least one securing mechanism 1004 is configured to releasably capture the third edge 1020, the fourth edge 1021, first edge 1032 and the second edge 1033 to at least partially close the first opening 1018 and the second opening 1034 to the interior space 1013 of the releasably closeable pocket 1010.

In some embodiments of the portable exercise apparatus 1000, the second exterior end margin 1017 comprises a fifth edge 1022 and a sixth edge 1023, forming a third opening 1036 to the interior space 1013, wherein the at least one securing mechanism 1004 is configured to releasably capture the third edge 1020, the fourth edge 1021, first edge 1032, the second edge 1033, the fifth edge 1022 and the sixth edge 1023, to at least partially close the second opening 1034, the first opening 1018, and the third opening 1036 to the interior space 1013 of the releasably closeable pocket 1010.

In some embodiments, the first pocket opening 1018 only adjoins the second pocket opening 1034 to create two adjoining openings. In some embodiments, the first pocket opening 1018 adjoins only the third pocket opening 1036 to create two different adjoining openings. In some embodiments, the first pocket opening 1018 adjoins the second pocket opening 1034 and the third pocket opening 1036 to create a contiguous opening.

In some embodiments, the first opening 1018, the second opening 1034 and the third opening 1036 of the releasably closeable pocket 1010 each individually comprise a separate securing mechanism 1004, such that there is one closure mechanism when there is one pocket opening, two closure mechanisms when there are two pocket openings or three closure mechanisms when there are three pocket openings. Further still, in some embodiments, the releasably closeable pocket can comprise only two closure mechanisms when there are three pocket openings, wherein one closure mechanism can secure two adjoining pocket openings, and a second closure mechanism secures the third pocket opening. Still further, in some embodiments, there can be multiple closure mechanisms to secure each pocket opening of the releasably closeable pocket.

In some embodiments, the portable exercise apparatus 1000 comprises: an adjustable connector strap 1001 comprising a first end 1002 and a second end 1003 spaced lengthwise from each other; a coupling mechanism assembly 1006 comprising a first coupling component 1007 at the first end of the adjustable connector strap and a second coupling component 1008 at or near the second end adjustable connector strap for releasably securing the first end 1002 of the adjustable connector strap to a section of the adjustable connector strap at or near the second end 1003 of the adjustable connector strap; a releasably closeable pocket 1010 affixed lengthwise to the adjustable connector strap comprising at least a first medial exterior surface 1011 and a first lateral exterior surface 1012, an interior space 1013 within the releasably closeable pocket comprising, a first medial interior surface 1014 and a first lateral interior surface 1015; a first exterior end margin 1016 and a second exterior end margin 1017; a first exterior lengthwise margin 1030 comprising a first edge 1032 and a second edge 1033, forming a first opening 1018 to the interior space; and a second exterior lengthwise margin 1031 spaced apart from the first exterior lengthwise margin, forming a closed bottom to the interior space of the pocket; the first exterior end margin 1016 comprising a third edge 1020 and a fourth edge 1021, forming a second opening 1034 to the interior space, the second exterior 1017 end margin comprising a fifth edge 1022 and a sixth edge 1023, forming a third opening 1036 to the interior space, wherein the first end margin 1016 and the second end margin 1017 are spaced apart from each other at opposite ends of the pocket 1010, wherein the first exterior lengthwise margin 1030 and the second exterior lengthwise margin 1031 adjoin the first end margin 1016 and the second end margin 1017, and wherein the first and the second lengthwise margin are positioned longitudinally between the first end margin and second end margin along the length of the adjustable connector strap 1001; at least one securing mechanism 1004 configured to releasably capture the third edge 1020, the fourth edge 1021, the first edge 1032, the second edge 1033, the fifth edge 1022 and the sixth edge 1023, to at least partially close the second pocket opening 1034, the first pocket opening 1018, and the third pocket opening 1036 to the interior space 1013 of the releasably closable pocket (pouch) 1010; and wherein the adjustable connector strap 1001 is affixed lengthwise to the medial interior surface 1014 of the releasably closeable pocket (pouch), such that the first end 1002 and the second end 1003 of the adjustable connector strap 1001 protrude past the first exterior end margin 1016 and the second exterior end margin 1017 of the pocket 1010.

In some embodiments, the medial layer (interior and exterior surfaces) and lateral layer (interior and exterior surfaces) of the pocket 1010 are formed from a single piece of folded material. In some embodiments, the medial layer and lateral layer are formed from two or more pieces of material and joined along at least one the margins, typically the bottom (inferior) margin of the pocket 1010.

In some embodiments of the portable exercise apparatus, the releasably closable pocket 1010 is at least partially closable along the first exterior lengthwise margin 1030.

In some embodiments of the portable exercise apparatus, the releasably closable pocket 1010 is at least partially closable at the first end margin 1016.

In some embodiments of the portable exercise apparatus, the releasably closable pocket 1010 is at least partially closable at the second end margin 1017.

In some embodiments of the portable exercise apparatus, the releasably closable pocket 1010 is at least partially closable along the first exterior lengthwise margin 1030 and either one of, or both of, the first end margin 1016 or the second end margin 1017.

One of skill in the art would recognize that more than one type of securing mechanism could be utilized to secure any one of or all of the pocket openings. For example, a zipper could be utilized to close one pocket opening; whereas a button or compression snap or magnet(s) could be utilized, (as non-limiting examples), to close other pocket openings. In some embodiments of the portable exercise apparatus, any one of or all of the pocket openings comprise multiple securing mechanisms.

In some embodiments, the portable exercise apparatus 1000 further comprises a first auxiliary storage pocket 1040 having a first end 1041, a second end 1042 and a first cavity 1043 therebetween, affixed to the apparatus on or about the second exterior lengthwise margin 1031, at or near the first exterior end margin 1016.

In some embodiments, the portable exercise apparatus 1000 further comprises a second auxiliary storage pocket 1044 having a third end 1045, a fourth end 1046 and a second cavity 1047 therebetween, affixed to the apparatus on or about the second exterior lengthwise margin 1031, at or near the second exterior end margin 1017. In some embodiments, the first auxiliary storage pocket 1040 and second auxiliary storage pocket 1044 are spaced apart lengthwise from each other and affixed on or about the second exterior lengthwise margin 1031.

Figure 12:
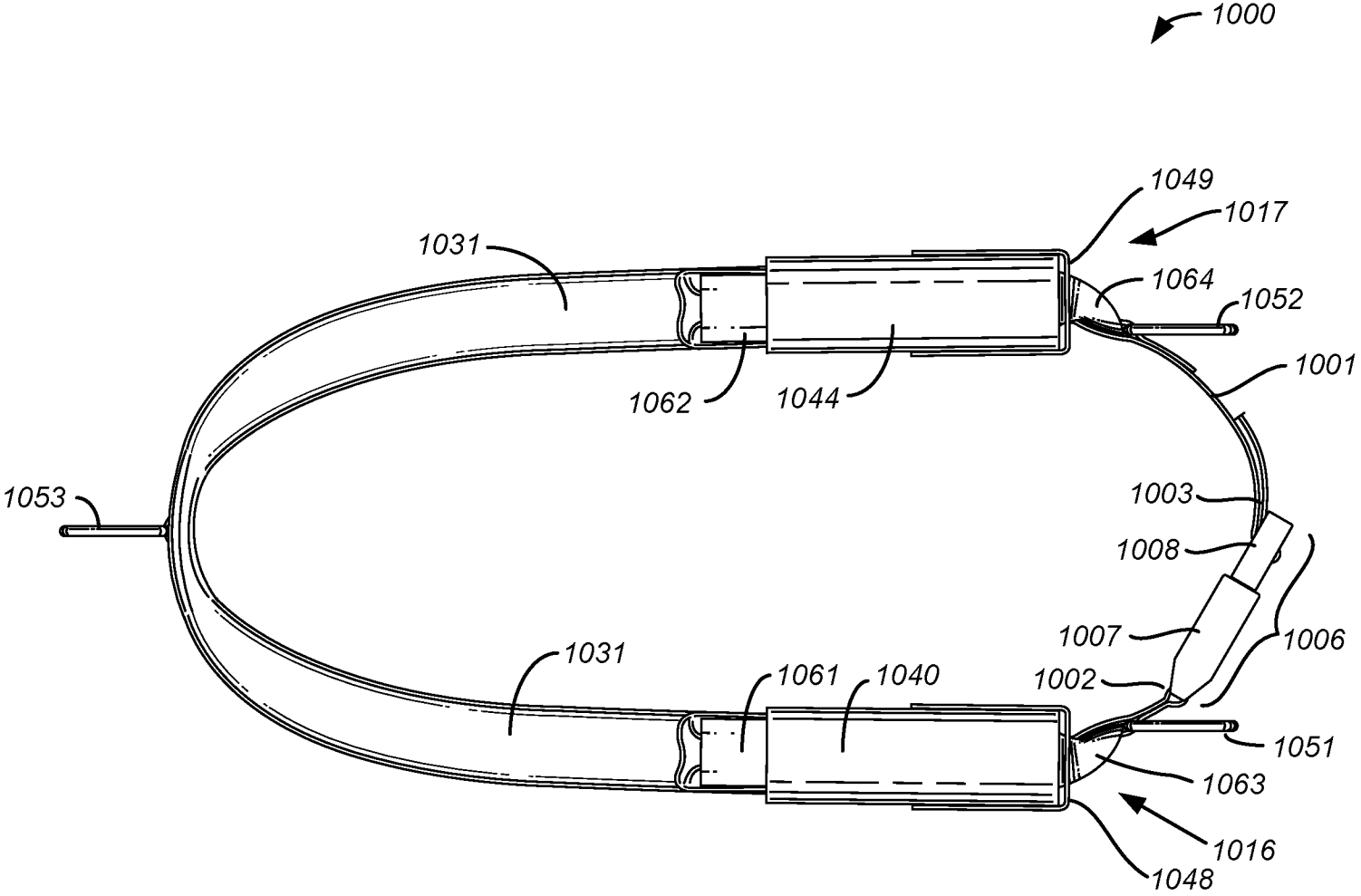
FIG. 12 is a bottom plan view of the exemplary portable exercise apparatus of FIG. 10 with a single releasably closable continuous pocket.

In some embodiments, as illustrated in FIGS. 10, 11 and 12, the portable exercise apparatus further comprises a first fixation ring 1051; and a second fixation ring 1052; wherein the first fixation ring 1051 is permanently affixed to the adjustable connector strap 1001 between the first coupling component 1007 at or near the first end 1002 of the adjustable connector strap 1001 and the first exterior end margin 1016 of the pocket 1010 and wherein the second fixation ring 1052 is permanently affixed to the adjustable connector strap 1001 between the second coupling component 1008 at or near the second end 1002 of the adjustable connector strap 1001 and the second exterior end margin 1017 of the pocket 1010.

In some embodiments, the portable exercise apparatus 1000 further comprises a first fixation ring 1051; and a second fixation ring 1052; wherein the first fixation ring is a releasably affixable carabiner 1072 affixable to the adjustable connector strap 1001 between the first coupling component 1007 at the first end 1002 of the adjustable connector strap and the first exterior end margin 1016 of the pocket 1010, and wherein the second fixation ring 1052 is a releasably affixable carabiner 1072 affixable to the adjustable connector strap 1001 between the second coupling component 1008 at the second end 1003 of the adjustable connector strap 1001 and the second exterior end margin 1017 of the pocket 1010. In some embodiments, the adjustable connector strap 1001 is configurable with a special (e.g.: fabric or metal) loop, button-like hole or opening on the adjustable connector strap to provide an attachment point for the releasably affixable carabiner 1072.

Alternatively, as described earlier in FIG. 6B or 6C, an additional fixation ring is configurable inside any of the pockets, typically near an end margin with an opening, to provide an attachment point for the releasably affixable carabiner 1072.

Figure 13:
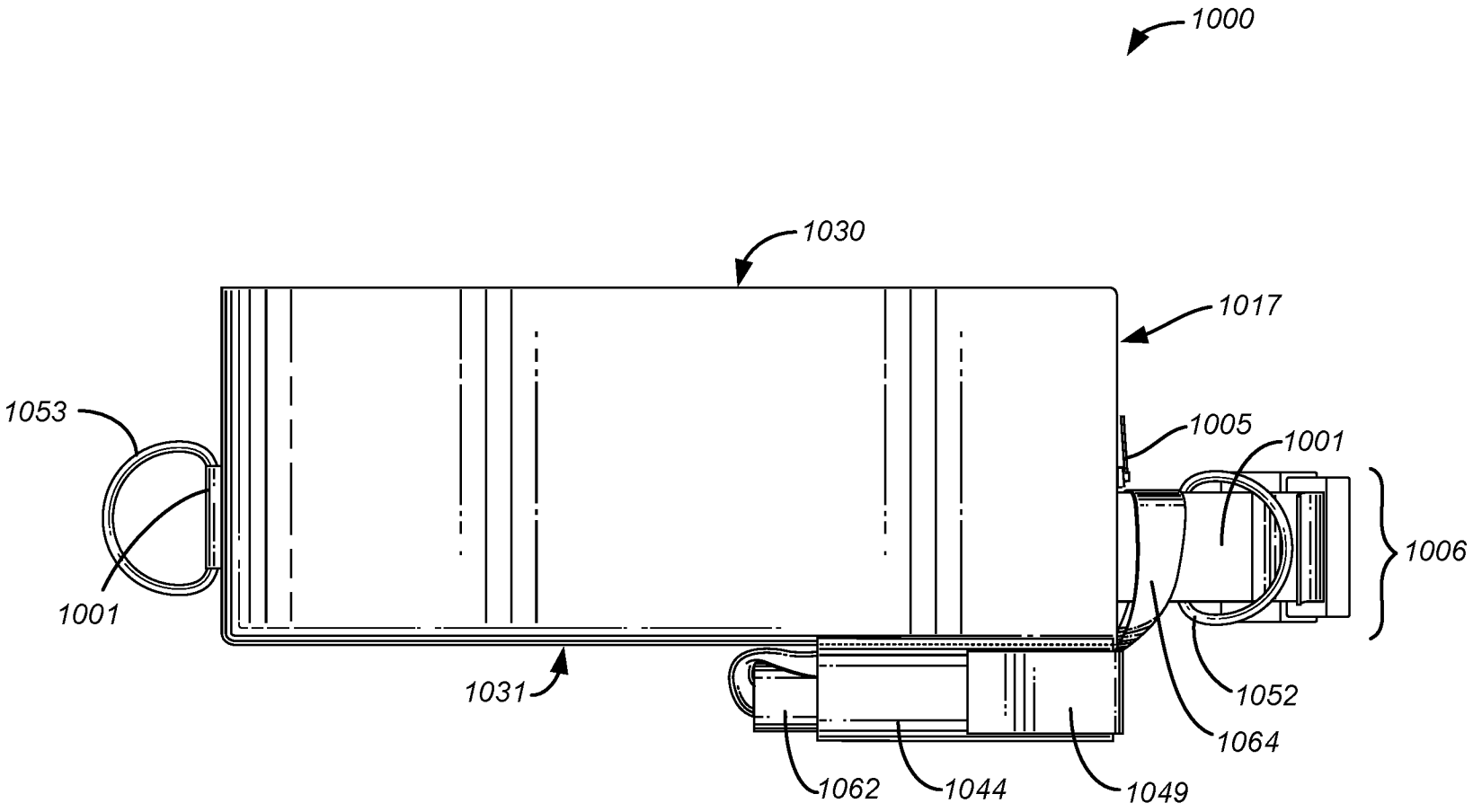
FIG. 13 is a right side elevation view of the exemplary portable exercise apparatus of FIG. 10 with a single releasably closable continuous pocket.
Figure 14:
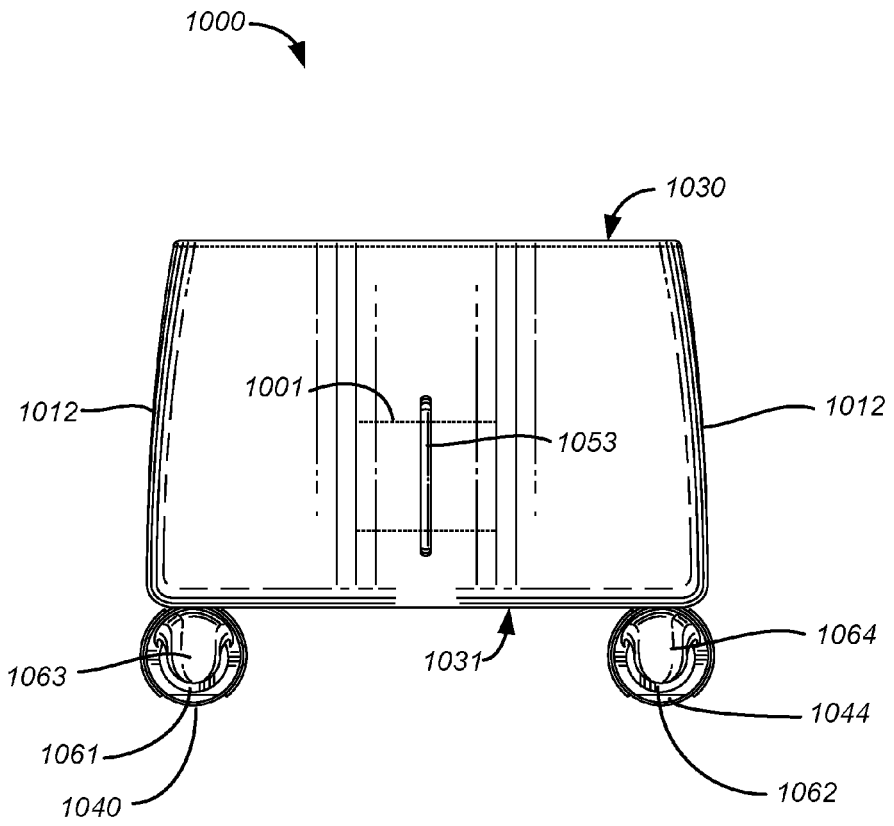
FIG. 14 is a rear elevation view of the exemplary portable exercise apparatus of FIG. 10 with a single releasably closable continuous pocket.

In some embodiments, as illustrated in FIGS. 12, 13 and 14, the portable exercise apparatus 1000 further comprises a third fixation ring 1053; wherein the third fixation ring 1053 is permanently affixed to the portable exercise apparatus at or about the approximate lengthwise center of the releasably closeable pocket 1010, approximately equidistant between the first fixation ring 1051 and the second fixation ring 1052.

In some embodiments, the third fixation ring 1053, is a releasably affixable carabiner 1072 affixable to the adjustable connector strap 1001 at or about the approximate lengthwise center of the releasably closeable pocket. In some embodiments, the adjustable connector strap is configurable with a special (e.g.: fabric or metal) loop, button-like hole or opening on the adjustable connector strap that protrudes through, around or outside the pocket to provide an attachment point for the releasably affixable carabiner 1072. Alternatively, as described earlier in FIG. 6D, an additional fixation ring is configurable such that it protrudes through an opening at or about the approximate lengthwise center of the releasably closeable pocket to provide an attachment point for the releasably affixable carabiner 1072.

In any one of the embodiments, a fixation ring 1051, 1052, 1053 or a releasably affixable carabiner 1072 can have virtually any shape (e.g.: round, square, rectangular, oval, pear-shaped, D-ring, offset D-ring, Pearl/HMS, etc.).

In some embodiments, the portable exercise apparatus comprises a first handgrip 1061 with a first flexible connector strap 1063.

In some embodiments, the portable exercise apparatus further comprises a second handgrip 1062 with a second flexible connector strap 1064.

In some embodiments of the portable exercise apparatus, the first handgrip 1061 is permanently affixed to the adjustable connector strap 1001 with the first flexible connector strap 1063 between the first coupling component 1007 at or near the first end 1002 of the adjustable connector strap 1001 and the first exterior end margin 1016 of the pocket 1010.

In some embodiments of the portable exercise apparatus, the second handgrip 1062 is permanently affixed to the adjustable connector strap 1001 with the second flexible connector strap 1064 between the second coupling component 1008 at or near the second end 1003 of the adjustable connector strap 1001 and the second exterior end margin 1017 of the pocket 1010.

In still other embodiments of the portable exercise apparatus 1000, the first handgrip 1061 with the first flexible connector strap 1063 is releasably affixable with a carabiner to the first fixation ring 1051 that is affixed to the adjustable connector strap 1001 between the first coupling component 1007 at or near the first end 1002 of the adjustable connector strap and the first exterior end margin 1016 of the pocket 1010.

In still other embodiments of the portable exercise apparatus, the second handgrip 1062 with the second flexible connector strap 1064 is releasably affixable with a carabiner to the second fixation ring 1052 that is affixed to the adjustable connector strap 1001 between the second coupling component 1008 at or near the second end 1003 of the adjustable connector strap and the second exterior end margin 1017 of the pocket 1010.

Figure 18:
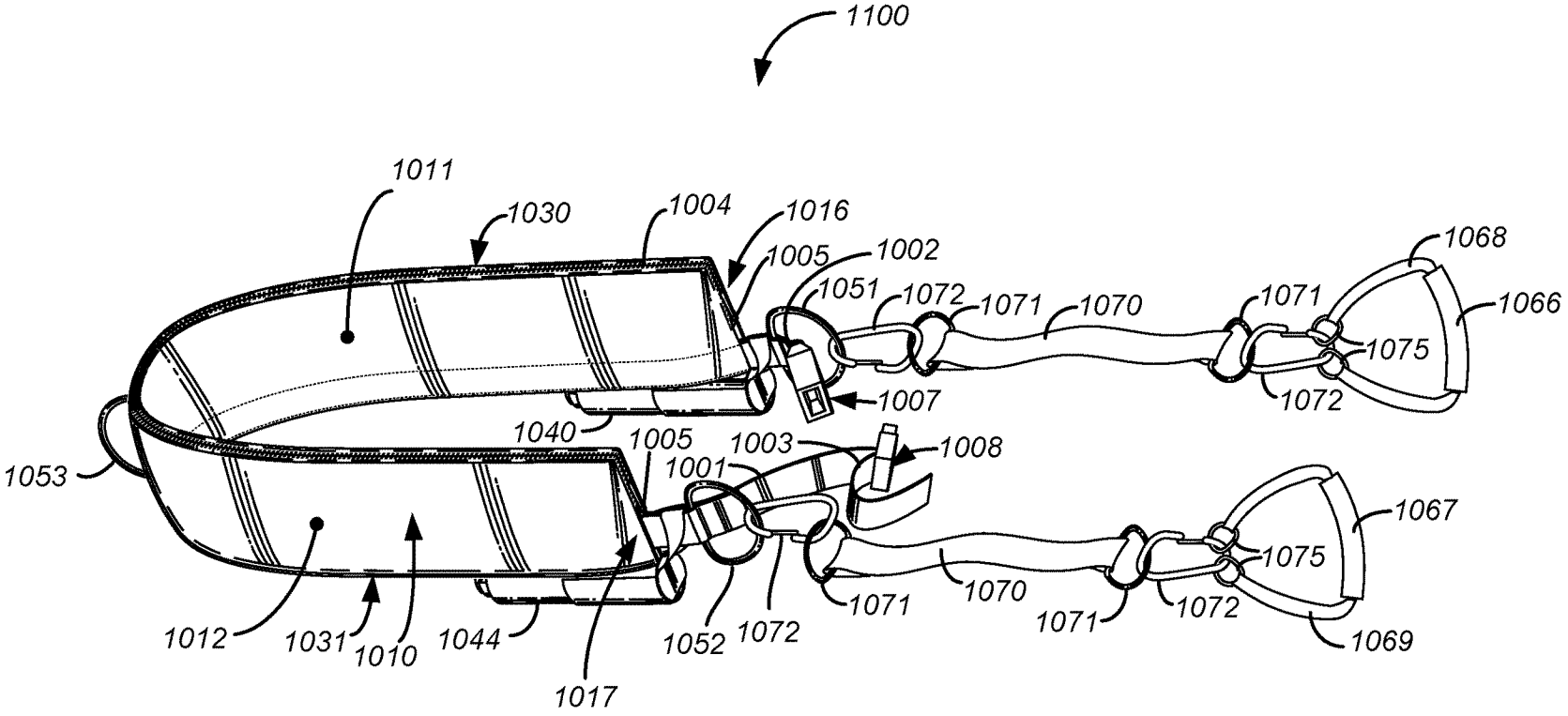
FIG. 18 is another perspective view of the exemplary portable exercise apparatus of FIG. 10 with a single releasably closable continuous pocket with the permanently attached handles in their auxiliary storage pockets, the attachment strap coupling mechanism uncoupled and D-rings configured to receive a variety of attachments, such as auxiliary handles and elastic bands.
Figure 19:
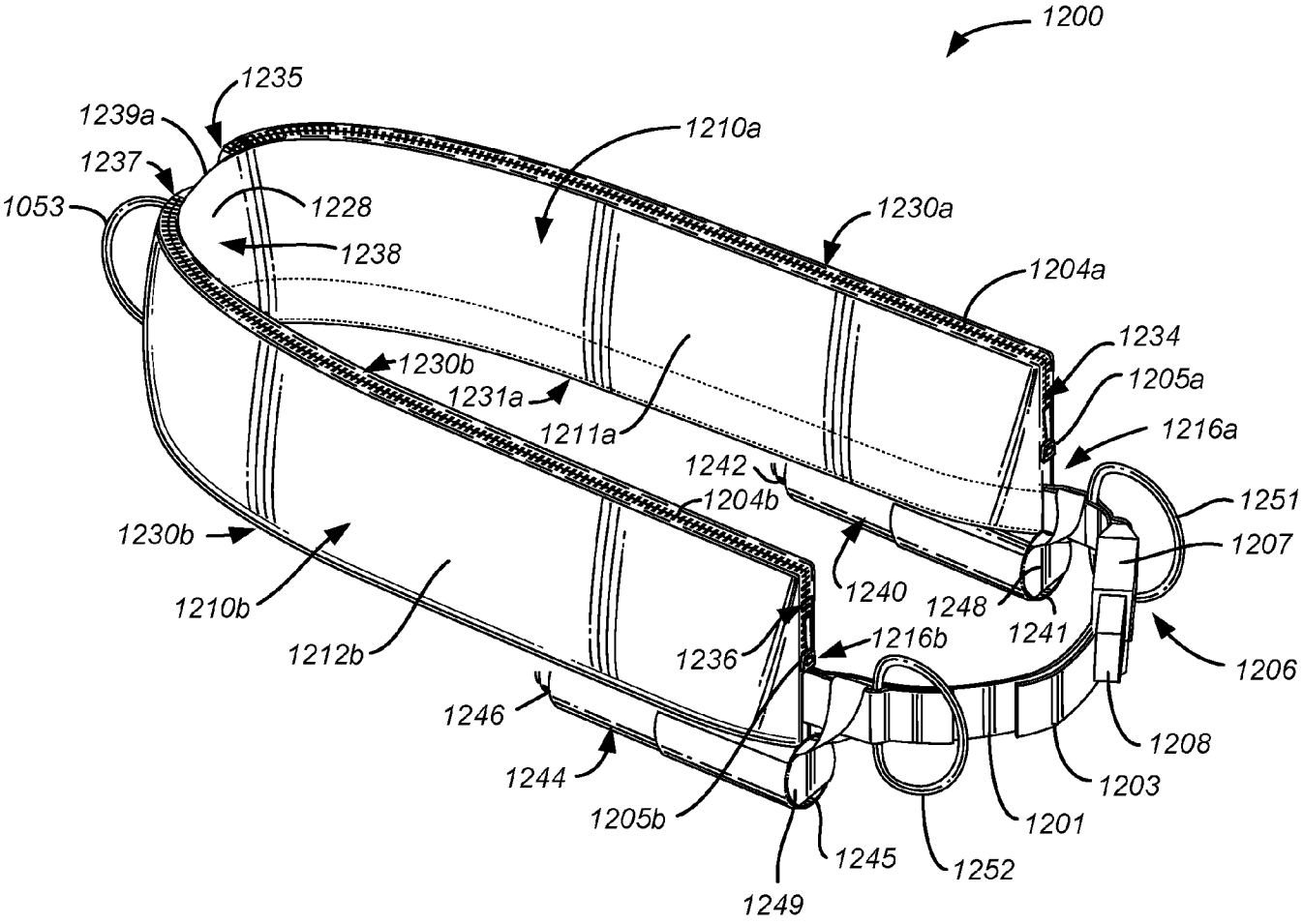
FIG. 19 is a perspective view of still another exemplary portable exercise apparatus with two releasably closable pockets affixed to an adjustable connector strap with a coupling mechanism assembly and an auxiliary storage pocket configured along the inferior edge of each releasably closable continuous pocket.
Figure 20:
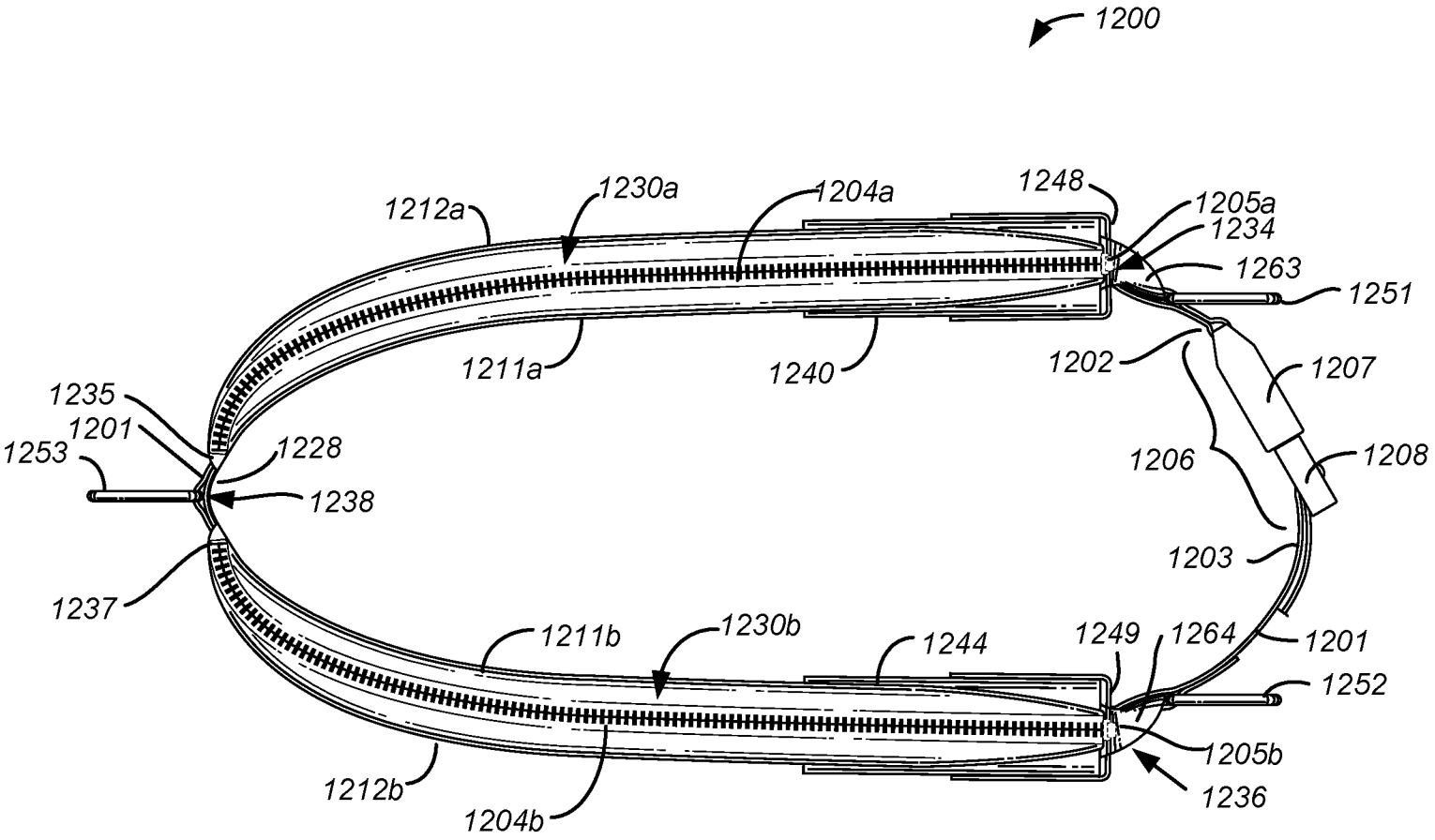
FIG. 20 is a top plan view of the exemplary portable exercise apparatus of FIG. 19 with two releasably closable pockets.
Figure 21:
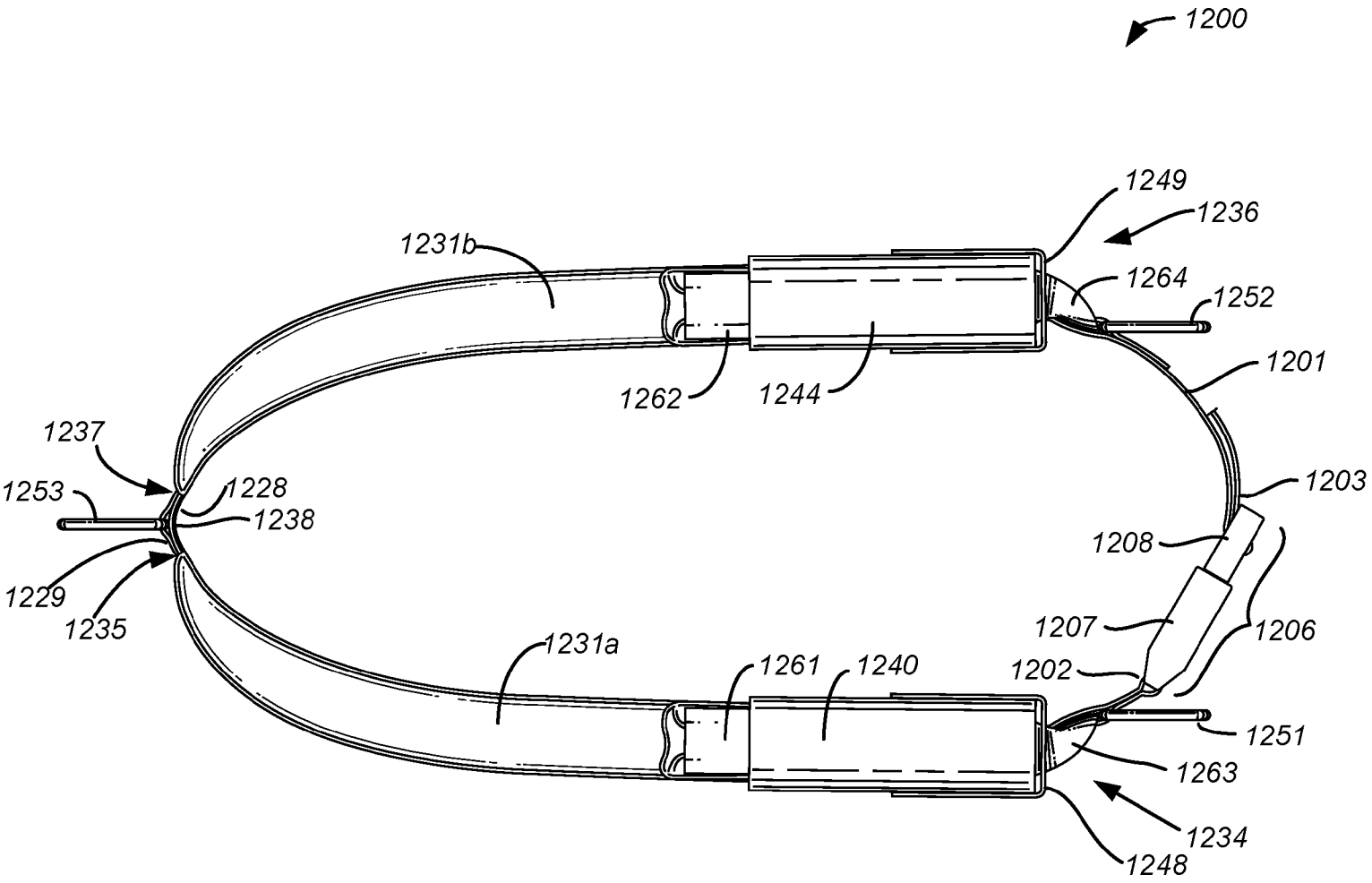
FIG. 21 is a bottom plan view of the exemplary portable exercise apparatus of FIG. 19 with two releasably closable pockets.
Figure 22:
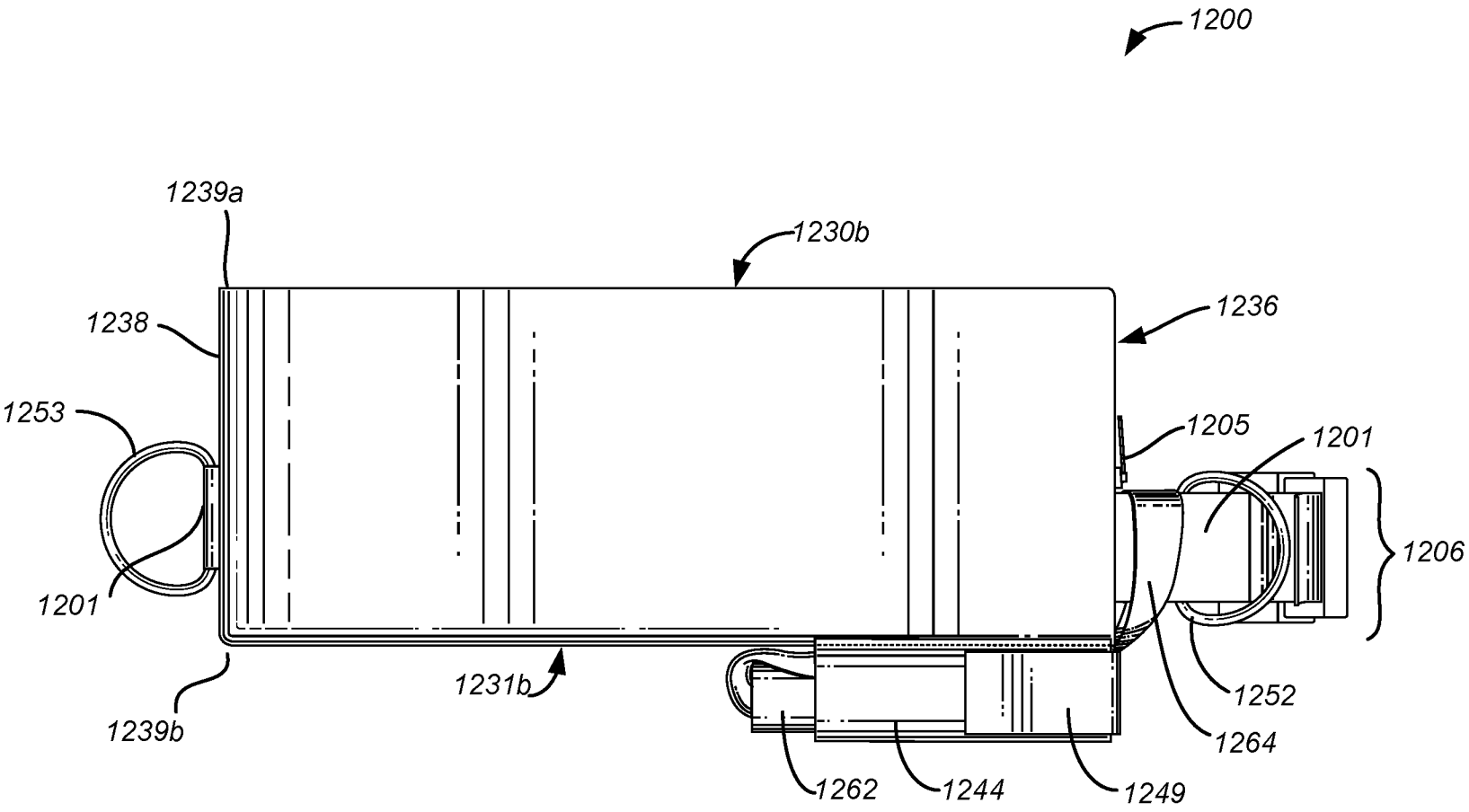
FIG. 22 is a right side elevation view of the exemplary portable exercise apparatus of FIG. 19 with two releasably closable pockets.

In some embodiments, the portable exercise apparatus 1000 comprises an assembly 1100 having a plurality of accessories as illustrated in FIGS. 17 and 18.

In some embodiments, the portable exercise apparatus is an assembly 1100 comprising a third handgrip 1066 with a third flexible connector strap 1068.

In some embodiments, the portable exercise apparatus is an assembly 1100 further comprising a fourth handgrip 1067 with a second flexible connector strap 1069.

In some embodiments, any one or more of the first handgrip 1061, the second handgrip 1062, the third handgrip 1066, and the fourth handgrip 1067 are configurable with flexible handgrips. In some embodiments, any one or more of the first handgrip 1061, the second handgrip 1062, the third handgrip 1066, and the fourth handgrip 1067 are configurable with inflexible handgrips.

In some embodiments, any of the flexible connector straps for the handgrips are configurable with one or more connector strap fixation rings 1075 for attachment to other components of the apparatus, typically using a carabiner 1072. In some embodiments, each of the ends of the flexible connector straps for the handgrips are configurable with a fixation ring. In some embodiments, both ends of the flexible connector strap are sewn together creating a closed loop around the handle grip and further affixed with a single fixation ring 1075. In some embodiments, the fixation rings themselves are carabiners 1072.

In any one of the embodiments, the third handgrip 1066 with the third flexible connector strap 1068 and the fourth handgrip 1067 with the second flexible connector strap 1069 are releasably affixable to any of the fixation rings 1051, 1052, 1053 or to a releasably affixable carabiner 1072, for fixation to another accessory of the apparatus.

In any one of the embodiments, the third handgrip 1066 with the third flexible connector strap 1068 and the fourth handgrip 1067 with the second flexible connector strap 1069 are releasably affixable to tension bands 1070 or suspension lines 1080.

In some embodiments of the portable exercise apparatus, the first handgrip 1061 and the second handgrip 1062 with flexible connector straps 1063 and 1064 are configured for storage within the first auxiliary storage pocket 1040 and the second auxiliary storage pocket 1044.

In some embodiments of the portable exercise apparatus, the third handgrip 1066 and the fourth handgrip 1067 with flexible connector straps 1068 and 1069 are configured for storage within the pocket 1010. In some embodiments of the portable exercise apparatus, the third handgrip 1066 and the fourth handgrip 1067 with flexible connector straps 1068 and 1069 are configured for storage within the first auxiliary storage pocket 1040 and the second auxiliary storage pocket 1044.

In some embodiments, the first auxiliary storage pocket 1040 further comprises a first cavity closure mechanism 1048 to restrain, capture and temporarily store a handle grip (1061, 1066), with a flexible connector strap (1063, 1068).

In some embodiments, the second auxiliary storage pocket 1044 further comprises a second cavity closure mechanism 1049 to restrain, capture and temporarily store a handle grip (1062, 1067), with a flexible connector strap (1064, 1069).

Further still, the third handgrip 1066 with the third flexible connector strap 1068 and the fourth handgrip 1067 with the second flexible connector strap 1069 are releasably affixable to other auxiliary apparatus such as a tension band 1070 or a suspension line 1080 using a releasably affixed carabiner 1072.

In some embodiments, the tension band 1070 comprises a permanently affixed auxiliary fixation ring 1071 at each end. In some embodiments, the tension band comprises a releasably affixed carabiner 1072 at each end. In some embodiments, the tension band comprises a permanently affixed carabiner 1072 at each end.

In some embodiments, the suspension line 1080 comprises a permanently affixed auxiliary fixation ring 1071 at each end. In some embodiments, the suspension line comprises a releasably affixed carabiner 1072 at each end. In some embodiments, the tension bands comprises a permanently affixed carabiner 1072 at each end.

In some embodiments, the suspension line 1080 further comprises an adjustment device, friction hitch, or knot used to attach a loop of cord around a rope or to create a length adjustment. In some embodiments, the adjustment device is a ring 1071 or a carabiner 1072. In some embodiments, the adjustment device, friction hitch, or knot is a Prusik knot 1085.

In any one of the embodiments, the third handgrip 1066 with the third flexible connector strap 1068 and the fourth handgrip 1067 with the second flexible connector strap 1069, the tension band(s) 1070 and/or the suspension line(s) 1080, are releasably affixable to any one or more of the fixation rings 1051, 1052, 1053, to create a multi-functional exercise apparatus assembly 1100 configurable for a plurality of variable tension, compression or suspension exercises intended to improve a user's strength, endurance and/or flexibility.

In any one of the embodiments, the portable exercise apparatus assembly 1100 comprising the adjustable connector strap 1001, the pocket 1010, any one or more of the handgrips 1061, 1062, 1066, 1067 with flexible straps 1063, 1064, 1068, 1069, can be suspended from a plurality of structures such as a tree limb, a rafter or swing set cross-bar, to create a suspended exercise apparatus incorporating tension band(s) 1070 and/or the suspension line(s) 1080.

Alternatively, the portable exercise apparatus assembly 1100 described above can be wrapped around a vertical structure, such as a pole or tree trunk to create a stationary tension-training device incorporating tension band(s) 1070 and/or the suspension line(s) 1080.

Further still, the third handgrip 1066 with the third flexible connector strap 1068 and the fourth handgrip 1067 with the second flexible connector strap 1069, are configurable with a door handle attachment feature that allows for secure fixation of the portable exercise apparatus 1000 using auxiliary fixation rings and carabiners to configure the apparatus for indoor use when weather or travel conditions preclude outdoor exercise. In some embodiments, a doorframe attachment feature comprises a bundled material knot in the flexible connector strap configurable for insertion between a closed door and the doorframe. In some embodiments, the doorframe attachment feature comprises a buckle or fixation ring feature 1075 in the flexible connector strap configurable for insertion between a closed door and the doorframe.

In some embodiments of the portable exercise apparatus 1000, the at least one securing mechanism 1004 for the pocket (pouch) 1010 comprises: a zipper; a Velcro™ connection; a compression snap; a magnet; a buckle; a button; a clasp; a lace; a flexible material strap; a hook or a combination thereof.

Figure 16:
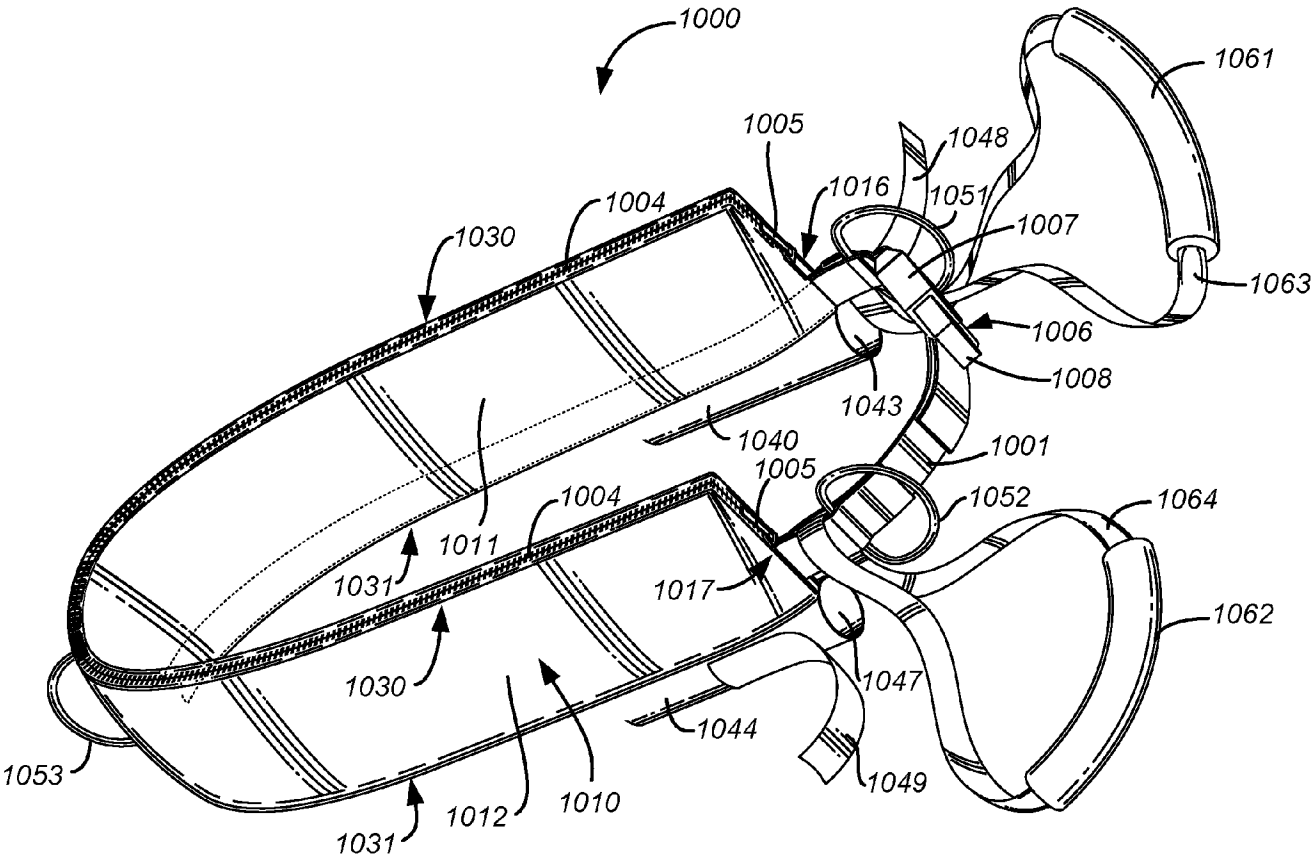
FIG. 16 is a perspective of the exemplary portable exercise apparatus of FIG. 10 with a single releasably closable continuous pocket and with the permanently attached handles withdrawn from their auxiliary storage pockets and fully extended.

In some embodiments of the portable exercise apparatus 1000, the at least one securing mechanism 1004 for the pocket (pouch) 1010 comprises a zipper 1004 with a zipper pull tag 1005 or a securing mechanism assist component, as illustrated in FIG. 16.

In some embodiments of the portable exercise apparatus 1000, the auxiliary storage pockets (1040, 1044) further comprises a cavity closure mechanism 1048, 1049 comprising a flexible material strap with a Velcro™ connection, (also illustrated in FIG. 16); a zipper; a compression snap; a magnet; a clasp; a hook or a combination thereof.

As further illustrated in FIG. 17, in some embodiments of the portable exercise apparatus assembly 1100, the portable exercise apparatus 1000 further comprises detachable flexible or solid handles 1066, 1067 with flexible straps 1068, 1069, a door handle attachment feature, or doorframe attachment feature; tension bands 1070, suspension lines 1080 with Prusik knot 1085; a suspension harness (not shown); a running parachute (not shown); a parachute cord (not shown); a coupling mechanism (e.g.: carabiner 1072); a flexible water canteen (not shown); a drinking tube (not shown); a flow valve (not shown); at least one glove (not shown); first aid materials; or one or more of a plurality of safety features (e.g.: reflectors; flashing light; etc.).

In some embodiments of the portable exercise apparatus assembly 1100, doorframe attachment feature is configurable for securing itself between a door and a door frame such that when the door is closed within the frame, an attachment ring 1075 or similar feature protrudes from the door attachment feature to provide an attachment point for a releasable connecting attachment feature or specialized type of shackle, such as a carabiner, so that the portable exercise apparatus can be releasably attached thereto. Therein, the portable exercise apparatus assembly is configurable for indoor use.

In any one of the embodiments, the portable exercise apparatus assembly comprises a solid handgrip with a flexible connector strap that is convertible to a doorframe attachment device configured with connector strap fixation rings for attachment to the portable exercise apparatus, or any of a plurality of exercise apparatus accessories.

Figure 24:
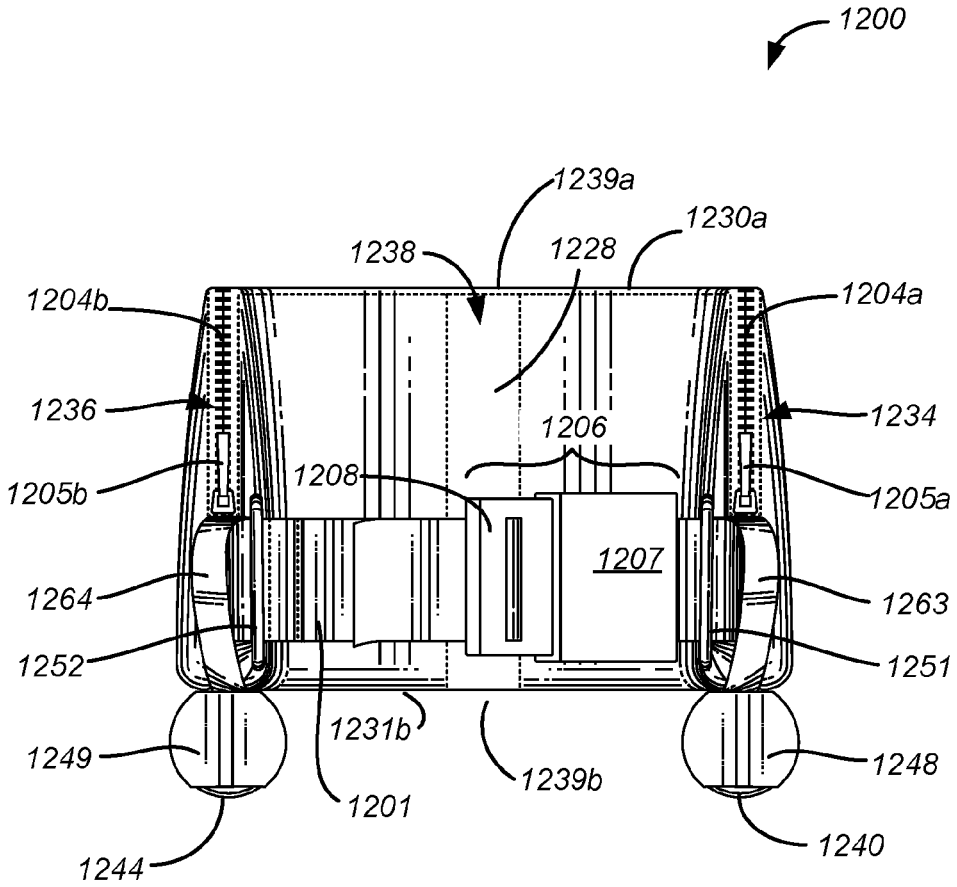
FIG. 24 is a front elevation view of the exemplary portable exercise apparatus of FIG. 19 with two releasably closable pockets.

Referring now to FIGS. 19, 20, 21 and 26, provided herein is a portable exercise apparatus 1200 comprising: an adjustable connector strap 1201 comprising a first end 1202 and a second end 1203 spaced lengthwise from each other; a coupling mechanism assembly 1206, as further illustrated in FIG. 24, comprising; a first coupling component 1207 at the first end 1202 of the adjustable connector strap 1201 and a second coupling component 1208 at or near the second end 1203 of the adjustable connector strap for releasably securing the first end of the adjustable connector strap to a section of the adjustable connector strap at or near the second end of the adjustable connector strap; a first releasably closeable pocket (pouch) 1210*a* attached to and spaced along a first section of the adjustable connector strap 1201 comprising; at least a first medial exterior surface 1211*a* and a first lateral exterior surface 1212*a*, an first interior space 1213*a* within the first releasably closeable pocket 1210*a* comprising a first medial interior surface 1214*a* and a first lateral interior surface 1215*a*; a first exterior end margin 1234 and a first interior end margin 1235; wherein the first exterior end margin 1234 and the first interior end margin 1235 are spaced apart lengthwise from each other along the first section of the adjustable connector strap 1201, at opposite ends of the first releasably closeable pocket 1210*a*, a first exterior lengthwise margin 1230*a* adjoining the first exterior end margin 1234 and the first interior end margin 1235, the first exterior lengthwise margin comprising a first edge 1220 and a second edge 1221, forming a first opening 1218*a* to the interior space 1213*a*; and a second exterior lengthwise margin 1231*a* spaced apart from the first exterior lengthwise margin 1230*a*, forming a closed bottom to the first interior space 1213*a* of the first releasably closeable pocket 1210*a*; wherein the first exterior lengthwise margin 1230*a* and second exterior lengthwise margin 1231*a* are positioned longitudinally along the adjustable connector strap 1201 between the first exterior end margin 1234 and first interior end margin 1235; at least a first pocket securing mechanism 1204*a* configured to releasably capture the first edge 1220 and the second edge 1221 to at least partially close the first opening 1218*a* to the interior space 1213*a* of the first releasably closeable pocket 1210*a*; a second releasably closable pocket (pouch) 1210*b* attached to and spaced along a second section of the adjustable connector strap 1201 comprising: at least a second medial exterior surface 1211*b* and a second lateral exterior surface 1212*b*, a second interior space 1213*b* within the second releasably closeable pocket 1210*b* comprising at least a second medial interior surface 1214*b* and a second lateral interior surface 1215*b*, a second exterior end margin 1236 and a second interior end margin 1237; wherein the second exterior end margin 1236 and the second interior end margin 1237 are spaced apart lengthwise from each other at opposite ends of the second releasably closeable pocket (pouch) 1210*b* along the second section of the adjustable connector strap 1201, a third exterior lengthwise margin 1230*b* adjoining the second exterior end margin 1236 and the second interior end margin 1237, the third exterior lengthwise margin comprising a third edge 1224 and a fourth edge 1225, forming a first opening 1218*b* to the second interior space 1213*b* within the second releasably closeable pocket 1210*b*; and a fourth exterior lengthwise margin 1231*b* spaced apart from the third exterior lengthwise margin 1230*b*, forming a closed bottom to the second interior space 1213*b* of the second releasably closeable pocket 1210*b*; wherein the third exterior lengthwise margin 1230*b* and fourth exterior lengthwise margin 1231*b* are positioned longitudinally along a second section of the adjustable connector strap 1201 between the second exterior end margin 1236 and second interior end margin 1237; at least a second pocket securing mechanism 1204*b* configured to releasably capture the third edge 1224 and the fourth edge 1225 to at least partially close the first opening 1218*b* to the second interior space 1213*b* of the second releasably closeable pocket 1210*b*; a connecting section 1238 comprising at least a medial surface 1228 and a lateral surface 1229, a superior margin 1239*a* and an inferior margin 1239*b* spaced apart from each other and positioned between the first interior end margin 1235 of the first releasably closeable pocket 1210*a* and the second interior end margin 1237 of the second releasably closeable pocket 1210*b*; wherein the adjustable connector strap 1201 is affixed lengthwise to the first medial interior surface 1214*a* of the first releasably closeable pocket (pouch) 1210*a*, the lateral surface 1229 or the medial surface 1228 of the connecting section 1238 and the second medial interior surface 1215*b* of the second releasably closeable pocket (pouch) 1210*b*, or wherein the adjustable connector strap 1201 is affixed lengthwise to the first medial exterior surface 1211*a* of the first releasably closeable pocket (pouch) 1210*a*, the lateral surface 1229 or the medial surface 1228 of the connecting section 1238 and the second medial exterior surface 1211*b* of the second releasably closeable pocket (pouch) 1210*b*, or, a combination thereof, such that the first end 1202 and the second end 1203 of the adjustable connector strap 1201 protrude past the first exterior end margin 1234 of the first pocket 1210*a* and the second exterior end margin 1236 of the second pocket 1210*b*.

In some embodiments of the portable exercise apparatus 1200, the connecting section 1238 comprises: a separate intermediate piece of material, an extension at the end of the first pocket 1210*a*, beyond the first interior end margin 1235 of the first pocket joined to an extension at the end of the second pocket 1210*b* beyond the second interior end margin 1237 of the second pocket, the adjustable connector strap 1201, or a combination thereof.

In some embodiments of the portable exercise apparatus, the first exterior end margin 1234 further comprises a fifth edge 1222 and a sixth edge 1223, forming a second opening 1216*a* to the first interior space 1213*a* of the first releasably closeable pocket 1210*a*, and wherein the first interior end margin 1235 forms a closed end to the first interior space of the first releasably closeable pocket.

In some embodiments of the portable exercise apparatus, the first opening 1218*a* to the first interior space 1213*a* of the first releasably closeable pocket 1210*a* adjoins the second opening 1216*a* to the first interior space of the first releasably closeable pocket.

In some embodiments, the first opening 1218*a* and the second opening 1216*a* of the first releasably closeable pocket 1210*a* comprise one closure mechanism 1204*a* to secure both the first and the second opening. In some embodiments, the first opening 1218*a* and the second opening 1216*a* of the first releasably closeable pocket 1210*a* each individually comprise a separate securing mechanism 1204*a*, such that there are two closure mechanisms when there are two openings.

In some embodiments, the at least one securing mechanism 1204*a*, 1204*b* for the first pocket 1210*a* or second pocket 1210*b* comprises a zipper 1204*a*, 1204*b* with a zipper pull tag 1205*a*, 1205*b* or a comparable securing mechanism assist component.

Still further, in some embodiments, there can be multiple closure mechanisms 1204*a* to secure each of the first and second openings 1218*a*, 1216*a* of the first releasably closeable pocket 1210*a*. Similarly, in some embodiments, there can be multiple closure mechanisms 1204*b* to secure each of the first and second openings 1218*b*, 1216*b* of the second releasably closeable pocket 1210*b*.

In some embodiments of the portable exercise apparatus 1200, the second exterior end margin 1236 comprises a seventh edge 1226 and an eighth edge 1227, forming a second opening 1216*b* to the second interior space 1213*b* of the second releasably closeable pocket 1210*b*, and wherein the second interior end margin 1237 forms a closed end to the second interior space 1213*b* of the second releasably closeable pocket 1210*b*.

In some embodiments, the first opening 1218*b* and the second opening 1216*b* of the second releasably closeable pocket 1210*b* comprise one closure mechanism 1204*b* to secure both the first and the second opening.

In some embodiments, the first opening 1218*b* and the second opening 1216*b* of the second releasably closeable pocket 1210*b* each individually comprise a separate securing mechanism 1204*b*, such that there are two closure mechanisms when there are two openings.

In some embodiments, the at least one closure mechanism is a zipper, or zipper mechanism 1204. In some embodiments, the zipper comprises a zipper assist or pull tab 1205. In some embodiments, the closure mechanism comprises: a lace, a flap; a Velcro™ connection; compression snaps; magnets; buckles; buttons; clasps; a flexible material strap; or hooks.

In some embodiments of the portable exercise apparatus, the closure mechanism for the first pocket 1210*a* or the second pocket 1210*b* comprises: a zipper; a Velcro™ connection; a compression snap; a magnet; a buckle; a button; a clasp; a lace; a flexible material strap; a hook or a combination thereof.

Still further, in some embodiments, there can be multiple closure mechanisms to secure each of the first and second openings 1218*b*, 1216*b* of the second releasably closeable pocket 1210*b*.

In some embodiments, the portable exercise apparatus 1200 or assembly 1300 further comprises, a first auxiliary storage pocket 1240 having a first end 1241, a second end 1242 and a first cavity 1243 therebetween, affixed to the apparatus on or about the second exterior lengthwise margin 1231*a*, at or near the first exterior end margin 1234.

Figure 27:
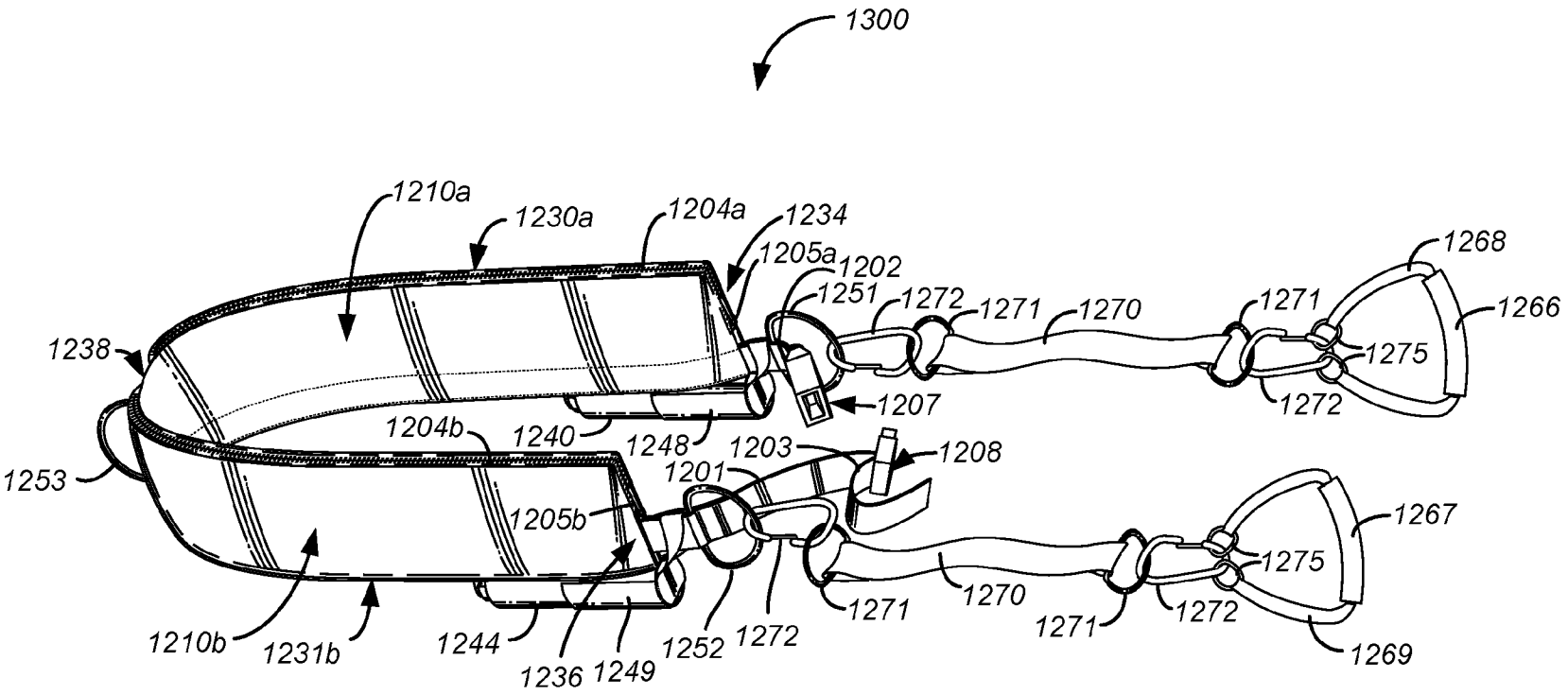
FIG. 27 is another perspective view of the exemplary portable exercise apparatus of FIG. 19 with two releasably closable pockets, with the permanently attached handles in their auxiliary storage pockets, the attachment strap coupling mechanism uncoupled and D-rings configured to receive a variety of attachments, such as auxiliary handles and elastic bands.

In some embodiments, the portable exercise apparatus 1200 comprises an assembly 1300 having a plurality of accessories as illustrated in FIG. 27.

In some embodiments, the portable exercise apparatus 1200 or assembly 1300 further comprises, a second auxiliary storage pocket 1244 having a third end 1245, a fourth end 1246 and a second cavity 1247 therebetween, affixed on or about the fourth exterior lengthwise margin 1231*b*, at or near the second exterior end margin 1236.

In some embodiments of the first auxiliary storage pocket 1240 and the second auxiliary storage pocket 1244 are spaced apart lengthwise from each other on or about the second exterior lengthwise margin 1231*a* and the fourth exterior lengthwise margin 1231*b*.

In some embodiments of the portable exercise apparatus 1200 or assembly 1300, the first and/or the second auxiliary storage pocket 1240, 1244 further comprises a cavity closure mechanism comprising: a zipper; a Velcro™ connection; a compression snap; a magnet; a clasp; a flexible material strap; a hook or a combination thereof.

In some embodiments, as illustrated in FIGS. 19-22, the portable exercise apparatus 1200 or assembly 1300 comprises a first fixation ring 1251 and a second fixation ring 1252, wherein the first fixation ring 1251 is permanently affixed to the adjustable connector strap 1201 between the first coupling component 1207 at or near the first end 1202 of the adjustable connector strap 1201 and the first exterior end margin 1234 of the first pocket 1210*a*, and wherein the second fixation ring 1252 is permanently affixed to the adjustable connector strap 1201 between the second coupling component 1208 at or near the second end 1203 of the adjustable connector strap 1201 and the second exterior end margin 1236 of the second pocket 1210*b*. In some embodiments, the portable exercise apparatus 1200 or assembly 1300 further comprises a first fixation ring 1251 and a second fixation ring 1252; wherein the first fixation ring 1251 is a releasably affixable carabiner 1272 affixable to the adjustable connector strap 1201 between the first coupling component 1207 at or near the first end 1202 of the adjustable connector strap and the first exterior end margin 1234 of the first pocket 1210*a*, and wherein the second fixation ring 1252 is a releasably affixable carabiner affixable to the adjustable connector strap 1201 between the second coupling component 1208 at the second end 1203 of the adjustable connector strap and the second exterior end margin 1236 of the second pocket 1210*b*.

Figure 23:
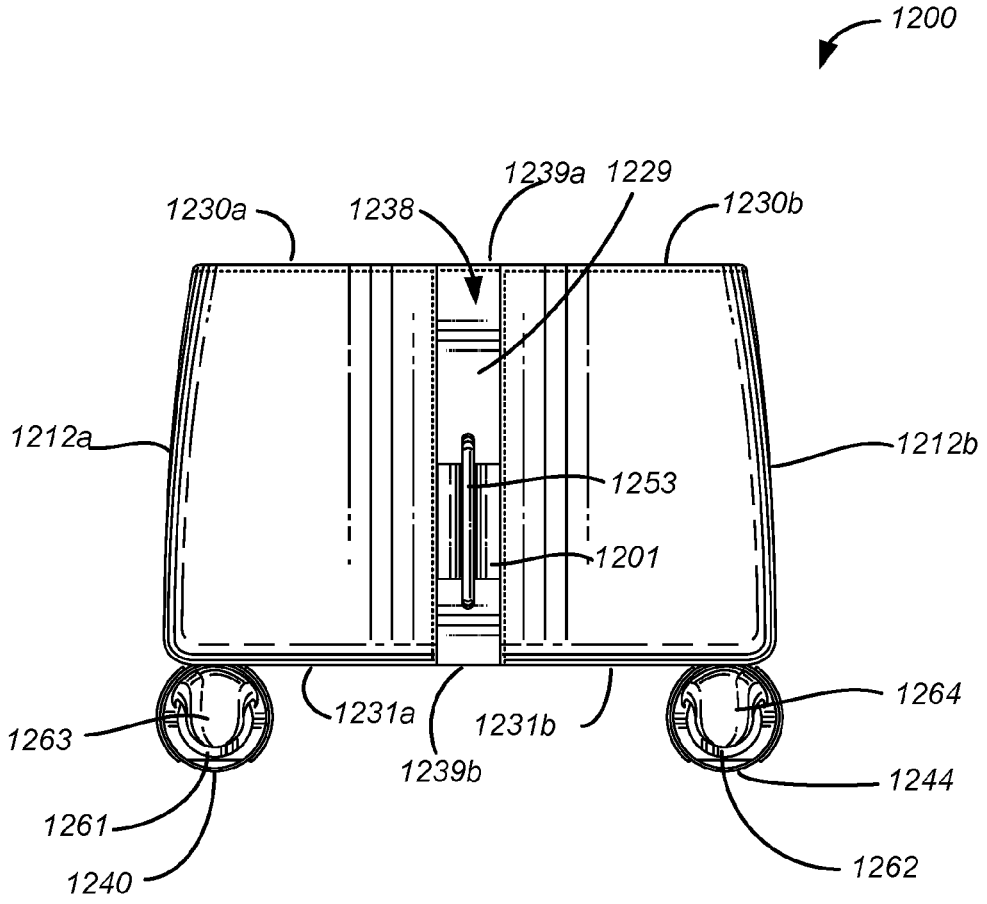
FIG. 23 is a rear elevation view of the exemplary portable exercise apparatus of FIG. 19 with two releasably closable pockets.
Figure 25:
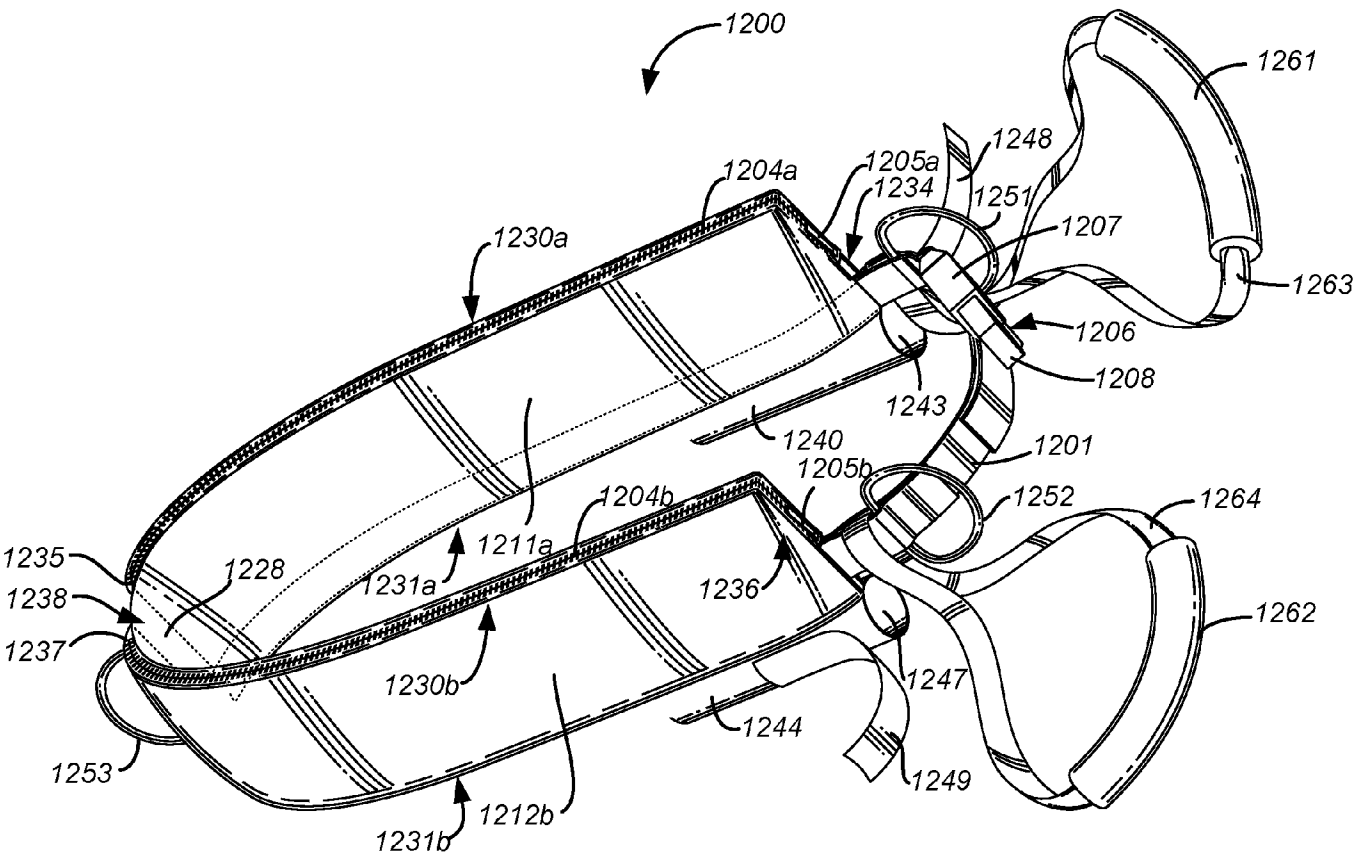
FIG. 25 is a perspective of the exemplary portable exercise apparatus of FIG. 19 with two releasably closable pockets and with the permanently attached handles withdrawn from their auxiliary storage pockets and fully extended.
Figure 26:
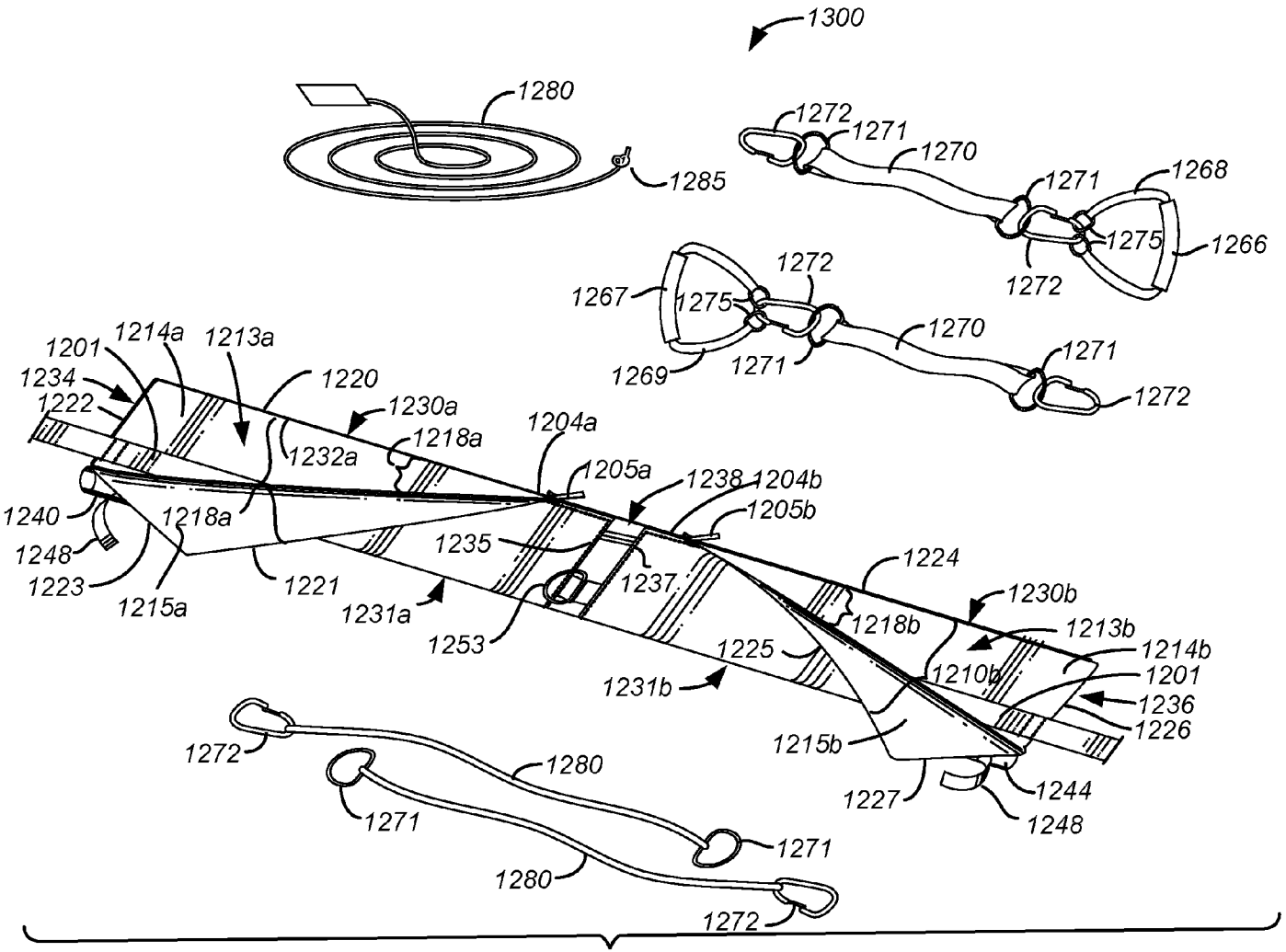
FIG. 26 is another perspective view of the exemplary portable exercise apparatus of FIG. 19, in a fully extended state, illustrating the two open, releasably closable pockets for holding accessories, each with a securing mechanism shown in an open pocket state and the attachment strap affixed therein and a plurality of accessories comprising tension bands, suspension lines, attachment couplings and additional releasable handles.

In some embodiments, as illustrated in FIGS. 23 and 25, the portable exercise apparatus 1200 or assembly 1300 further comprises, a third fixation ring 1253, wherein the third fixation ring is permanently affixed to the portable exercise apparatus between the first pocket 1210*a* and the second pocket 1210*b*, at the connecting section 1238, at or about the approximate lengthwise center of the working length of the adjustable connector strap 1201, and approximately equidistant between the first fixation ring 1251 and the second fixation ring 1252. In some embodiments, the portable exercise apparatus 1200 or assembly 1300 further comprises, a third fixation ring 1253, wherein the third fixation ring is a releasably affixable carabiner 1272 affixable to the portable exercise apparatus at the connecting section between the first pocket 1210*a* and the second pocket 1210*b*, at the connecting section 1238 and approximately equidistant between the first fixation ring 1251 and the second fixation ring 1252.

In some embodiments of the portable exercise apparatus 1200 or assembly 1300, the connecting section 1238 comprises: a separate intermediate piece of material, an extension at the end of the first pocket 1210*a*, beyond the first interior end margin 1235 of the first pocket joined to an extension at the end of the second pocket 1210*b*, beyond the second interior end margin 1237 of the second pocket, the adjustable connector strap 1201, or a combination thereof.

In some embodiments, the portable exercise apparatus 1200 or assembly 1300 comprises a first handgrip 1261 with a first flexible strap 1263.

In some embodiments, the portable exercise apparatus 1200 or assembly 1300 further comprises a second handgrip 1262 with a second flexible strap 1264.

In some embodiments of the portable exercise apparatus 1200 or assembly 1300, the first handgrip 1261 with the first flexible connector strap 1263 is permanently affixed to the adjustable connector strap 1201 between the first coupling component 1207 at or near the first end 1202 of the adjustable connector strap 1201 and the first exterior end margin 1234 of the first pocket 1210*a*.

In some embodiments of the portable exercise apparatus 1200 or assembly 1300, the second handgrip 1262 with the second flexible connector strap 1264 is permanently affixed to the adjustable connector strap 1201 between the second coupling component 1208 at or near the second end 1203 of the adjustable connector strap 1201 and the second exterior end margin 1236 of the second pocket 1210*b*.

In still other embodiments of the portable exercise apparatus 1200 or assembly 1300, the first handgrip 1261 with the first flexible connector strap 1263 is releasably affixable to a first fixation ring 1251 that is affixed to the adjustable connector strap 1201 between the first coupling component 1207 at or near the first end 1202 of the adjustable connector strap 1201 and the first exterior end margin 1234 of the first pocket 1210*a*.

In still other embodiments of the portable exercise apparatus 1200 or assembly 1300, the second handgrip 1262 with the second flexible connector strap 1264 is releasably affixable to a second fixation ring 1252 that is affixed to the adjustable connector strap 1201 between the second coupling component 1208 at or near the second end 1203 of the adjustable connector strap and the second exterior end margin 1236 of the second pocket 1210*b*.

In some embodiments, the first handgrip 1261 and first flexible connector strap 1263 is configurable for storage within the first cavity 1243 of the first auxiliary storage pocket 1240. In some embodiments, the second handgrip 1262 and second flexible connector strap 1264 is configurable for storage within the second cavity 1247 of the second auxiliary storage pocket 1244.

Further still, in some embodiments, the portable exercise apparatus 1200 or assembly 1300 comprises at least a third handgrip 1266 with a third flexible strap 1268. Still further, in some embodiments, the portable exercise apparatus 1200 or assembly 1300 comprises a fourth handgrip 1267 with a fourth flexible strap 1269.

In some embodiments, the handgrip 1261, 1262, 1266, and 1267 is flexible. In some embodiments, the handgrip 1261, 1262, 1266, and 1267 is not flexible.

In some embodiments of the portable exercise apparatus 1200 or assembly 1300, any of the flexible connector straps 1263, 1264, 1268, 1269 for the handgrips 1261, 1262, 1266, 1267 are configurable with connector strap fixation rings 1275 for attachment to other components of the apparatus or assembly, typically using a carabiner 1272. In some embodiments, each of the ends of the flexible connector straps for the handgrips is configurable with a fixation ring 1275. In some embodiments, both ends of the flexible connector strap are sewn together creating a closed loop around the handle grip and further affixed with a single fixation ring 1275. In some embodiments, the fixation rings themselves are carabiners 1272.

In some embodiments of the portable exercise apparatus 1200 or assembly 1300, any of the tension bands 1270 are configurable with auxiliary fixation rings 1271 for attachment to the apparatus 1200 or assembly 1300 or other components thereof, typically using a carabiner 1272. In some embodiments, the auxiliary fixation rings themselves are carabiners 1272.

In any one of the embodiments of the portable exercise apparatus 1000, 1200, or assembly 1100, 1300, the tension bands 1070, 1270 are provided in pairs, each pair comprising matched tensions. In some embodiments, the assembly comprises multiple pairs of tension bands. In any one of the embodiments of the portable exercise apparatus assembly 1100, 1300 the tension band pairs are provided in tension ranges between about 5.0 lbs. and about 75.0 lbs., between about 5.0 lbs. and about 70.0 lbs., between about 5.0 lbs. and about 65.0 lbs., between about 5.0 lbs. and about 60.0 lbs., between about 5.0 lbs. and about 55.0 lbs., between about 5.0 lbs. and about 50.0 lbs., between about 5.0 lbs. and about 45.0 lbs., between about 5.0 lbs. and about 40.0 lbs., between about 5.0 lbs. and about 35.0 lbs., between about 5.0 lbs. and about 30.0 lbs., between about 5.0 lbs. and about 25.0 lbs., between about 5.0 lbs. and about 20.0 lbs., between about 5.0 lbs. and about 15.0 lbs., or between about 5.0 lbs. and about 10.0 lbs.

In any one of the embodiments of the portable exercise apparatus assembly 1300 the elastic tension band ranges are provided, in increments of about 2.5 lbs., in increments of about 5.0 lbs., in increments of about 7.5 lbs., in increments of about 10.0 lbs., in increments of about 12.5 lbs., in increments of about 15.0 lbs., in increments of about 17.5 lbs., in increments of about 20.0 lbs., in increments of about 22.5 lbs., or in increments of about 25.0 lbs.

In some embodiments of the portable exercise apparatus assembly 1100, 1300, the at least one releasably attachable elastic tension band 1270 ranges in length from about: 0.5- to about 2.0 feet, from about 1.0- to about 2.0 feet, from about 1.5- to about 2.0 feet; from about 1.5- to about 3.0 feet; from about 1.5- to about 4.0 feet; from about 1.5- to about 5.0 feet; from about 1.5-to about 6.0 feet; from about 1.5- to about 7.0 feet; from about 1.5- to about 8.0 feet; from about 1.5- to about 9.0 feet; and from about 0.5- to about 10.0 feet.

In still other embodiments of the portable exercise apparatus 1200 or assembly 1300, the first pocket securing mechanism 1204*a* for the first pocket 1210*a* and the second pocket securing mechanism 1204*b* for the second pocket 1210*b* comprise a zipper; a Velcro™ connection; a compression snap; a magnet; a buckle; a button; a clasp; a lace; a flexible material strap; a hook or a combination thereof.

In some embodiments of the portable exercise apparatus, the auxiliary storage pocket 1240, 1244 further comprises a cavity closure mechanism 1248, 1249 comprising a zipper; a Velcro™ connection; a compression snap; a magnet; a clasp; a flexible material strap; a hook or a combination thereof.

In some embodiments of the portable exercise apparatus 1200 or assembly 1300, the apparatus further comprises additional accessory components comprising: at least a third handgrip 1266 with a third flexible strap 1268; at least one suspension line 1280 configured to safely support the weight of a human adult; at least one tension band 1270; at least one accessory attachment connection device 1271, 1272; a door attachment device, doorknob attachment device or door frame attachment device (not shown).

In some embodiments, the suspension line 1280 comprises a permanently affixed auxiliary fixation ring 1271 at each end. In some embodiments, the suspension line comprises a releasably affixed carabiner 1272 at each end.

In some embodiments, the suspension line 1280 further comprises an adjustment device, friction hitch, or knot used to attach a loop of cord around a rope or to create a length adjustment. In some embodiments, the adjustment device is a ring 1271 or a carabiner 1272. In some embodiments, the adjustment device, friction hitch, or knot is a Prusik knot 1285.

In some embodiments of the portable exercise apparatus 1200 or assembly 1300, the apparatus further comprises detachable flexible or solid handles 1266, 1267 with flexible straps 1268, 1269; a door handle or hinge attachment feature (not shown); a suspension harness (not shown); a running parachute (not shown); a parachute cord (not shown); a coupling mechanism; a flexible water canteen; a drinking tube; a flow valve; a glove, first aid articles and one or more of a plurality of safety features.

In any one of the embodiments of the portable exercise apparatus 1200 or assembly 1300, the apparatus comprises wear-resistant material comprising: nylon; moleskin; polyester; polypropylene; aramid polymer fabric; Kevlar®; technical fabric; SuperFabric®; Cordura®; Spectra Shield®; Dyneema®; Tegris™ polypropylene; Innegra™; HB51; Protech®; Gold Shield®; polyethylene naphthalate (PEN); Vectran®; high-modulus polyethylene; ABC-Matrix © Technora®, Vectran®; Ultra High Molecular Weight Polyethylene (UHMWPE); Twaron®; Zylon®; Carbon Fiber; Mylar®; Chlorosulfonated polyethylene (Hypalon, CSPE, CSM) and/or leather.

In any one of the embodiments of the portable exercise apparatus 1200 or assembly 1300, the apparatus further comprises one or more of a plurality of safety features comprising: reflective tape; neon coloring; florescent coloring; a flashing light unit (not shown); RFID tracking device (not shown); GPS tracking device (not shown); or a geolocation device (not shown).

Provided herein is a portable exercise apparatus kit 1300 comprising: an adjustable connector strap 1201 comprising a first end 1202 and a second end 1203 spaced lengthwise from each other; a coupling mechanism assembly 1206 comprising a first coupling component 1207 at or near the first end of the adjustable connector strap and a second coupling component 1208 at or near the second end of the adjustable connector strap for releasably securing the first end of the adjustable connector strap to a section of the adjustable connector strap at or near the second end of the adjustable connector strap; a first releasably closeable pocket 1210*a* attached to and spaced along a first section of the adjustable connector strap comprising; an first interior space 1213*a* within the first releasably closeable pocket; a first exterior end margin 1234 and a first interior end margin 1235; a first exterior lengthwise margin 1230*a* adjoining the first exterior end margin and the second end margin, the first exterior lengthwise margin 1230*a* comprising a first edge 1220 and a second edge 1221, forming a first opening 1216*a* to the first interior space; and a second exterior lengthwise margin 1231*a* spaced apart from the first exterior lengthwise margin, forming a closed bottom to the first interior space of the first releasably closeable pocket; at least a first pocket securing mechanism 1204*a* configured to releasably capture the first edge and the second edge to at least partially close the first opening to the first interior space of the first releasably closeable pocket; a second releasably closable pocket 1210*b* attached to and spaced along a second section of the adjustable connector strap comprising: a second interior space 1213*b* within the second releasably closeable pocket, a second exterior end margin 1236 and a second interior end margin 1237; a third exterior lengthwise margin 1230*b* adjoining the second exterior end margin and the second interior end margin, the third exterior lengthwise margin 1230*b* comprising a third edge 1224 and a fourth edge 1225, forming a first opening 1216*b* to the second interior space within the second releasably closeable pocket; and a fourth exterior lengthwise margin 1231*b* spaced apart from the third exterior lengthwise margin, forming a closed bottom to the second interior space of the second releasably closeable pocket; at least a second pocket securing mechanism 1204*b* configured to releasably capture the third edge and the fourth edge to at least partially close the first opening to the second interior space of the second releasably closeable pocket; a connecting section 1238 positioned between the first interior end margin 1235 of the first releasably closeable pocket 1210*a* and the second interior end margin 1237 of the second releasably closeable pocket 1210*b*; wherein the adjustable connector strap 1201 is affixed lengthwise to a surface of the first releasably closeable pocket 1210*a*, optionally affixed to a surface of the connecting section 1238, and affixed to a surface of the second releasably closeable pocket 1210*b*, such that the first end 1202 and the second end 1203 of the adjustable connector strap 1201 protrude past the first exterior end margin 1234 of the first pocket and the second exterior end margin 1236 of the second pocket, a first fixation ring 1251; a second fixation ring 1252; and a third fixation ring 1253; wherein the first fixation ring is affixed to the adjustable connector strap near the first end of the adjustable connector strap, the second fixation ring is affixed to the adjustable connector strap near the second end of the adjustable connector strap, and the third fixation ring is affixed to apportion of the portable exercise apparatus between the first pocket and the second pocket approximately equidistant between the first fixation ring and the second fixation ring, at least one handgrip 1261, 1262 with at least one flexible strap 1263, 1264; at least one auxiliary storage pocket 1240, 1244; at least one suspension line 1280 configured to safely support the weight of human adult; at least one tension band 1270; at least one accessory attachment connection device 1271, 1272; a door attachment device or doorframe attachment device.

In some embodiments of the portable exercise apparatus kit 1300, the portable exercise apparatus comprises a first fixation ring 1251 and a second fixation ring 1252; wherein the first fixation ring is a releasably affixable carabiner 1272 affixable to the adjustable connector strap between the first coupling component 1207 at or near the first end of the adjustable connector strap and the first exterior end margin 1234 of the first pocket, and wherein the second fixation ring is a releasably affixable carabiner affixable to the adjustable connector strap between the second coupling component 1208 at the second end of the adjustable connector strap and the second exterior end margin 1236 of the second pocket.

In some embodiments of the portable exercise apparatus kit 1300, the portable exercise apparatus comprises a third fixation ring 1253, wherein the third fixation ring is a releasably affixable carabiner 1272 affixable to the portable exercise apparatus between the first pocket and the second pocket at the connecting section, approximately equidistant between the first fixation ring and the second fixation ring. In some embodiments of the kit, the third fixation ring is a releasably affixable carabiner affixed to the adjustable connector strap between the first pocket and the second pocket at the connecting section.

In some embodiments of the portable exercise apparatus kit 1300, the connecting section 1238 comprises: a separate intermediate piece of material, an extension at the end of the first pocket 1210*a*, beyond the first interior end margin 1235 of the first pocket joined to an extension at the end of the second pocket 1210*b*, beyond the second interior end margin 1237 of the second pocket, the adjustable connector strap 1201, or a combination thereof.

In some embodiments of the portable exercise apparatus kit 1300, the kit further comprises additional accessory components comprising: at least a third handgrip 1266 with a third flexible strap 1268; at least one suspension line 1280 configured to safely support the weight of a human adult; at least one tension band 1270; at least one accessory attachment connection device 1271, 1272; a door attachment device, doorknob attachment device or door frame attachment device (not shown).

In some embodiments of the portable exercise apparatus kit 1300, any of the tension bands 1270 are configurable with auxiliary fixation rings 1271 for attachment to the apparatus 1200 or assembly 1300 or other components thereof, typically using a carabiner 1272. In some embodiments, the auxiliary fixation rings themselves are carabiners 1272. In some embodiments of the kit, the suspension line 1280 comprises a permanently affixed auxiliary fixation ring 1271 at each end. In some embodiments, the suspension line comprises a releasably affixed carabiner 1272 at each end.

In some embodiments of the portable exercise apparatus kit 1300, the kit comprises multiple pairs of tension bands. In any one of the embodiments of the kit, the tension band pairs are provided in tension ranges between about 5.0 lbs. and about 75.0 lbs., between about 5.0 lbs. and about 70.0 lbs., between about 5.0 lbs. and about 65.0 lbs., between about 5.0 lbs. and about 60.0 lbs., between about 5.0 lbs. and about 55.0 lbs., between about 5.0 lbs. and about 50.0 lbs., between about 5.0 lbs. and about 45.0 lbs., between about 5.0 lbs. and about 40.0 lbs., between about 5.0 lbs. and about 35.0 lbs., between about 5.0 lbs. and about 30.0 lbs., between about 5.0 lbs. and about 25.0 lbs., between about 5.0 lbs. and about 20.0 lbs., between about 5.0 lbs. and about 15.0 lbs., or between about 5.0 lbs. and about 10.0 lbs.

In any one of the embodiments of the portable exercise apparatus kit 1300, the elastic tension band ranges are provided, in increments of about 2.5 lbs., in increments of about 5.0 lbs., in increments of about 7.5 lbs., in increments of about 10.0 lbs., in increments of about 12.5 lbs., in increments of about 15.0 lbs., in increments of about 17.5 lbs., in increments of about 20.0 lbs., in increments of about 22.5 lbs., or in increments of about 25.0 lbs.

In any one of the embodiments of the portable exercise apparatus kit 1300, the at least one releasably attachable elastic tension band 1270 ranges in length from about: 0.5- to about 2.0 feet, from about 1.0- to about 2.0 feet, from about 1.5- to about 2.0 feet; from about 1.5- to about 3.0 feet; from about 1.5- to about 4.0 feet; from about 1.5- to about 5.0 feet; from about 1.5- to about 6.0 feet; from about 1.5- to about 7.0 feet; from about 1.5- to about 8.0 feet; from about 1.5- to about 9.0 feet; and from about 0.5- to about 10.0 feet.

In some embodiments of the kit 1300, the suspension line 1280 further comprises an adjustment device, friction hitch, or knot used to attach a loop of cord around a rope or to create a length adjustment. In some embodiments, the adjustment device is a ring 1271 or a carabiner 1272. In some embodiments, the adjustment device, friction hitch, or knot is a Prusik knot 1285.

In some embodiments of the portable exercise apparatus kit 1300, the apparatus further comprises detachable flexible or solid handles 1266, 1267 with flexible straps 1268, 1269; a door handle or hinge attachment feature (not shown); a suspension harness (not shown); a running parachute (not shown); a parachute cord (not shown); a coupling mechanism; a flexible water canteen; a drinking tube; a flow valve; a glove, first aid materials, and one or more of a plurality of safety features.

Still further, in any one of the embodiments of the portable exercise apparatus kit 1300, the portable exercise apparatus comprises a handgrip with a flexible connector strap that is convertible to a doorframe attachment device configured with connector strap fixation rings, wherein the handgrip is configurable for placement between a doorframe and a closed door such that the flexible connector strap with connector strap fixation rings extend past the frame and the closed door and can be attached to the portable exercise apparatus, or any of a plurality of the exercise apparatus accessories.

In some embodiments of the portable exercise apparatus kit 1300, the apparatus is configured from or comprises wear-resistant material comprising: nylon; moleskin; polyester; polypropylene; aramid polymer fabric; Kevlar®; technical fabric; SuperFabric®; Cordura®; Spectra Shield®; Dyneema®; Tegris™ polypropylene; Innegra™; HB51; Protech®; Gold Shield®; polyethylene naphthalate (PEN); Vectran®; high-modulus polyethylene; ABC-Matrix © Technora®, Vectran®; Ultra High Molecular Weight Polyethylene (UHMWPE); Twaron®; Zylon®; Carbon Fiber; Mylar®; Chlorosulfonated polyethylene (Hypalon, CSPE, CSM) and/or leather.

In some embodiments of the portable exercise apparatus kit 1300, the apparatus further comprises one or more of a plurality of safety features comprising: reflective tape; neon coloring; florescent coloring; a flashing light unit (not shown); RFID tracking device (not shown); GPS tracking device (not shown); or a geolocation device (not shown).

Provided herein is a method of using an exercise apparatus comprising: providing a strap-like apparatus adapted to be worn about the user's body, wherein the strap-like apparatus comprises at least a first layer and a second layer, wherein the first layer comprises a first inside surface and a first outside surface and the second layer comprises a second inside surface and a second outside surface; providing at least one pocket between the first layer and the second layer; attaching a connector strap comprising a first end and a second end and affixed to the outside surface or inside surface of the first layer, wherein the connector strap comprises a coupling mechanism for releasably securing the first end and second end of the connector strap to each other; affixing a first handle and a second handle to the connector strap or directly to an outside surface of the exercise apparatus, wherein each first handle and second handle is spaced approximately equidistant from the lengthwise center of the strap-like apparatus; affixing a first fixation ring adjacent to a first end of the strap-like apparatus, extending outside of the pocket; and affixing a second fixation ring adjacent to a second end of the strap-like apparatus, extending outside of the pocket; affixing a third fixation ring to the to the connector strap at the approximate lengthwise center of the strap-like apparatus connector strap and making it accessible through an access point in the layers of the strap-like apparatus; wherein the strap-like apparatus is adapted for exercising various muscle groups of the body of a user when performing suspension exercises, resistance exercises, stretching exercises, aerobic exercises, or other combination exercises with said apparatus as a component of a total body workout.

In some embodiments of the method, the strap-like apparatus is removed from the user's body and wrapped about a stable vertical or horizontal structure such as a tree or pole, wherein a first end of a first elastic band and a first end of a second elastic band are affixed to any two of the fixation rings of the strap-like apparatus, wherein the user performs resistance or stretching exercises with the elastic bands while holding the bands with the hands.

In some embodiments of the method, the resistance exercises comprise: pulling; pushing; spinal flexion; spinal extension; spinal rotation; shoulder internal rotation; shoulder external rotation; lateral flexion; shoulder abduction; shoulder adduction; shoulder flexion; and shoulder extension. In some embodiments of the method, the resistance exercises comprise arm curls; and arm extensions.

In some embodiments of the method, the stretching exercises comprise: pulling; pushing; leg extension, hamstring extension, spinal flexion; spinal extension; spinal rotation; shoulder internal rotation; shoulder external rotation; lateral flexion; shoulder abduction; shoulder adduction; shoulder flexion; and shoulder extension.

In some embodiments of the method, the strap-like apparatus is removed from the user's body and wrapped about a stable vertical or horizontal structure such as a tree or pole, wherein a first end of a first elastic band is affixed to any one of the fixation rings of the strap-like apparatus, a detachable flexible handle is wrapped around the user's ankle or foot and attached the second end of the first elastic band, wherein the user performs limb resistance exercises with the elastic bands with their legs.

In some embodiments of the method, the resistance exercises comprise: hip abduction; hip adduction; dorsiflexion; plantarflexion; knee extension; knee flexion; hip flexion; hip extension; eversion; inversion; and lateral resistance steps.

In some embodiments of the method, the strap-like apparatus is removed from the user's body and suspended about a hanging structure capable of supporting the user, wherein the user performs pull-ups or chin-ups utilizing any the handles affixed to the strap-like apparatus.

In some embodiments of the method, the strap-like apparatus is removed from the user's body and suspended about a hanging structure capable of supporting the user, wherein the first end of a first elastic band and the first end of a second elastic band are each affixed to any of the fixation rings; a first end of a flexible strap handle is connected to the second end of the first elastic band and a second end of the detachable flexible handle is connected to the second end of the second strap-like apparatus, creating a suspended strap step; wherein the user can step or kneel on the suspended strap step while grasping any of the affixed handles of the strap-like apparatus and performing assisted suspension exercises, such as assisted pull-ups or chin-ups.

As illustrated in FIG. 9, a user can suspend the apparatus 100 over a structure capable of supporting a weight in excess of the user 1, such as a large tree limb 2, and performing various strength-building exercises, such as pull-ups or assisted pull-ups. As illustrated herein, a user 1 is performing assisted pull-ups by kneeling in a suspended elastic band 900, while grasping the apparatus handles 111, allowing the elastic bands 900 to partially support his/her weight during the exercise. Of course, it would be obvious to one skilled in the art that the user can perform the same exercise without the assistance of the elastic bands 900.

In some embodiments of the method, the first end of at least a first elastic band is affixed to any of the fixation rings of the strap-like apparatus, wherein the user performs limb resistance exercises with an elastic band while holding the band in a hand with the strap-like apparatus secured about the user's waist.

In some embodiments of the method, the first end of a first elastic band is affixed to any of the fixation rings of the strap-like apparatus, wherein the user performs limb resistance exercises with an elastic band in a hand while holding the band and standing on the strap-like apparatus with the user's feet or kneeling on the strap-like apparatus.

In some embodiments of the method, the resistance exercises comprise elbow flexion; elbow extension; shoulder abduction; shoulder internal rotation, shoulder external rotation; shoulder extension; shoulder flexion; lateral flexion; and tension squatting exercises.

In some embodiments of the method, the first end of a first elastic band is affixed to the fixation ring located on the outside surface of the strap-like apparatus, the second end of the first elastic band comprising a quick-release attachment coupling is affixed to an anchoring point of a stationary structure, wherein the user performs resistance running exercises with the elastic band providing a resistance force while the strap-like apparatus is secured about the user's waist.

In some embodiments of the method, the first end of a first elastic band is affixed to the fixation ring located on the outside surface of the strap-like apparatus, (the center of connecting strap) the second end of the first elastic band comprising a quick-release attachment coupling with a detachable handle is held by another person, wherein the user performs resistance running exercises with the elastic band and other person providing a resistance force while the strap-like apparatus is secured about the user's waist.

In some embodiments of the method, the first end of a first elastic band is affixed to the fixation ring located on the outside surface of the strap-like apparatus, (the center of connecting strap) the second end of the first elastic band comprising an attached handle is held by another person, wherein the user performs resistance running exercises with the elastic band while the strap-like apparatus is secured about the user's waist.

In some embodiments of the method, the first end of a first elastic band is affixed to the fixation ring located on the outside surface of the strap-like apparatus, (center of connecting strap) the second end of the first elastic band comprising a quick-release attachment coupling is affixed to an anchoring point of a stationary structure, wherein the user performs resistance running exercises with the elastic band while the strap-like apparatus is secured about the user's body as a bandolier or waist.

In some embodiments of the method, the first end of a first elastic band is affixed to the fixation ring located in the lengthwise center of the strap-like apparatus, the second end of the first elastic band comprising an optional handle is held by another person, wherein the user performs resistance running exercises with the elastic band while the strap-like apparatus is secured about the user's body as a bandolier or waist.

In some embodiments of the method, at least a second band is affixed to the fixation ring located in outer surface of the first layer of the strap-like apparatus for additional resistance.

In some embodiments of the method, the first end of a first elastic band and the first end of a second elastic band are each affixed to any of the fixation rings; the second end of the first elastic band and the second end of the second elastic band each comprising a quick-release attachment coupling are each affixed to an anchoring point of a stationary structure above the user capable of supporting the user's weight, wherein the user can step on the suspended strap-like apparatus, while grasping the stationary structure above the user's head and performing assisted suspension exercises.

Provided herein is a kit for an exercise apparatus comprising a strap-like apparatus adapted to be worn about the user's body, wherein the strap-like apparatus comprises at least a first layer and a second layer, wherein the first layer comprises a first inside surface and a first outside surface and the second layer comprises a second inside surface and a second outside surface; at least one pocket between the first layer and the second layer; a connector strap comprising a first end and a second end and affixed to the outside surface or inside surface of the first layer, wherein the connector strap comprises a coupling mechanism for releasably securing the first end and second end of the connector strap to each other; a first handle and a second handle affixable to the connector strap or directly to an outside surface of the exercise apparatus, wherein each first handle and second handle is spaced approximately equidistant from the lengthwise center of the strap-like apparatus; at least one fixation ring affixed to the apparatus; and at least one releasably attachable elastic band.

In some embodiments of the kit, the strap-like apparatus comprises a third layer, wherein the third layer comprises a third inside surface and a third outside surface.

In some embodiments of the kit, the third layer is an extension of the first layer and folds over the second layer to enclose the at least one pocket between the first inside surface and the second inside surface.

In some embodiments of the kit, the layers are formed from a single piece of folded material.

In some embodiments of the kit, the layers are formed from two or more pieces of material and joined along their lengthwise edges.

In some embodiments of the kit, the at least one fixation ring is located at the approximate lengthwise center of the connector strap and accessible through an access point in the layers of the strap-like apparatus.

In some embodiments, the kit further comprises a detachable flexible or solid handles with flexible straps; a running parachute; a suspension cord; a suspension harness; a parachute cord; a coupling mechanism; a flexible water canteen; a glove; a drinking tube; a flow valve and one or more of a plurality of safety features.

In some embodiments, the kit further comprises a second fixation ring affixed adjacent to a first end of the strap-like apparatus, extending outside of the pocket and a third fixation ring affixed adjacent to a second end of the strap-like apparatus, extending outside of the pocket, wherein the second and third fixation rings are affixed between the first and second layers and to the connector strap or are affixed directly to the connector strap.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein could be employed in practicing the invention. It is intended that the following claims define the scope of the invention and that methods and structures within the scope of these claims and their equivalents be covered thereby.

What is claimed is:

1. A portable exercise apparatus comprising:

an adjustable connector strap comprising a first end and a second end spaced lengthwise from each other;

a coupling mechanism assembly comprising a first coupling component at the first end of the adjustable connector strap and a second coupling component at or near the second end of the adjustable connector strap for releasably securing the first end of the adjustable connector strap to a section of the adjustable connector strap at or near the second end of the adjustable connector strap;

a releasably closeable pocket, affixed lengthwise to the adjustable connector strap, the pocket comprising;

at least a first medial exterior surface and a first lateral exterior surface;

an interior space within the releasably closeable pocket comprising at least a first medial interior surface and a first lateral interior surface;

a first exterior end margin at a first end of the pocket and a second exterior end margin at a second end of the pocket;

a first exterior lengthwise margin comprising a first edge and a second edge, forming an opening to the interior space of the pocket;

a second exterior lengthwise margin spaced apart from the first exterior lengthwise margin, forming a closed bottom to the interior space of the pocket;

at least one pocket securing mechanism configured to releasably capture the first edge and the second edge, to at least partially close the opening to the interior space of the releasably closable pocket;

wherein the first exterior end margin and the second exterior end margin are spaced apart from each other at opposite ends of the pocket along the adjustable connector strap, wherein the first and second exterior lengthwise margins are spaced apart from each other and positioned longitudinally between the first exterior end margin and second exterior end margin, wherein the first exterior lengthwise margin and the second exterior lengthwise margin adjoin the first exterior end margin and the second exterior end margin, and wherein the adjustable connector strap is affixed lengthwise to a surface of the releasably closeable pocket, such that the first end and the second end of the adjustable connector strap protrude past the first exterior end margin and the second exterior end margin, a first fixation ring;

a second fixation ring; and a third fixation ring;

wherein the first fixation ring is affixed to the adjustable connector strap between the first coupling component and the first exterior end margin of the pocket, wherein the second fixation ring is affixed to the adjustable connector strap between the second coupling component and the second exterior end margin of the pocket, and wherein the third fixation ring is affixed to the portable exercise apparatus at or about the approximate lengthwise center of the releasably closeable pocket, approximately equidistant between the first fixation ring and the second fixation ring.

2. The portable exercise apparatus of claim 1, further comprising:

a first auxiliary storage pocket having a first end, a second end and a first cavity therebetween; and a second auxiliary storage pocket having a third end, a fourth end and a second cavity therebetween;

wherein the first auxiliary storage pocket and second auxiliary storage pocket are spaced apart lengthwise from each other and affixed on or about the second exterior lengthwise margin.

3. The portable exercise apparatus of claim 2, further comprising a first handgrip with a first flexible connector strap and a second handgrip with a second flexible connector strap.

4. The portable exercise apparatus of claim 3, wherein the first handgrip and the second handgrip are configurable for storage within the first auxiliary storage pocket and the second auxiliary storage pocket.

5. A portable exercise apparatus kit comprising:

an adjustable connector strap comprising a first end and a second end spaced lengthwise from each other;

a coupling mechanism assembly comprising a first coupling component at the first end of the adjustable connector strap and a second coupling component at or near the second end of the adjustable connector strap for releasably securing the first end of the adjustable connector strap to a section of the adjustable connector strap at or near the second end of the adjustable connector strap;

a first releasably closeable pocket attached to and spaced along a first section of the adjustable connector strap comprising;

a first interior space within the first releasably closeable pocket;

a first exterior end margin and a first interior end margin;

a first exterior lengthwise margin adjoining the first exterior end margin and the first interior end margin, the first exterior lengthwise margin comprising a first edge and a second edge, forming a first opening to the first interior space; and a second exterior lengthwise margin spaced apart from the first exterior lengthwise margin, forming a closed bottom to the first interior space of the first releasably closeable pocket;

at least a first pocket securing mechanism configured to releasably capture the first edge and the second edge to at least partially close the first opening to the first interior space of the first releasably closeable pocket;

a second releasably closable pocket attached to and spaced along a second section of the adjustable connector strap comprising:

a second interior space within the second releasably closeable pocket;

a second exterior end margin and a second interior end margin;

a third exterior lengthwise margin adjoining the second exterior end margin and the second interior end margin, comprising a third edge and a fourth edge, forming a first opening to the second interior space within the second releasably closeable pocket; and a fourth exterior lengthwise margin spaced apart from the third exterior lengthwise margin, forming a closed bottom to the second interior space of the second releasably closeable pocket;

at least a second pocket securing mechanism configured to releasably capture the third edge and the fourth edge to at least partially close the first opening to the second interior space of the second releasably closeable pocket;

a connecting section positioned between the first interior end margin of the first releasably closeable pocket and the second interior end margin of the second releasably closeable pocket;

wherein the adjustable connector strap is affixed lengthwise to a surface of the first releasably closeable pocket, and a surface of the second releasably closeable pocket, such that the first end and the second end of the adjustable connector strap protrude past the first exterior end margin of the first pocket and the second exterior end margin of the second pocket, a first fixation ring;

a second fixation ring; and a third fixation ring;

wherein the first fixation ring is affixed to the adjustable connector strap at or near the first end of the adjustable connector strap, the second fixation ring is affixed to the adjustable connector strap at or near the second end of the adjustable connector strap, and the third fixation ring is affixed to the portable exercise apparatus between the first pocket and the second pocket at the connecting section, a handgrip with a flexible strap;

an auxiliary storage pocket;

a suspension line;

a tension band;

an accessory attachment connection device; or a door attachment device.

6. A portable exercise apparatus comprising:

an adjustable connector strap comprising a first end and a second end spaced lengthwise from each other;

a coupling mechanism assembly comprising a first coupling component at the first end of the adjustable connector strap and a second coupling component at or near the second end of the adjustable connector strap for releasably securing the first end of the adjustable connector strap to a section of the adjustable connector strap at or near the second end of the adjustable connector strap;

a first releasably closeable pocket attached to and spaced along a first section of the adjustable connector strap comprising;

a first medial exterior surface and a first lateral exterior surface, an first interior space within the first releasably closeable pocket comprising a first medial interior surface and a first lateral interior surface, a first exterior end margin and a first interior end margin;

wherein the first exterior end margin and the first interior end margin are spaced apart lengthwise from each other along the first section of the adjustable connector strap at opposite ends of the first releasably closeable pocket, a first exterior lengthwise margin adjoining the first exterior end margin and the second end margin, the first exterior lengthwise margin comprising a first edge and a second edge, forming a first opening to the first releasably closeable pocket; and a second exterior lengthwise margin spaced apart from the first exterior lengthwise margin, forming a closed bottom to interior space of the first releasably closeable pocket;

wherein the first exterior lengthwise margin and second exterior lengthwise margin are positioned longitudinally along the first section of the adjustable connector strap between the first exterior end margin and first interior end margin;

wherein the first exterior end margin comprises a fifth edge and a sixth edge, forming a second opening to the first releasably closeable pocket, and wherein the first interior end margin forms a closed end to the first interior space of the first releasably closeable pocket, and at least a first pocket securing mechanism configured to releasably capture the first edge, the second edge, the fifth edge and the sixth edge to at least partially close the first and second opening to the first interior space of the first releasably closeable pocket;

a second releasably closable pocket attached to and spaced along a second section of the adjustable connector strap comprising:

a second medial exterior surface and a second lateral exterior surface, a second interior space within the second releasably closeable pocket comprising a second medial interior surface and a second lateral interior surface, a second exterior end margin and a second interior end margin;

wherein the second exterior end margin and the second interior end margin are spaced apart lengthwise from each other at opposite ends of the second releasably closeable pocket along the second section of the adjustable connector strap, a third exterior lengthwise margin adjoining the second exterior end margin and the second interior end margin, the third exterior lengthwise margin comprising a third edge and a fourth edge, forming a first opening to the second interior space within the second releasably closeable pocket; and a fourth exterior lengthwise margin spaced apart from the third exterior lengthwise margin, forming a closed bottom to the second interior space of the second releasably closeable pocket;

wherein the third exterior lengthwise margin and fourth exterior lengthwise margin are positioned longitudinally between the second exterior end margin and second interior end margin, wherein the second exterior end margin comprises a seventh edge and a eighth edge, forming a second opening to the second interior space of the second releasably closeable pocket, and wherein the second interior end margin forms a closed end to the second interior space of the second releasably closeable pocket, at least a second pocket securing mechanism configured to releasably capture the third edge, the fourth edge, the seventh edge and the eighth edge to at least partially close the first and second opening to the second interior space of the second releasably closeable pocket; and a connecting section positioned between the first interior end margin of the first releasably closeable pocket and the second interior end margin of the second releasably closeable pocket;

wherein the adjustable connector strap is affixed lengthwise to a surface of the first releasably closeable pocket and a surface of the second releasably closeable pocket, such that the first end and the second end of the adjustable connector strap protrude past the first exterior end margin of the first pocket and the second exterior end margin of the second pocket.

7. The portable exercise apparatus of claim 6, further comprising a first auxiliary storage pocket having a first end, a second end, and a first cavity therebetween, affixed to the apparatus.

8. The portable exercise apparatus of claim 7, further comprising: a second auxiliary storage pocket having a third end, a fourth end, and a second cavity therebetween, affixed to the apparatus.

9. The portable exercise apparatus of claim 8, wherein the first auxiliary storage pocket is affixable on or about the second exterior lengthwise margin and the second auxiliary storage pocket is affixable on or about the fourth exterior lengthwise margin.

10. The portable exercise apparatus of claim 6, further comprising:

a first fixation ring; and a second fixation ring;

wherein the first fixation ring is affixed to the adjustable connector strap between the first coupling component and the first exterior end margin of the first pocket, and wherein the second fixation ring is affixed to the adjustable connector strap between the second coupling component and the second exterior end margin of the second pocket.

11. The portable exercise apparatus of claim 10, further comprising:

a third fixation ring;

wherein the third fixation ring is affixed to the portable exercise apparatus between the first pocket and the second pocket at the connecting section, approximately equidistant between the first fixation ring and the second fixation ring.

12. The portable exercise apparatus of claim 9, further comprising a first handgrip with a first flexible strap and a second handgrip with a second flexible strap.

13. The portable exercise apparatus of claim 12, wherein the first handgrip with the first flexible strap and the second handgrip with the second flexible strap are configurable for storage within the first auxiliary storage pocket and the second auxiliary storage pocket.

14. The portable exercise apparatus of claim 12, wherein the first handgrip with the first flexible strap is permanently affixed to the adjustable connector strap between the first coupling component and the first exterior end margin of the first pocket, and wherein the second handgrip with the second flexible strap is permanently affixed to the adjustable connector strap between the second coupling component and the second exterior end margin of the second pocket.

15. The portable exercise apparatus of claim 12, wherein the first handgrip with the first flexible strap or a third handgrip with a third flexible strap is releasably affixable to a first fixation ring that is permanently affixed to the adjustable connector strap between the first coupling component and the first exterior end margin of the first pocket, and wherein the second handgrip with the second flexible strap or a fourth handgrip with a fourth flexible strap is releasably affixable to a second fixation ring that is permanently affixed to the adjustable connector strap between the second coupling component and the second exterior end margin of the second pocket.

16. The portable exercise apparatus of claim 6, wherein the at least first pocket securing mechanism and the at least second pocket securing mechanism comprise:

a zipper;
a Velcro™ connection;
a hook and loop connection;
a compression snap;
a magnet;
a buckle;
a button;
a clasp;
a lace;
a flexible material strap;
a hook; or
a combination thereof.

17. The portable exercise apparatus of claim 9, wherein the first auxiliary storage pocket and the second auxiliary storage pocket further comprise a cavity closure mechanism comprising:

a zipper;
a Velcro™ connection;
a hook and loop connection;
a compression snap;
a magnet;
a clasp;
a flexible material strap;
a hook; or
a combination thereof.

18. The portable exercise apparatus of claim 12, further comprising additional accessory components comprising:

at least a third handgrip with a third flexible strap;
at least one suspension line;
at least one tension band;
at least one accessory attachment connection device; or
a doorframe attachment device;

wherein the doorframe attachment device comprises a handgrip with a flexible connector strap and connector strap fixation rings that is convertible to a doorframe attachment device configured for placement between a doorframe and a closed door.

19. The portable exercise apparatus of claim 6, configured with wear-resistant material comprising: nylon; moleskin; polyester; polypropylene; aramid polymer fabric; Kevlar®; technical fabric; SuperFabric®; Cordura® Spectra Shield®; Dyneema®; Tegris™ polypropylene; Innegra™; HB51; Protech®; Gold Shield®; polyethylene naphthalate (PEN); Vectran®; high-modulus polyethylene; ABC-Matrix © Technora®, Vectran®; Ultra High Molecular Weight Polyethylene (UHMWPE); Twaron®; Zylon®; Carbon Fiber; Mylar®; Chlorosulfonated polyethylene (Hypalon, CSPE, CSM) and/or leather.

* * * * *